United States Patent [19]

Brandon

[11] 3,981,624

[45] Sept. 21, 1976

[54] SONIC OR ENERGY WAVE GENERATOR AND MODULATOR

[75] Inventor: Clarence W. Brandon, Nashville, Tenn.

[73] Assignee: Orpha B. Brandon, Nashville, Tenn. ; a part interest

[22] Filed: Oct. 12, 1973

[21] Appl. No.: 406,045

Related U.S. Application Data

[63] Continuation-in-part of Ser. No. 611,082, Jan. 23, 1967, Pat. No. 3,765,804, which is a continuation-in-part of Ser. No. 665,995, June 17, 1957, Pat. No. 3,302,720, which is a continuation-in-part of Ser. Nos. 296,038, June 27, 1952, Pat. No. 2,866,509, and Ser. No. 241,647, Aug. 13, 1951, Pat. No. 2,796,109.

[52] U.S. Cl. ..... 417/53; 417/240; 166/177

[51] Int. Cl.[2] ..... F04B 49/00; F04B 47/00

[58] Field of Search ..... 417/240, 53, 54, 241, 417/437; 166/177

[56] References Cited

UNITED STATES PATENTS

| | | | |
|---|---|---|---|
| 2,437,456 | 3/1948 | Bodine | 166/177 |
| 3,006,154 | 10/1961 | Brandon | 417/240 |
| 3,255,601 | 6/1966 | Brandon | 166/177 |

FOREIGN PATENTS OR APPLICATIONS

| | | | |
|---|---|---|---|
| 462,509 | 3/1926 | Germany | 417/241 |

*Primary Examiner*—William L. Freeh

[57] ABSTRACT

A sonic or energy wave generator to create and transmit sonic or energy waves of controllable and variable characteristics and which may be utilized to transport sensible heat at sonic velocities to sonic wave or heat reception locations. Self induced or artificially created liquid-gas phase changes are a means for this sonic wave or heat reception, which may be at the surface as in ore reduction, concrete breaking, ice breaking or various extrusion or pressing operations, or in subsurface operations through well bores to selectively and variably mine ores, treat fluid containing formations or to drive various subsurface fluids to adjacent well bores.

41 Claims, 79 Drawing Figures

12
12
120
128
126
118
104
110
124
122
130
112
132
114
116
134
106
108
82
50
100
102
58

352
330
338
332
350

260
264
300
328
16
344
338
174
176
80
170
208
278
174
344
340
56
58
266
214
172

170
212
170
210
170
208

194
170
200
202
198
178
204
218
206
172
180
182

586
588
580
592
582

634
658
640
656

608
600
650
560
598
580
614
586
574

116
616
620
642
658
652
640
657
620
654
656
666
662
672
660
664
670
678
674
676
683
680
681
678

848
966
970
944
936
964
965
948
930
932
934
946
972
952
982
950
954
994
960
962
940
938
942
768
986
984
988
990
992

A
L
L'
C
H
F
E
E'
J
N
K
G
I
D
M'
B
M

SONIC OR ENERGY WAVE GENERATOR AND MODULATOR

CROSS-REFERENCES TO RELATED APPLICATIONS

This invention comprises improvements in sonic or energy wave generation and modulation for producing variable and selectable sonic wave forms which are usable for carrying variable types of modulations and heat to a sonic wave or heat reception location and constitutes a continuation-in-part of my application Ser. No. 611,082 filed Jan. 23, 1967 now Pat. No. 3,765,804, which is a continuation-in-part of my prior application Ser. No. 665,995 filed June 17, 1957 now Pat. No. 3,302,720, which in turn is a continuation-in-part of my original applications Ser. No. 296,038 filed June 27, 1952 now Pat. No. 2,866,509 and Ser. No. 241,647 filed Aug. 13, 1951 now Pat. No. 2,796,109.

BACKGROUND OF THE INVENTION

Broadly this invention discloses above and below surface formation treatment by sonic or energy wave generation and modulation generally in Class 166 of the United States Patent Office classification, and includes subject matter which has been continued through co-pending applications since Aug. 13, 1951, portions of which have been divided or otherwise carved therefrom into issued patents or are now in co-pending applications.

The art prior to applicant's above filing date is typified by the Sherborne U.S. Pat. No. 2,670,801, Bodine U.S. Pat. No. 2,355,618 and subsequent Bodine U.S. Pat. Nos. 2,667,932, 2,871,943, 3,016,093, 3,016,095, and Re: 23,381. All of these references have a common denominator in the creation and utilization of sonic standing waves. This invention, on the other hand, provides for the creation and utilization of variable types of sonic or energy waves which are utilized as a carrier means for transporting variations of modulations of these waves or heat to a designated reception location such as a liquid-gas interface within permeable or porous formations or structures.

SUMMARY AND OBJECTS

The primary object of this invention is to provide a sonic or energy wave generator and modulator for producing and transmitting sonic or energy waves of variable characteristics or heat content in a fluid medium to a designated reception location.

The primary specific object of this invention is to provide means for treating various permeable or porous formations which contain or into which is injected fluids which will receive sonic or energy waves or sensible heat as transmitted thereto from the sonic wave generator and modulator of the first above object.

A very important object of this invention is to provide a sonic wave generator and transmitter of variable characteristics and heat content of transmitted waves specifically adapted for use in oil and gas wells and effectively treating the same by fracturing, acidizing, cementing, cleaning, water and gas flooding for the secondary and tertiary recovery of fluids from productive formations, drilling and for testing operations relative to any of the above.

Another important object is to utilize the generator and modulator of the first above object for widely diversified uses such as tunneling, drilling, breaking of concrete, mining of various ores, reduction or ores, pumping of fluids, various pressing operations, extrusion of materials, recrystallization of materials, ice breaking, structure deforming, prestressing or compacting of materials, quarrying, dyeing or disassociation of fibers, as well as the use as a seismic signal source for delineation of subsurface formations or fluids, whether onshore or in marine operations.

A more specific object of the invention is to provide a variable stroke pump for generating in a fluid medium energy carrying waves of various predetermined characteristics.

Another specific object is to provide a sonic or energy wave generator wherein the energy content of the generated and transmitted wave may be increased or decreased by applying or withdrawing heat from the medium supplied to the generator.

A still more specific object is to provide an apparatus for producing sonic or energy carrying waves by means or a variably reciprocated piston and wherein a pair of variably timed crankshafts are each adjustably connected to a rocker and slide mechanism driving said piston in order to controllably vary thereby the stroke of the latter.

An additional specific object is to provide a reciprocating piston type of pump, especially adapted for use as a generator of an energy carrying wave wherein a more perfect and self compensating counterbalancing of the pump pistons and the various moving parts is obtained.

Still another specific object is to provide a wave generating pump having means for storing energy therein from the fluid medium with which the pump is associated.

Yet another specific object is to provide a wave generating pump assembly having a means for adjustably reloading pump and/or counterbalance cylinders with an adjustable fluid pressure.

A further specific object is to provide a reciprocating piston pump assembly specifically adapted for the generation of sonic or energy carrying waves in a fluid medium and wherein a pump cylinder and a piston and a counterbalance cylinder and piston are interconnected and are each operatively connected whereby to balance out pulsations and vibrations in the mechanism.

Another object is to provide a valve assembly together with an actuating mechanism therefor interconnected with the energy wave generator of the last above object, so as to provide a fluid discharge means for modulating effects on the sonic or energy carrying wave produced by this generator and transmitter of energy carrying waves.

Another object is to provide a valve assembly of general utility and of use as a liquid discharge valve in a generator of energy transmitting waves.

A further object is to provide a valve assembly togehter with an actuating mechanism therefor capable of effecting a variably timed operation of the valve assembly.

An additional object is to provide a valve assembly wherein the valve is balanced in its action by the pressure of the fluid which it controls whereby to facilitate the actuation and to increase the sensitivity of the valve.

Still another object is to provide an improved packing assembly for a valve and one which may be easily adjusted to take up packing wear therein during the operation of the valve and without interfering with the latter.

Yet another object is to provide a valve assembly having means for imposing an adjustable preloading force on a valve for urging the latter to its seat.

A still further object is to provide a valve assembly having provision for draining therefrom any fluid leaking past the valve packing means.

A primary fundamental object of this invention is to provide a method and means for producing wave pulsations having predetermined characteristics in a wave transmitting medium and which shall be the resultant of a plurality of separately produced waves each being controllably varied as to its characteristics.

A primary and fundamental object of this invention is to provide a method and means for producing wave pulsations having predetermined modulational characteristics in a wave transmitting fluid medium and wherein the wave may have portions thereof subjected to a phase displacement whereby to produce a cavitational effect or a loading or lagging of the phase thereof.

A further primary object is to provide an apparatus and method whereby pump pistons and pump discharge valves may be independently variably timed and controlled in their operation whereby to produce each an energy transmitting wave in a fluid medium.

A primary and fundamental object of this invention is to provide a method and means for producing wave pulsations having predetermined modulational characteristics in an energy wave transmitting fluid medium and to transmit such energy waves to a petroliferous formation for the increase or recovery of oils and gases therefrom.

These and other objects and advantages will become apparent from a reading or the specification and claims, reference being had to the accompanying drawings forming a part hereof wherein like numerals refer to like parts throughout, and in which:

FIG. 21 is a perspective view of a connecting rod for a counterbalance cylinder piston;

GENERAL ORGANIZATION (FIGS. 1–13)

Figure 1:
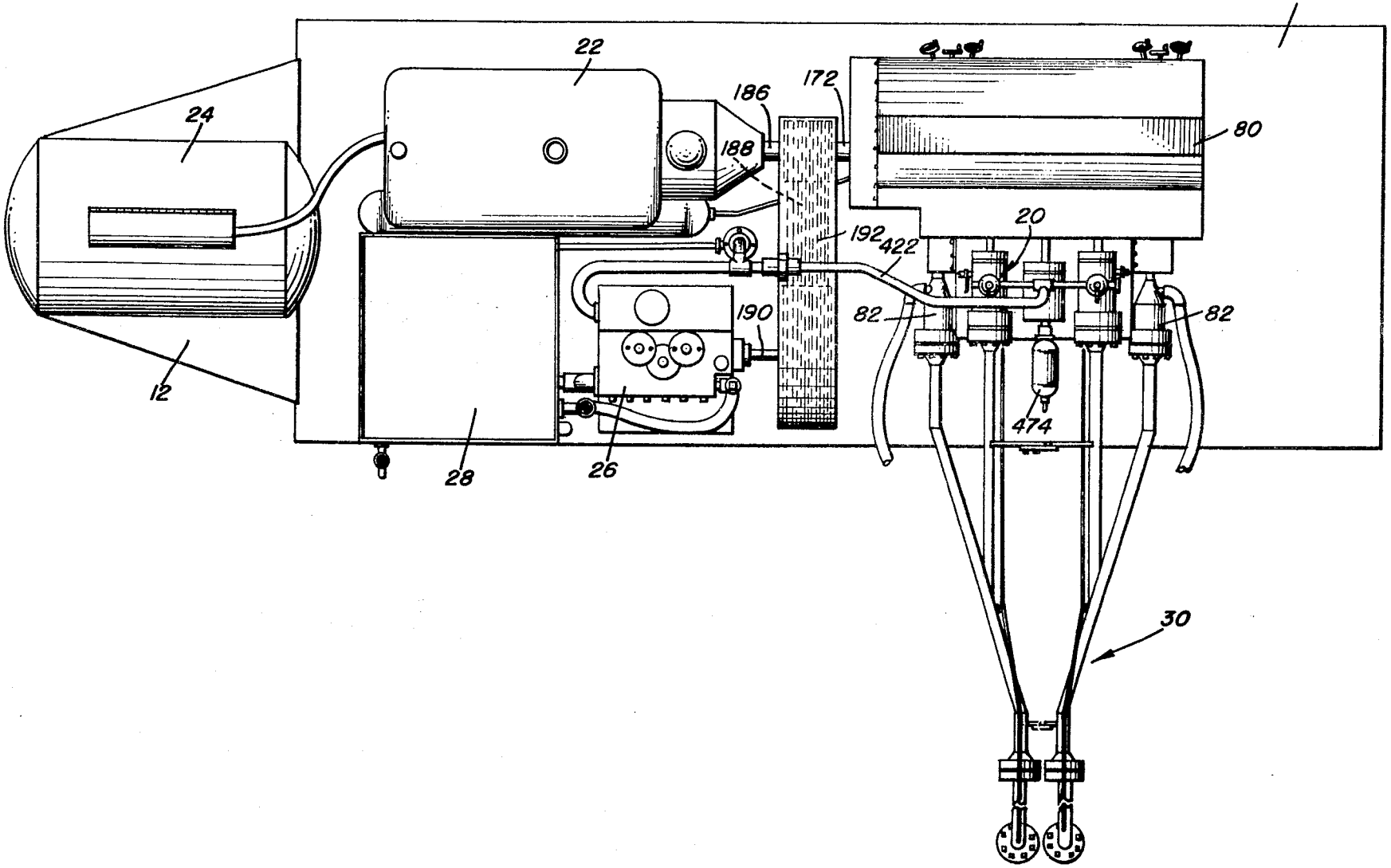
FIG. 1 is a top plan view of a satisfactory embodiment of apparatus incorporating therein the principles of this invention and showing in particular the relative arrangement and the location of the various sub-assemblies of this apparatus upon its mobile base.
Figure 2:
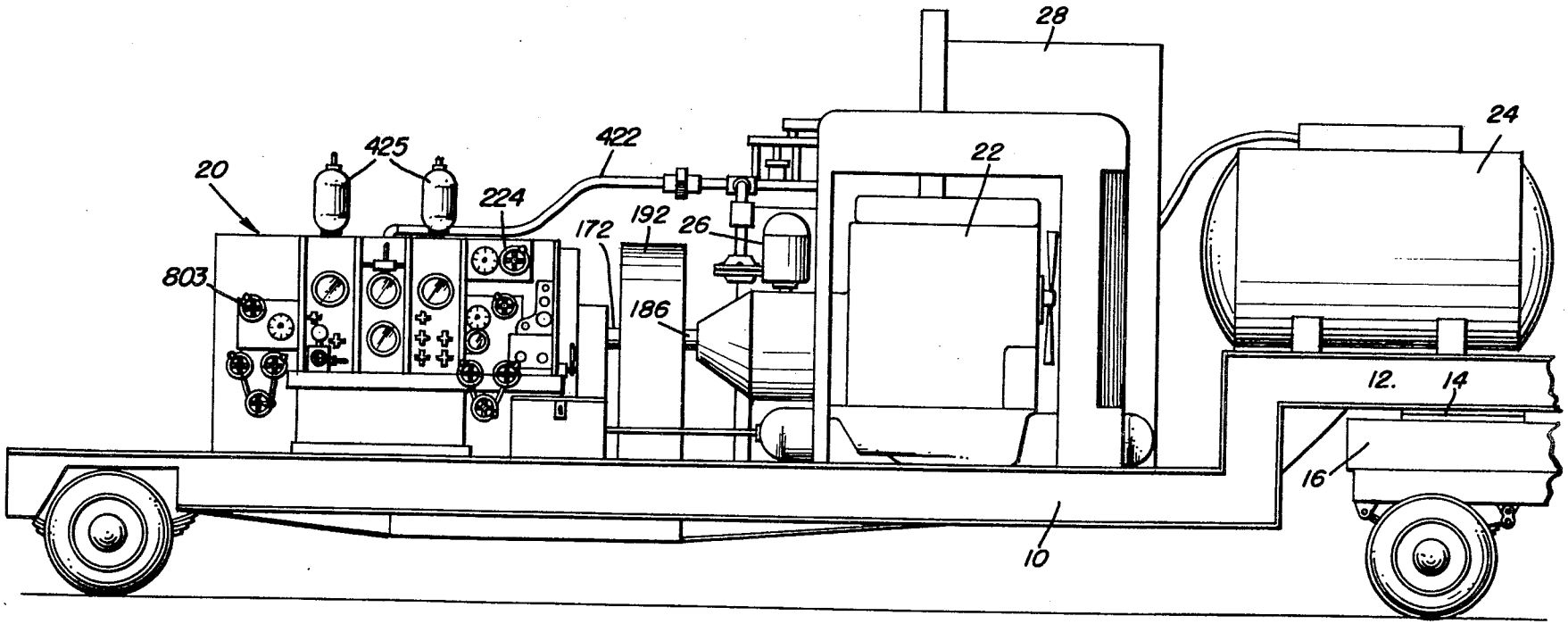
FIG. 2 is a side elevational view of the right side of the apparatus of FIG. 1, but with the Y-tube assembly removed therefrom, and showing the instrument and control panel of the energy wave generator.
Figure 3:
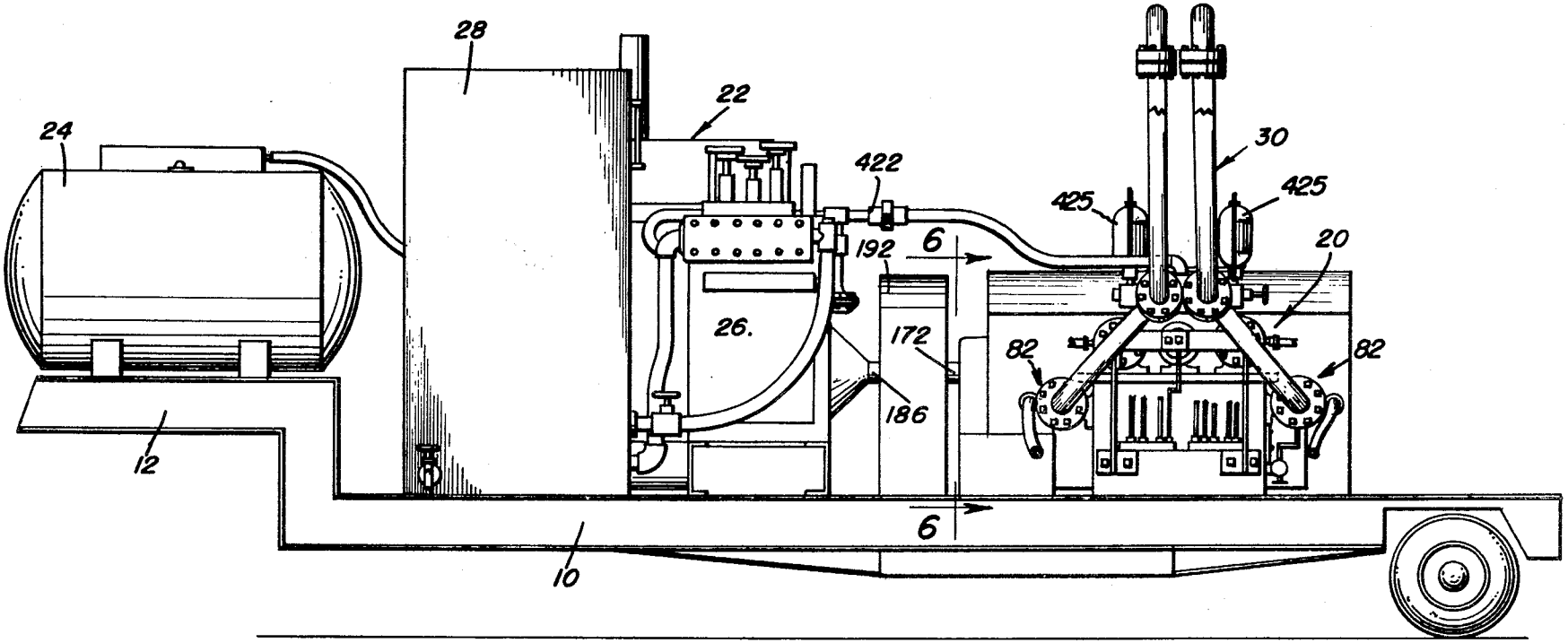
FIG. 3 is a side elevational view of the left side of the apparatus of FIG. 1 showing the Y-tube assembly thereof.

The general organization of this apparatus, specifically adapted for carrying out the purposes and methods of this invention, is disclosed in FIGS. 1–13. Referring first to FIGS. 1 to 3, it will be seen that the apparatus consists of a mobile supporting frame which may comprise the bed of a truck or a trailer, being illustrated in the drawings as consisting of a trailer bed 10 of any suitable design which has at its forward end a vertically offset or raised portion 12 which as shown in FIG. 2 is adapted to be supported and secured as by a conventional fifth wheel assembly 14 to the rear end portion 16 of a tractor vehicle. It is upon the trailer bed 10 that all of the elements and sub-combinations, forming the preferred form of the apparatus in accordance with the invention, are permanently mounted and secured in an operative relation for use or in a compact, stored condition for ready transportation.

Briefly, the elements and the sub-organizations forming a part of this invention and which are mounted upon the trailer bed and which will be referred to more specifically hereafter comprise an energy wave generator consisting of variable stroke pumping unit 20, an internal combustion engine 22, comprising the prime mover or power plant of the apparatus, a storage tank 24 for L.P.G. such as butane, propane or the like and which constitutes the fuel for the internal combustion engine. In addition, there is mounted upon the trailer bed a feed pump unit 26 together with a tank 28 constituting a reservoir for fluid to be supplied to the feed pump. A Y-tube assembly 30 is operatively detachably connected to the variable pump unit 20 for delivering the high frequency wave generated by the pump unit to the surface or object to be treated and for receiving the fluid discharged from the variable pump unit.

As set forth herinafter, the Y-tube assembly 30 is readily detachably and operatively secured to the pump unit 20 and is supported upon tractor bed 10 in such a manner as to permit ready removability therefrom in order to reduce the over-all height and width of the apparatus to thereby facilitate transportation of the same.

The over-all purpose of this apparatus is to provide a variable stroke and variable capacity pump capable of imparting high frequency vibrations and energy carrying waves upon the fluid medium operatively contacting and/or discharged by the pump whereby such vibrations and waves may be transmitted by the fluid medium to a surface or object to be treated by the same.

Although the invention is to be understood as being in no way limited thereto, one especially useful application of the principles of this invention is to oil wells and oil bearing formations or horizons whereby to impart a water drive to the oil bearing formation for effecting a secondary recovery of oil and gases therefrom; for fracturing such formations; for more effectively promoting and controlling the flow of fluids in such formations; for cleansing well bores and the horizon adjacent the same and the like. Accordingly, the disclosure of the present application has been particularly directed to the manner in which the apparatus and method is utilized in oil recovery.

More generally, the apparatus constitutes a means for generating energy carrying high frequency waves and for producing desired characteristics therein as to amplitude, frequency and strength; for transmitting such waves by a liquid medium to any desired surface or object to be treated by the pressure and vibrations of the same; and for pumping said medium during any of the foregoing.

Figure 4:
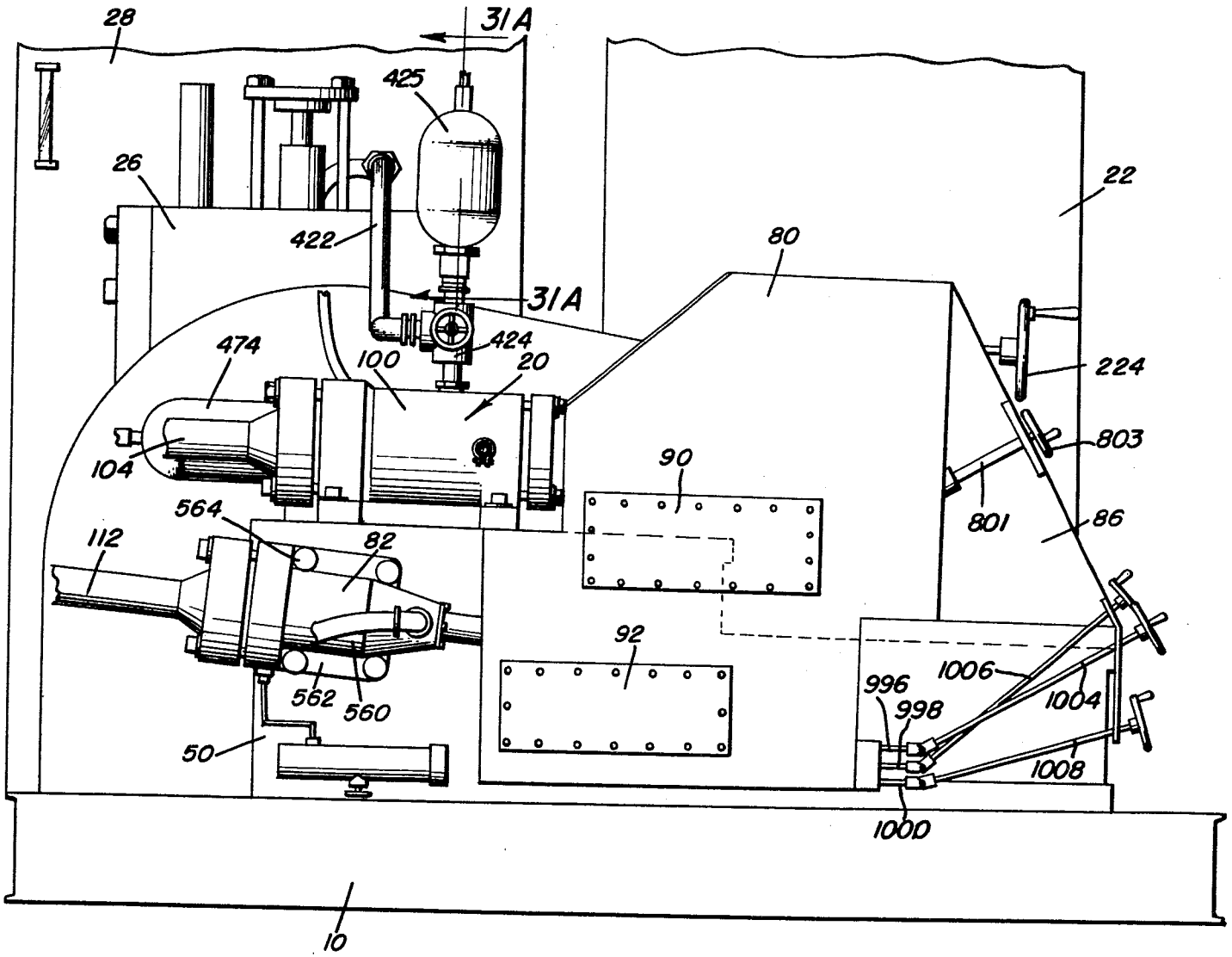
FIG. 4 is a rear elevational view taken on an enlarged scale of the apparatus of FIG. 1, part of the Y-tube assembly being broken away.
Figure 5:
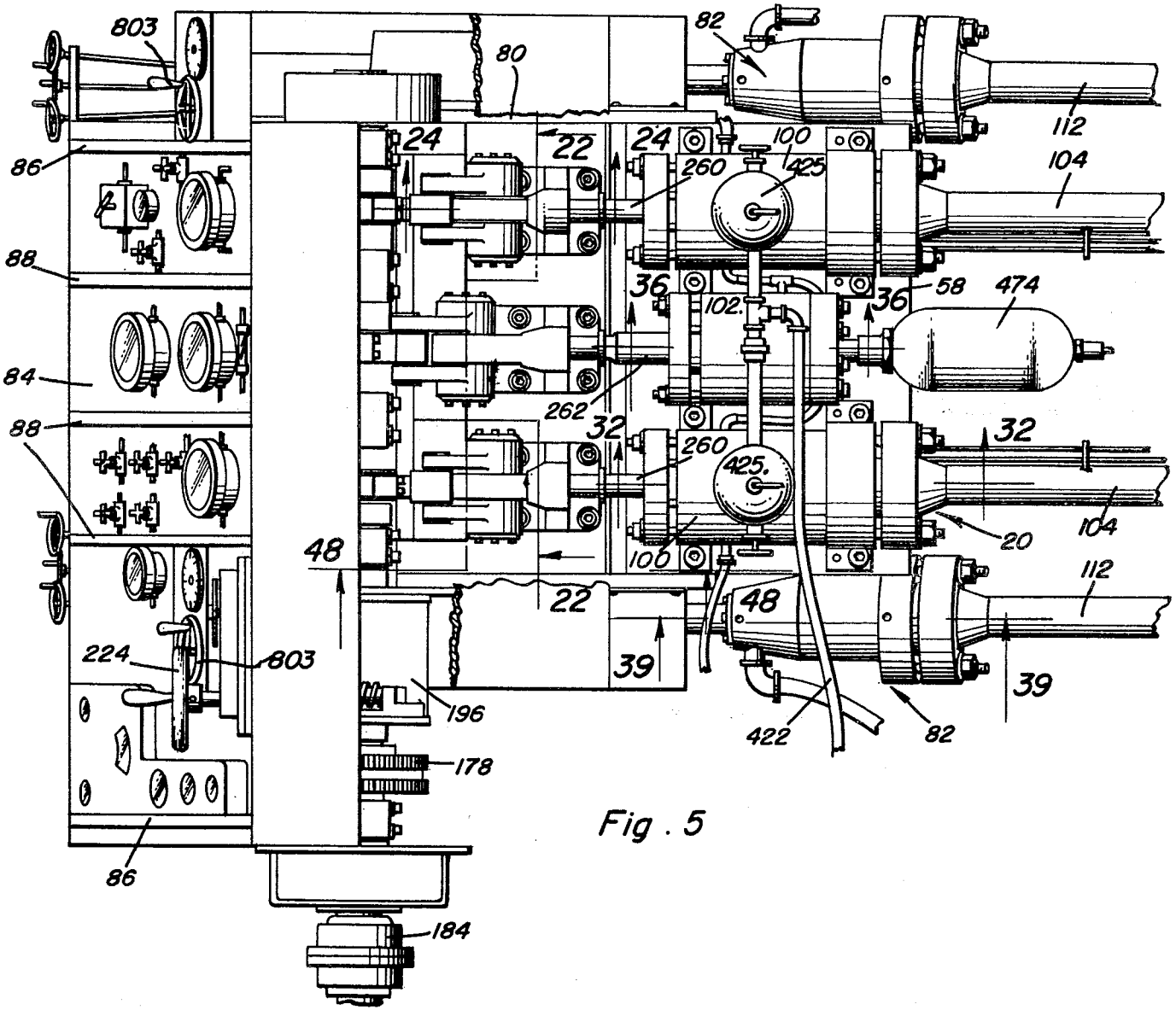
FIG. 5 is a top plan view on an enlarged scale of a portion of the apparatus of FIG. 1, some of the covers and enclosing housings being removed to show the structure of some of the power transmission mechanism for the pumping unit.
Figure 6:
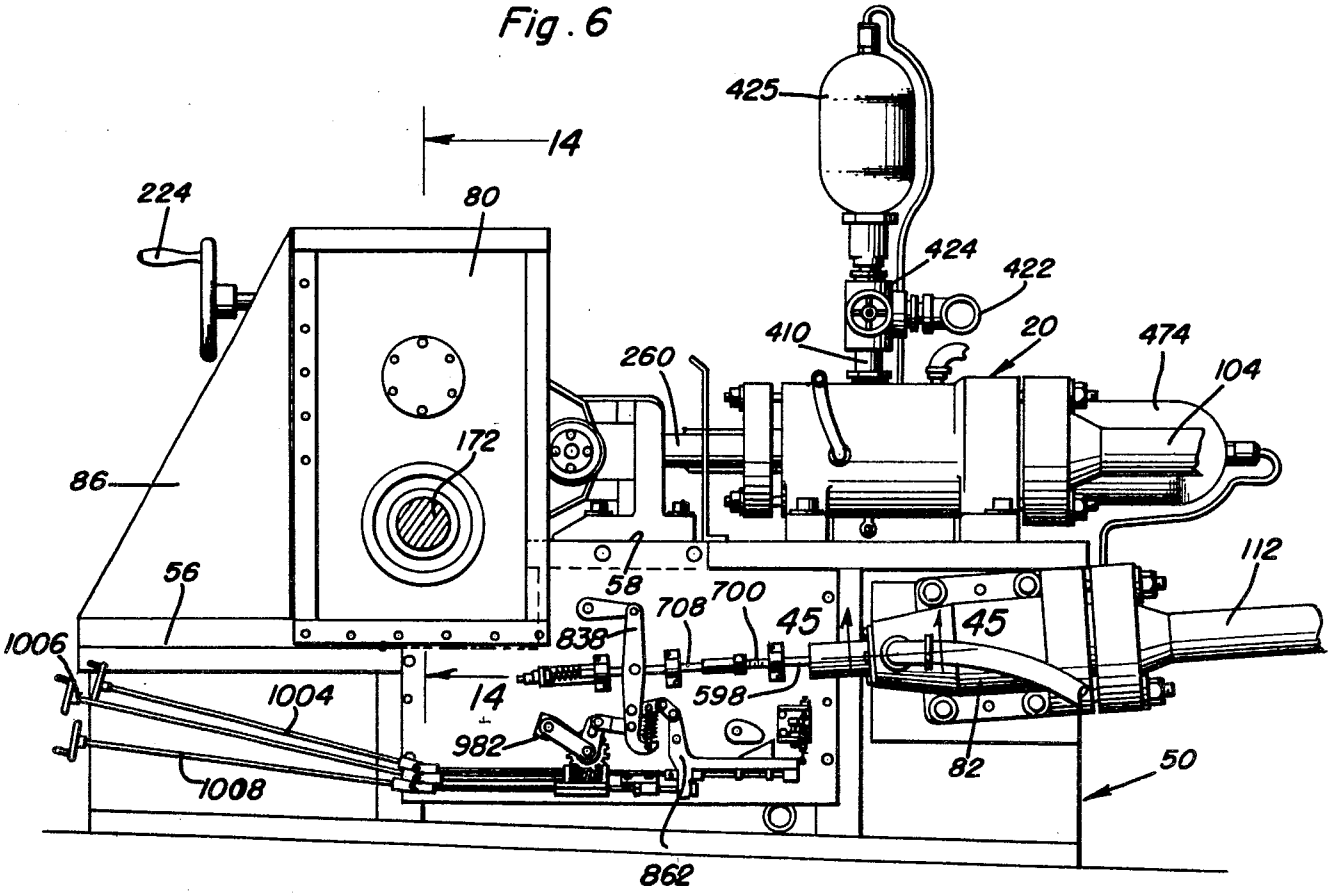
FIG. 6 is an enlarged view taken in transverse section substantially upon the plane indicated by the section line 6—6 of FIG. 3 and showing in front elevation the pump unit with the cover of one of the valve mechanism compartments and that of the rocker compartment being removed therefrom and with part of the Y-tube assembly broken away.
Figure 7:
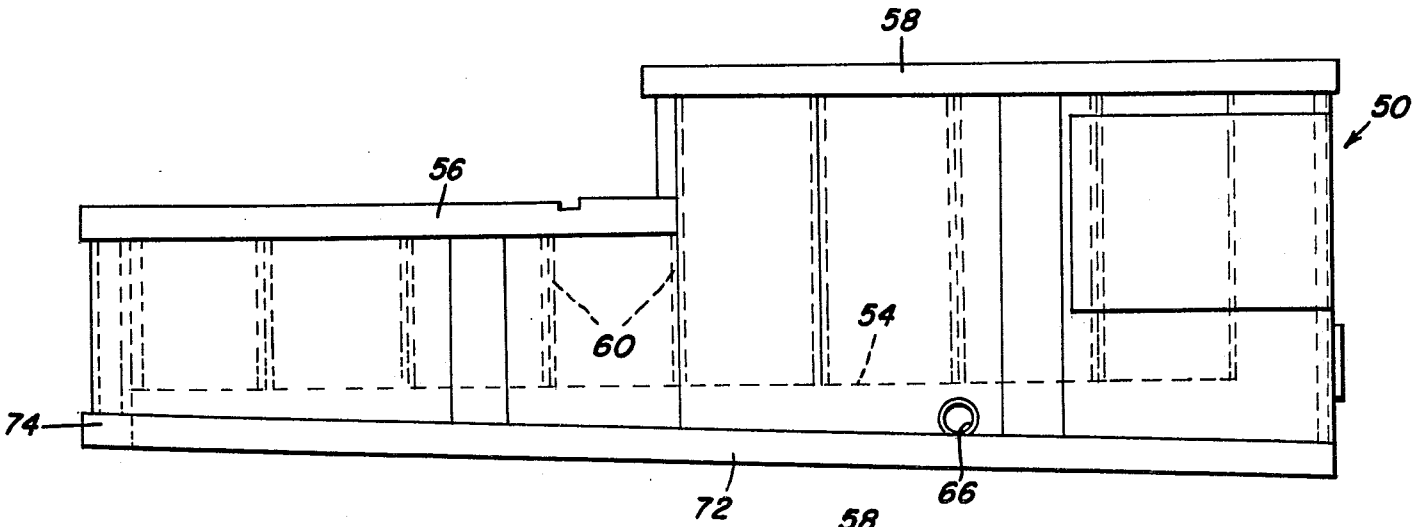
FIG. 7 is a front end elevational view of the base for the pump and transmission components of the wave generating apparatus, concealed parts being shown in dotted lines therein.
Figure 8:
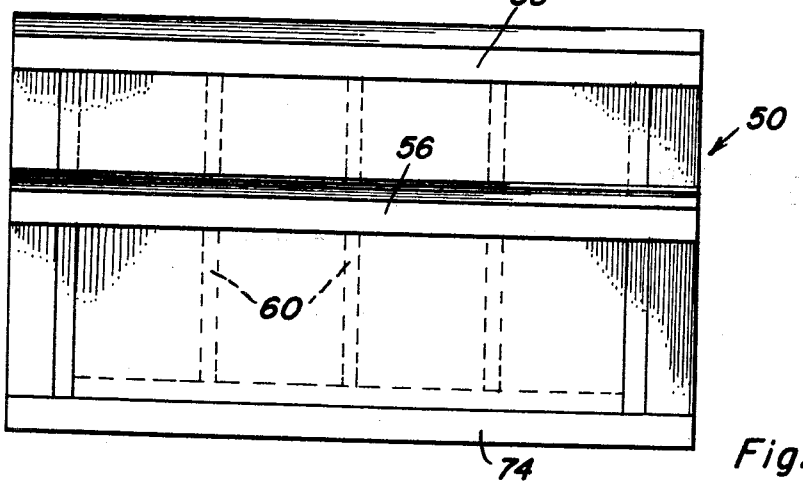
FIG. 8 is an elevational view of the left side of the base of FIG. 7, concealed parts thereof being shown in dotted lines.
Figure 9:
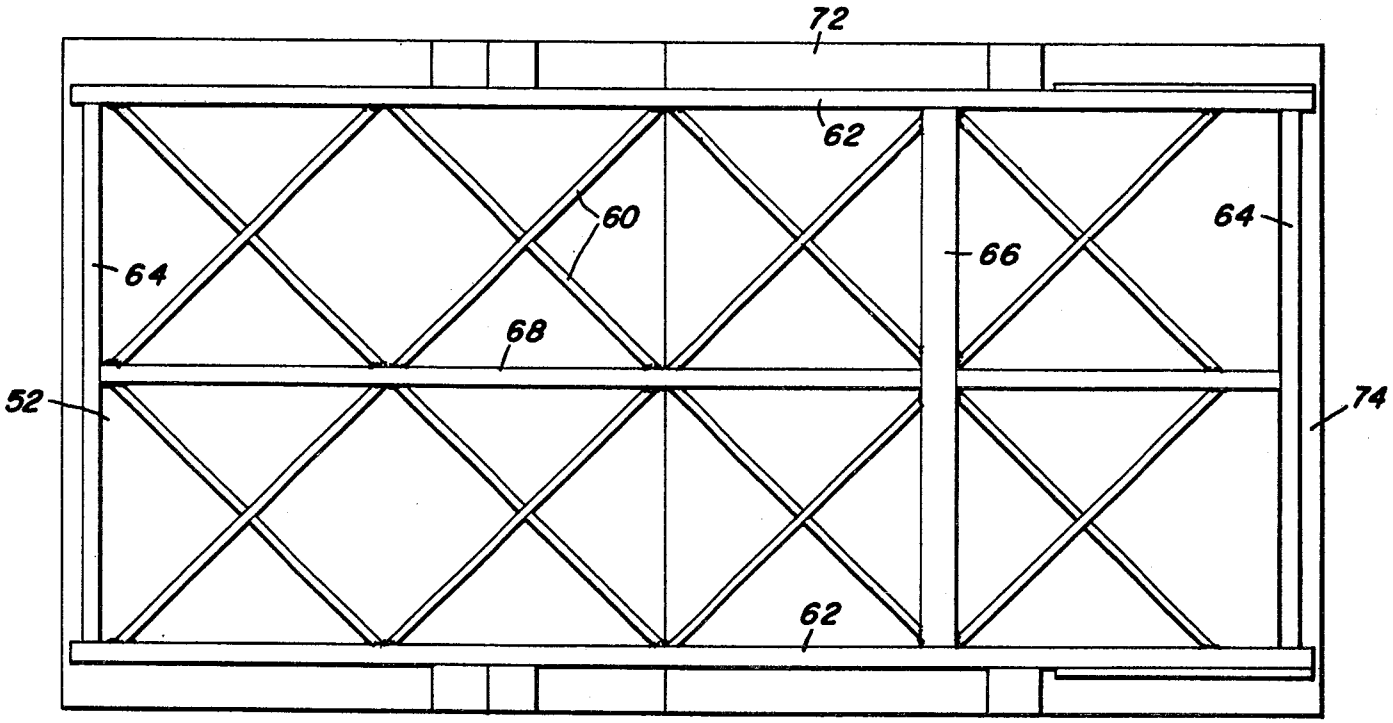
FIG. 9 is a bottom plan view of the base of FIG. 7.

Referring now more specifically to FIGS. 7–9, and in general to FIGS. 4–6, it will be seen that there is provided a suitable crankcase and supporting base assembly upon which are mounted in a convenient and compact manner the pump unit and the power transmission mechanism operatively connected thereto and which is driven from the power plant 22. The crankcase and supporting base of the pump unit is designated generally by the numeral 50 and consists of a suitable support base comprising a housing or casing of requisite strength having a substantially flat bottom wall 52 which is adapted to rest directly upon the bed 10 of the trailer together with suitable side and end walls.

Carried by the side and end walls of the support base, and upon the top surface thereof, are a pair of parallel, slightly inclined and vertically spaced platforms 56 and 58 serving to support the transmission assembly and the pump unit assembly respectively as set forth hereinafter. Suitable vertical supporting webs such as those indicated in dotted lines in FIGS. 7 and 8 at 60 constitute reinforcements and are disposed within the casing 50 to strengthen and brace the platforms 56 and 58. As will be more readily understood from FIG. 9, the webs 60 are relatively diagonally disposed and welded at their joints with each other and with the side and end walls 62 and 64 and the bottom surfaces of the platforms 56 and 58. The spaces between the webs are open at the lower ends of the latter which terminate along a line 54 which is parallel to the platforms 56 and 58. A longitudinal vertical rib 68 extends the full length of the casing and a transversely disposed lubricating communicative conduit 66 extends thereacross. Laterally extending flanges 72 and 74 project from the sides and ends of the base for engagement of fastening means.

As will be best apparent from FIGS. 1–6, support base 50 extends transversely of the truck bed with a supporting platform 56 for the transmission assembly being disposed at the other side thereof. Indicated by the numeral 80 is a casing or housing for the power transmission assembly which actuates the pump unit 20. As will be observed, the housing 80 is disposed upon that portion of platform 56 which is adjacent to platform 58.

Disposed below the pump unit 20 and mounted upon the opposite sides of the crankcase 50 are discharge valve assemblies, indicated generally by the numeral 82, and which are best shown in FIGS. 1, 3–6, 10 and 12. These, together with the pump units, are operatively connected with the transmission assembly and with the Y-tube assembly in a manner and for a purpose to be set forth hereinafter. Also supported upon platform 56 is an instrument and control panel 84 (see FIGS. 2, 4–6), the same having end walls 86 together with reinforcing webs 88.

As shown in FIG. 4, the end wall of the housing 80 of the transmission assembly, which is adjacent to the rear of the truck, is provided with a pair of closure and access plates 90 and 92. A suitable removable cover is provided for various portions of the housing 80 for obtaining access to the transmission mechanism and other assemblies enclosed therein.

Figures 11, 12:
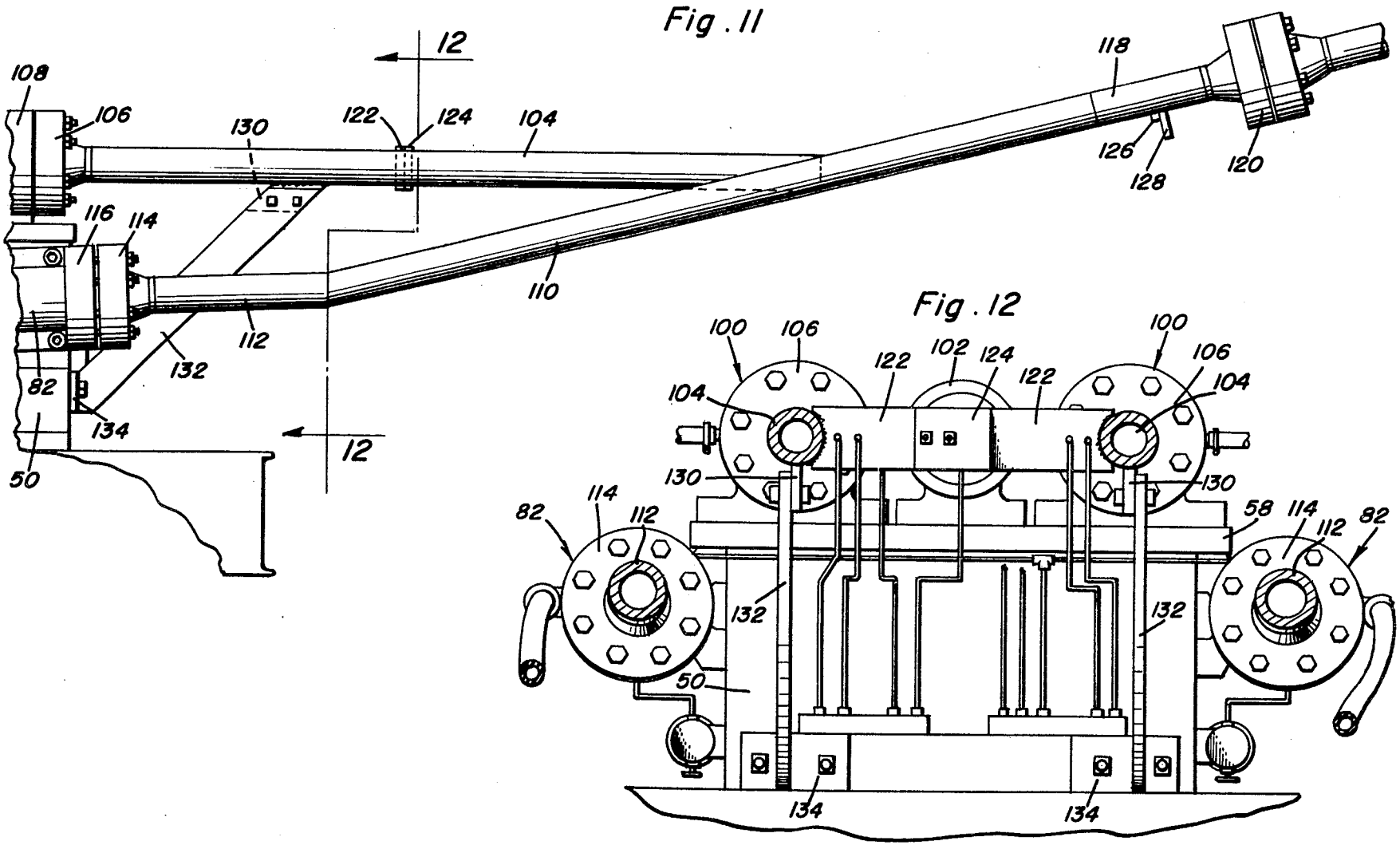
FIG. 11 is an elevational view of the right side of the arrangement of FIG. 10.
FIG. 12 is a vertical transverse sectional view through the Y-tube assembly taken upon an enlarged scale substantially upon the plane indicated by the broken section line 12—12 of FIG. 11.

At this point, referring especially to FIGS. 1, 5 and 12, it will be seen that the pump unit includes a pair of pump power cylinders 100 with a counterbalance or compensating cylinder 102 disposed therebetween. The Y-tube assembly 30 is operatively and detachably associated with the power cylinders 100 and with their valve assemblies 82.

Figures 10, 13:
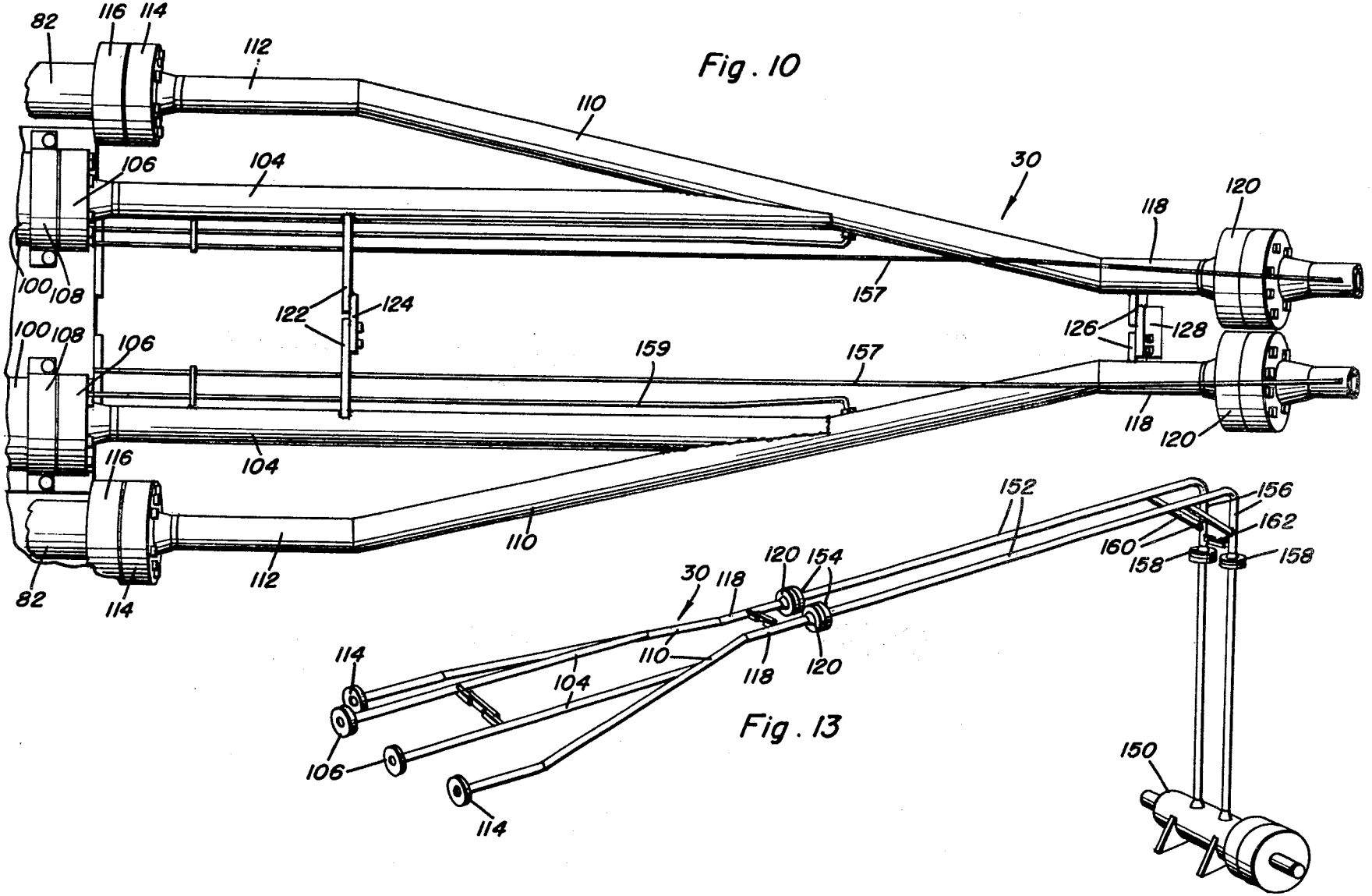
FIG. 10 is an enlarged fragmentary top plan view of Y-tube assembly showing the Y-tubes of the fluid pressure delivery conduit system of the apparatus.
FIG. 13 is a perspective view, parts being broken away and showing the Y-tube assembly operatively associated with a test chamber or other apparatus with which the invention may be used.

The Y-tube assembly consists of a pair of parallel straight conduits 104 having rigidly attached thereto coupling flanges 106 which are adapted to engage with corresponding flanges 108 forming the heads of the power pump cylinders 100 whereby the conduits or pipes 104 may be removably secured to the power cylinders and communicate with the interior thereof. At their opposite ends the conduits 104 are welded to intermediate portions of the pipes or conduits 110 which are disposed to intersect therewith at a slight angle as shown in FIG. 10. At their rearward ends the conduits 110 have end portions 112 which are in generally side by side relation to each other and to the conduits 104, and which likewise are provided with coupling flanges 114 adapted for detachable connection with corresponding flanges 116 of the valve assemblies 82. At their other ends the conduits 110 are provided with a pair of parallel terminal portions 118 likewise terminating in coupling flanges 120.

In order to rigidify the assembly of conduits and support the same in operation position upon the apparatus, the conduits 104 are provided with mounting brackets 122 which are welded thereto and which extend toward each other for engagement by a connecting plate 124. A similar connection serves to rigidly connect the terminal portions 118 of the conduits 110 at the forward ends, comprising laterally projecting lugs 126 together with a connecting plate 128. Welded to the underside of each of the conduits 104 adjacent their rearward end are depending mounting brackets or flanges 130 to which are secured in any suitable manner support members 132 (see FIGS. 11 and 12), the latter at their lower end having mounting flanges 134 by which they may be secured to crankcase 50.

Detachably connected to the outer end of the Y-tube assembly is an extension assembly by which the Y-tube may be coupled to a test chamber 150 as shown in FIG. 13 or may be connected to any other place of use such as a well casing and tubing assembly. The extensional connecting assembly of the Y-tube assembly comprises a pair of pipes 152 having a coupling flange 154 at one end of each by means of which the pipes 152 may be coupled to the terminal portions 118 of the pipes 110 at their coupling flanges 120. At their other ends the pipes 152 are provided with downturned extremities 156 terminating in coupling flanges 158. Bleed and sampling lines 157 are connected to the pipes 152 at their high point where they join to the downturned extremities 156 for a purpose to be subsequently set forth. Also, wave pressure gauge lines 159 are connected to the pipes 110 beyond the junction of the pipes 104 therewith. Suitable brace rods 160 serve to brace and rigidify the end portions 156 and, in addition, a cross brace 162 similar to the constructions 122, 124, and 126, 128 previously described may be employed adjacent the couplings 158.

The flanges 158 are adapted to be selectively coupled to the tubing or a pipe line in a well casing, to the interior of the well casing in any suitable manner, or to the test chamber 150, or to any other object to which the pressures and waves generated by the pump unit 20 are to be applied.

The general organization also includes numerous gauges and control means to be referred to hereinafter.

POWER TRANSMISSION ASSEMBLY (FIGS. 14–30)

The details of the power transmission assembly whereby power from the internal combustion engine 22 or other source of power is supplied by means of a pair of crankshafts and crosshead assemblies to the pump unit and to an auxiliary or feed pump is illustrated particularly in FIGS. 14–30.

Figure 14:
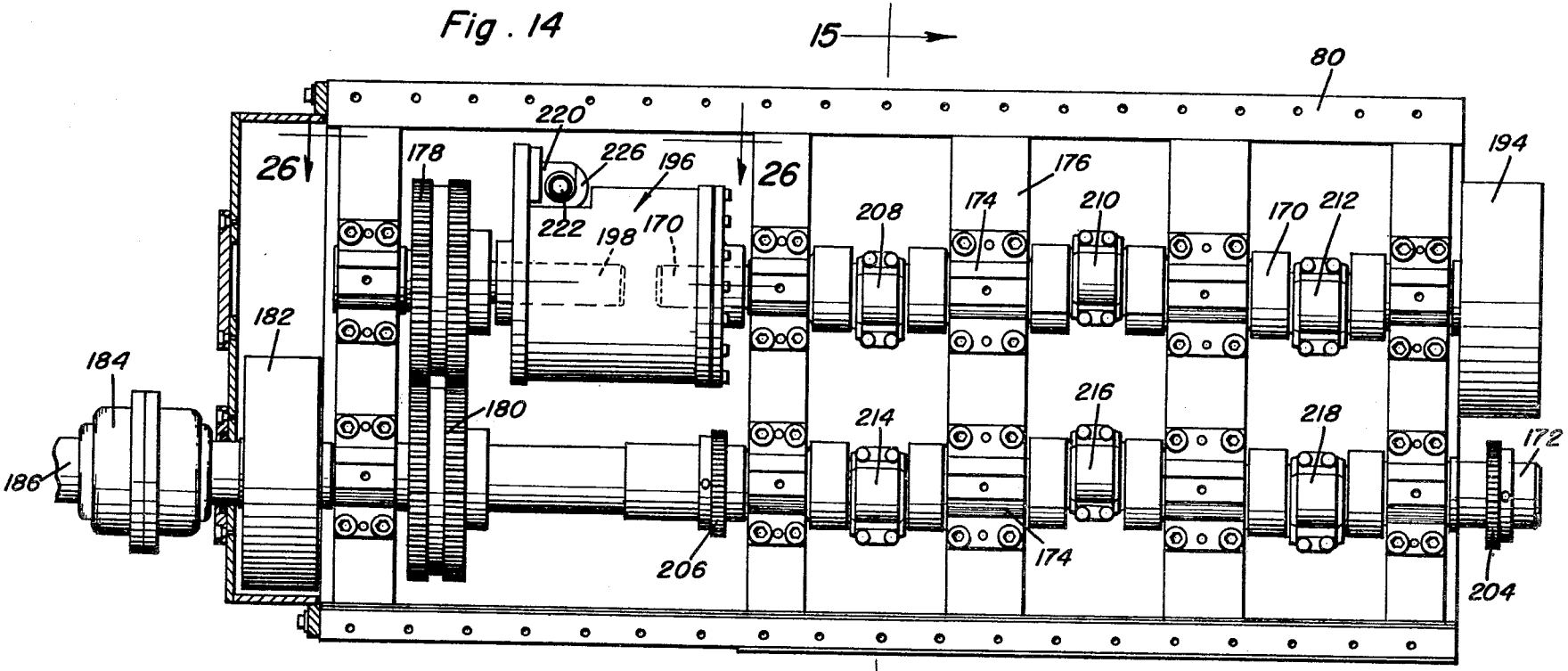
FIG. 14 is a vertical longitudinal sectional view through the pump unit showing the parallel crankshaft arrangement, upon an enlarged scale taken substantially upon the plane indicated by the section line 14—14 in FIG. 6.
Figures 15, 16, 17:
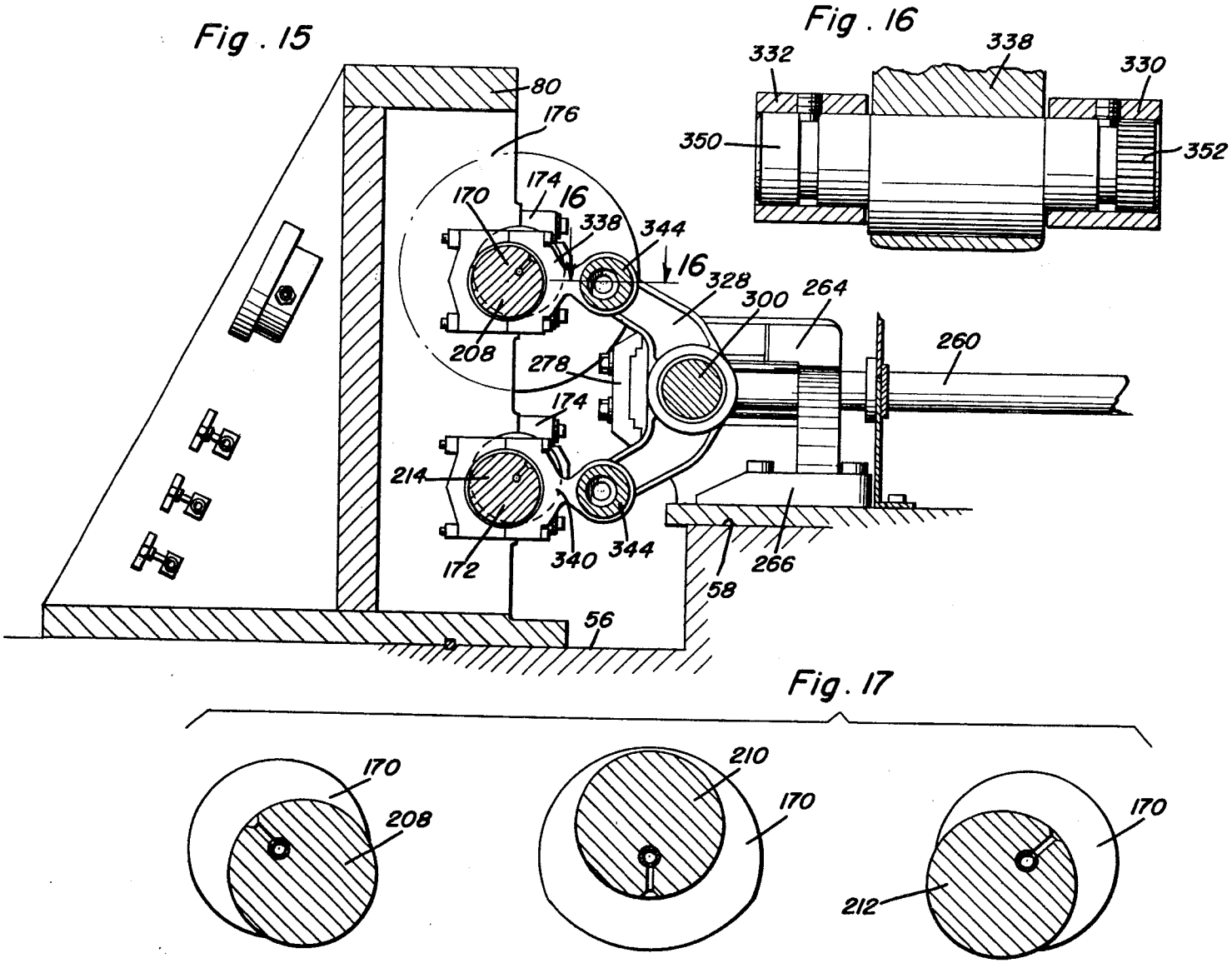
FIG. 15 is a vertical transverse sectional view through the pump unit showing the crankshaft, rocker and crosshead arrangement of a pump unit taken substantially upon the plane of the section line 15—15 of FIG. 14.
FIG. 16 is an enlarged detailed view in horizontal longitudinal section showing the rocker wristpin construction taken substantially upon the plane of the section line 16—16 of FIG. 15.
FIG. 17 is a schematic and diagrammatic view showing in vertical section the relative angular position of the crank throws of either crankshaft.

As will be more readily apparent from FIGS. 14 and 15, the power transmission assembly comprises a pair of upper and lower parallel crankshafts 170 and 172, each secured by suitable bearings 174 to the vertical surface of vertically extending ribs 176 in the power transmission casing 80. The two shafts (see also FIG. 19) are geared together by the connecting gears 178 and 180 and the lower shaft 172 may be provided with a flywheel 182 and extend through the end of the transmission casing 80, being provided with a coupling 184 by means of which it is secured to a power output shaft 186 operatively connected to the power plant 22. By means of a suitable belt drive 188 (best shown in FIG. 1) the engine power output shaft 186 is also connected to the driving shaft 190 of the auxiliary or feed pump 26 (best shown in FIG. 1), a housing or guard 192 being provided to enclose this driving connection.

As so far described, it will now be apparent that power from the power plant is applied to the lower crankshaft 172 for driving the same and that the upper crankshaft 170 is driven from the lower crankshaft in timed relation thereto.

Figure 18:
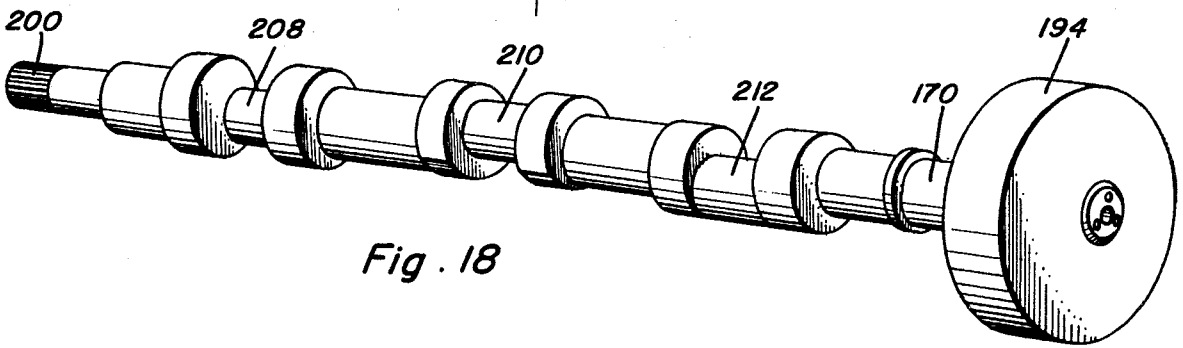
FIG. 18 is a perspective view of the right or main section of the upper crankshaft of FIG. 14.
Figure 19:
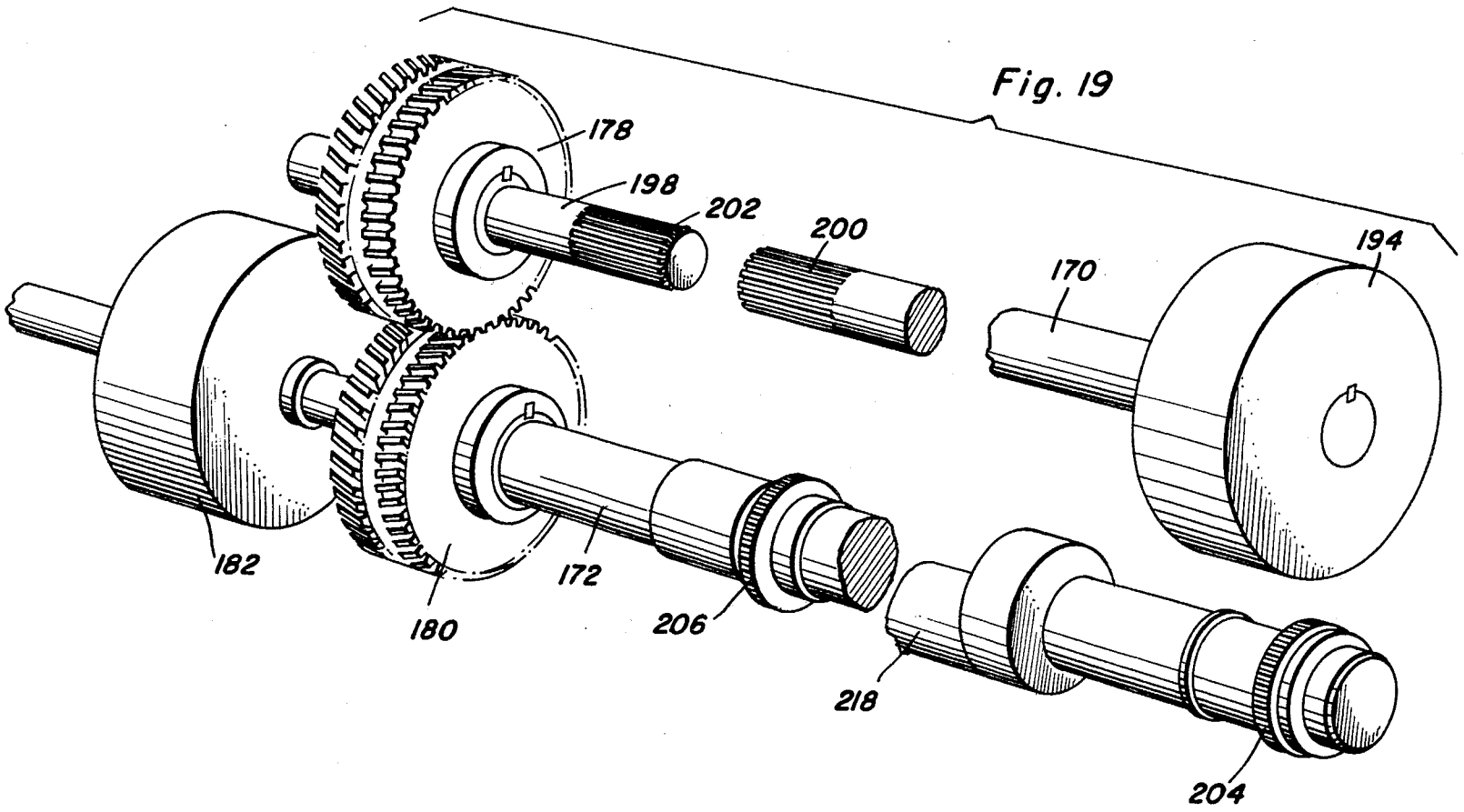
FIG. 19 is a group perspective view of the two angularly adjustable sections of the upper crankshaft of FIG. 14, parts being broken away and showing the operative connection with the lower crankshaft, the differential gearing between the two sections being omitted.

Referring now specifically to FIGS. 18 and 19, in conjunction with FIGS. 14 and 15, it will be seen that the upper crankshaft 170 is provided with a flywheel 194 at its right extremity and that the upper shaft 170 is of lesser length than the lower crankshaft 172. Further, there is provided an angularly adjustable coupling operatively interposed between gear 178 and upper crankshaft 170, which may consist of a differential gear assembly, designated generally by the numeral 196.

For this purpose, there is an aligned shaft extension 198 secured to the gear 178 and terminating in spaced relation to the end of the upper crankshaft 170. The adjacent ends of the shaft 170 and the shaft extension 198 are splined as at 200 and 202, respectively, and these splined extremities are received in the differential assembly 196 whereby, as set forth hereinafter, the crankshaft 170 may be given any desired angular adjustment with respect to the shaft extension 198, and also with respect to the lower crankshaft 172 which is geared to the extension 198.

The lower crankshaft 172 is provided with a gear 204 and intermediate its ends is also provided a gear 206 for a purpose to be later set forth. The two crankshafts are each provided with vertically aligned sets of three crank throws, those of the upper crankshaft 170 being shown in FIG. 14 at 208, 210 and 212, while the lower crankshaft has its three throws indicated at 214, 216 and 218.

As will be seen from FIG. 14, the throws 208 and 214 are in vertical alignment, 210 and 216 are in vertical alignment and 212 and 218 are in vertical alignment. By a rocker mechanism to be subsequently set forth the upper and lower end throws 208 and 214 are operatively connected by one rocker to one of the pump unit pump working cylinders, while the other two end throws 212 and 218 are similarly connected by a second rocker to the other pump unit pump working cylinder. The two middle throws 210 and 216 are connected by a third rocker to the pump compensator cylinder 102.

As shown in the schematic view of FIG. 17, the crank throws 208 and 212 are disposed 90° angular interval, with the crank throw 210 being at an intermediate position and at 135° to each. As shown, the crank throw 208 leads the throw 212 by 90°. It is to be understood that the crank throws 214, 216 and 218 of the lower crankshaft are likewise disposed at such intervals, although by operation of the differential mechanism 196 the annular relationship of the crank throws in the upper crankshaft 170 with respect to the corresponding crank throws of the lower crankshaft 172 can be readily varied to any desired angular relation for the purpose to be subsequently set forth.

Figure 26:
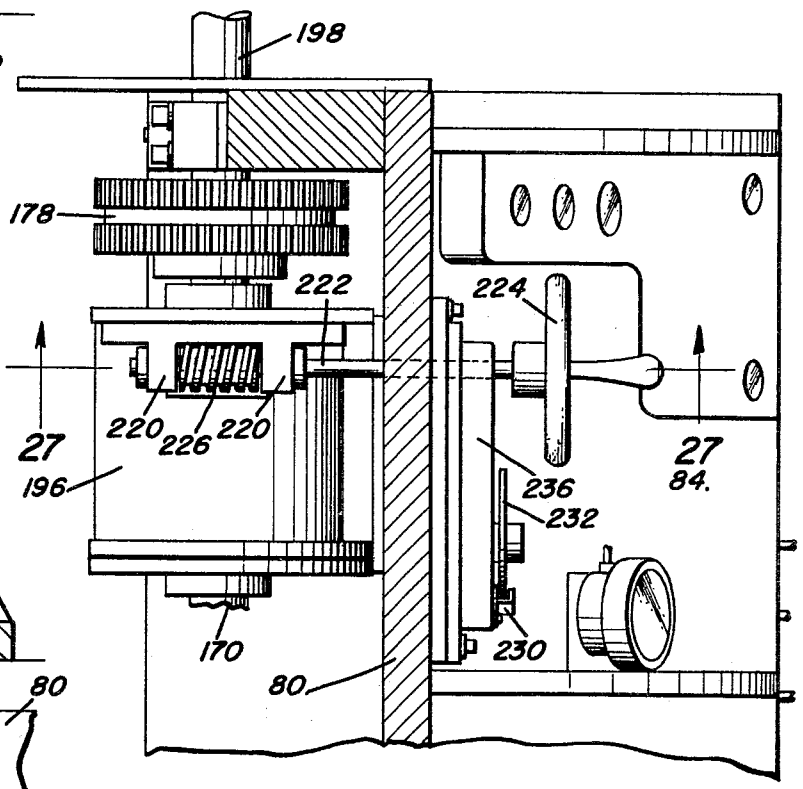
FIG. 26 is an enlarged horizontal sectional view showing a differential gear assembly for varying the phase or angular relationship between the two crankshafts, taken substantially in the plane indicated by the section line 26—26 of FIG. 14.
Figure 27:
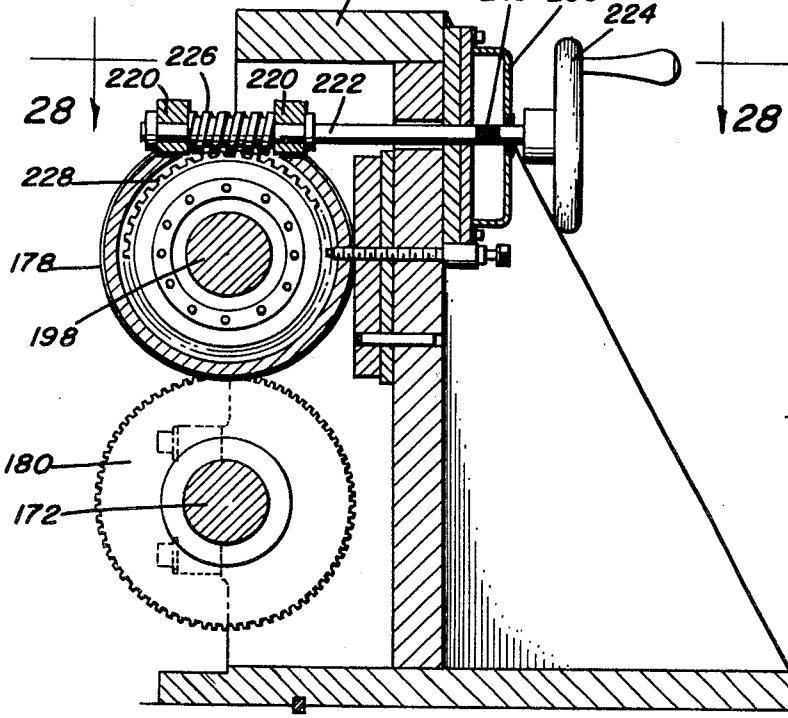
FIG. 27 is a vertical sectional view taken substantially upon the plane indicated by the section line 27—27 of FIG. 26.
Figure 29:
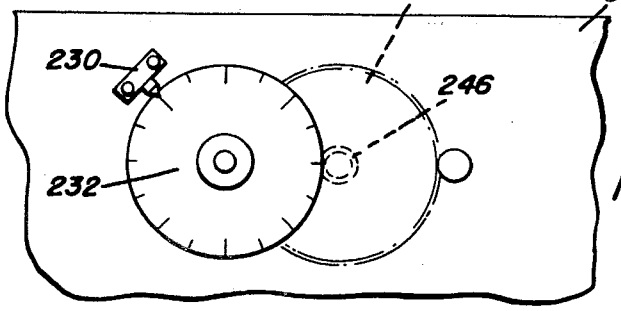
FIG. 29 is an elevational view from the right side of FIG. 28 showing the indicator gauge of the crankshaft phase adjusting mechanism.
Figure 28:
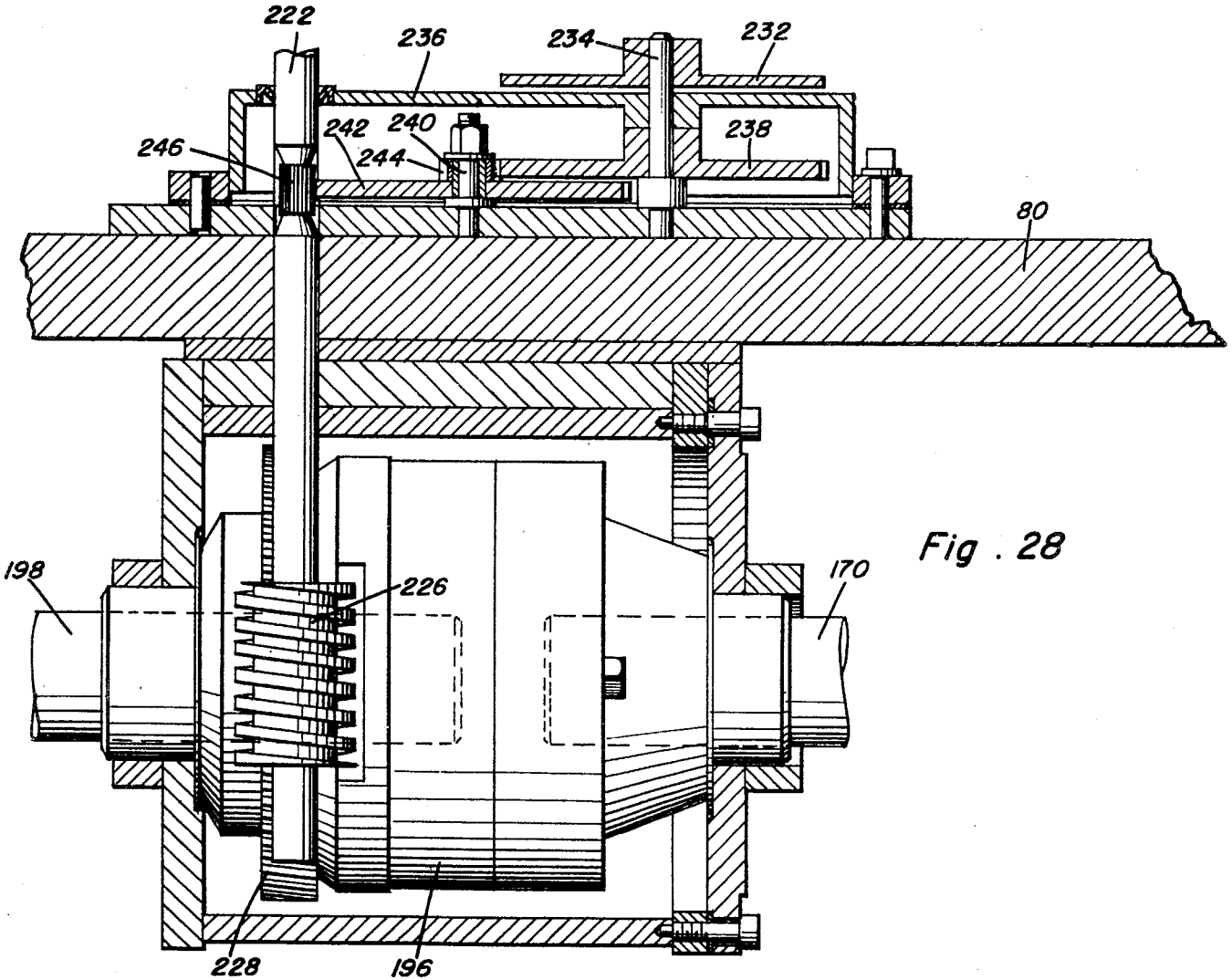
FIG. 28 is a horizontal sectional view taken upon an enlarged scale substantially upon the plane indicated by the section line 28—28 of FIG. 27, certain shaft bearings being omitted for clarity.

Referring next primarily to FIGS. 26–28, together with FIG. 14, it will be seen that the differential assembly 196 is of any conventional and well-known design and receives therein the splined ends of the shaft 170 and its shaft extension 198. Secured in any suitable bearings 220 is an adjusting shaft 222 which extends to the exterior of the casing 80 and is provided with a manual adjusting wheel 224 thereon (see FIG. 4). Secured to the shaft 222 and disposed between bearings 220 is a worm gear 226 which continuously meshes with a ring gear 228 mounted upon the differential assembly housing whereby, upon rotation of the worm and ring gear, the angular relation between the shafts 198 and 170 may be varied.

Associated with the shaft 222 (see FIG. 29) is an indicating means for registering the angular relationship between the two crankshafts. For this purpose a trammel 230 is secured to the wall of the housing 80 and cooperates with a calibrated dial 232 which is secured to a shaft 234. The latter is carried by and extends into a housing 236 and carries within said housing a gear 238. By means of a stub axle 240 within the housing 236 a compound gear consisting of a large gear 242 and a small gear 244 are journaled for rotation, the latter engaging the dial gear 246 formed upon the previously mentioned adjusting shaft 222. By an appropriate gear ratio it is evident that the movement of the adjusting shaft 222 can be utilized to appropriately indicate by the dial and the trammel the angular relation between the two shafts 198 and 170, which is also the angular relationship between the shaft 170 and the shaft 172.

Special reference is now made to FIGS. 20–25 and 30 for an explanation of the rocker guide and slide assembly by which the pistons of the pump unit are operatively connected to the crankshafts. In this connection, reference is also made to FIGS. 5, 6 and 15.

Figure 22:
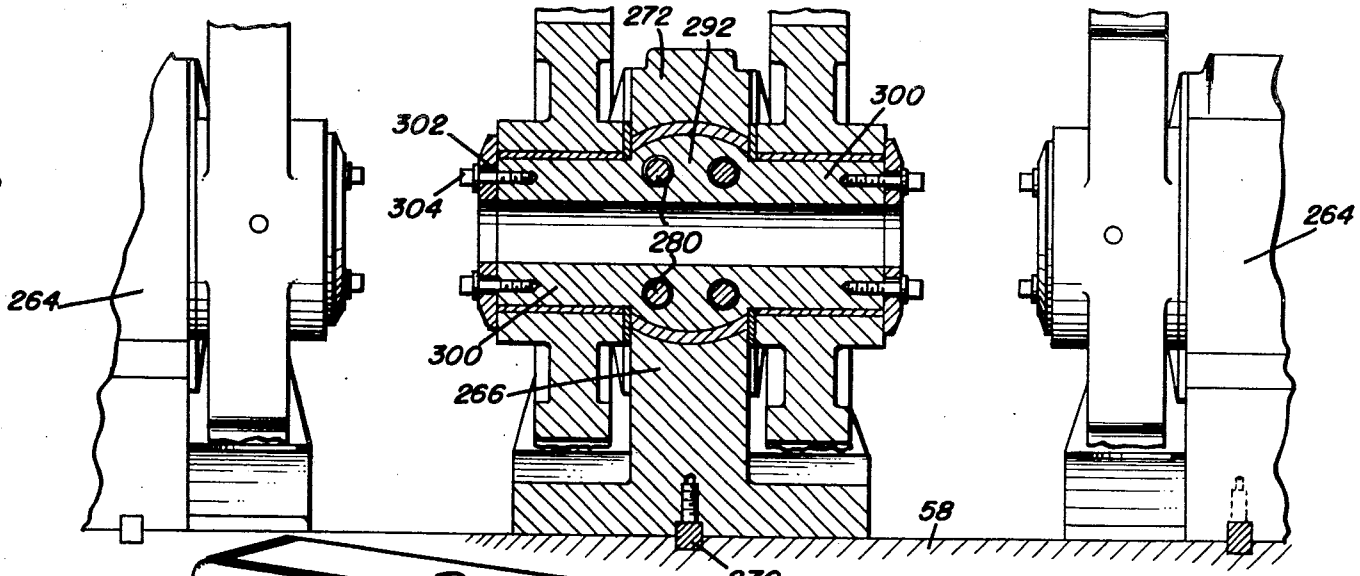
FIG. 22 is a view in vertical longitudinal section showing the crosshead assembly, being taken upon an enlarged scale substantially in a plane indicated by the broken section line 22—22 of FIG. 5, parts being broken away.

Each of the three pump unit cylinders has its piston provided with a piston rod which is operatively connected to the pair of crankshafts by means of a rocker and a slide and guide assembly. Since the rocker, guide and slide assemblies for the two pump working pistons and the pump counterbalance piston are substantially identical as to features of structure, it will be understood that the description and drawings directed to the former also describe and will suffice for an understanding of the latter. The piston rods for the two pump working cylinders 100 of the pump unit are designated by the numeral 160, while the rod for the piston of the counterbalance cylinder is indicated at 262 (see FIG. 5). Mounted upon the platform 58 as shown in FIGS. 5 and 22 are a plurality of crossheads or guides or guide brackets 264 comprising bearings or supports for the slides which carry the rocker arms. Each bracket 264 is positioned between each of the vertically disposed pair of throws of the two crankshafts and an associated pump unit cylinder 100 or 102 as shown in FIG. 15.

Figure 23:
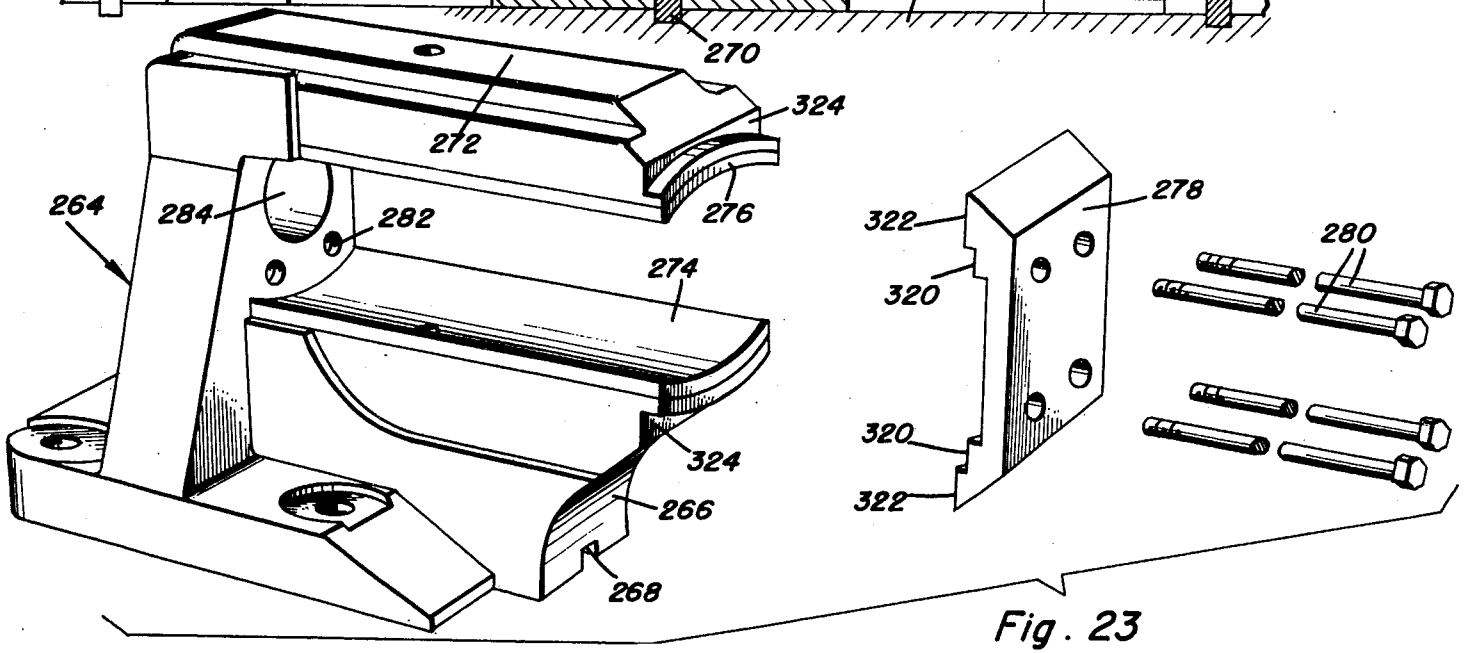
FIG. 23 is an exploded perspective view of one of the crosshead guides.
Figure 24:
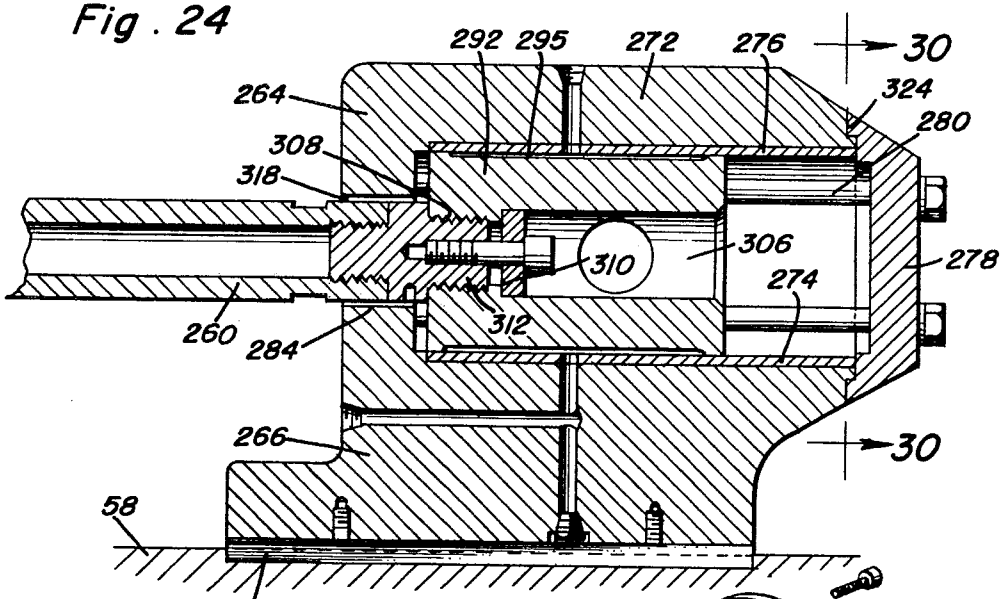
FIG. 24 is a vertical longitudinal sectional view through one of the crosshead units showing the association of the crosshead guide and slide, being taken substantially in the plane indicated by section line 24—24 of FIG. 5, parts being broken away.

The construction of each guide bracket 264 of the crosshead is clearly shown in FIG. 23, the same including a base 266 adapted to be secured by bolts to the surface 58 and having a longitudinally extending keyway 268 therebeneath which is engaged with a positioning key 270 disposed in the surface 58 as shown in FIG. 22 and FIG. 24. The member 264 is further provided with an overhanging arm 272 which overlies and is parallel to the base 266 to provide a horizontally and longitudinally extending guide slot therebetween. The adjacent surfaces of the base and arm are provided with curved guide surfaces 274 and 276 respectively between which is secured a slide to be hereinafter described. A closure plate or end plate 278 is secured as by fastening bolts 280 engaged in threaded recesses 282 formed in the member 264, whereby to close the outer end of the slot between the arm and the base. There is provided a bore 284 disposed through the member 264 and opening centrally and longitudinally of the slot between the arm and base for the reception of the piston rods 260 and 262.

Figure 25:
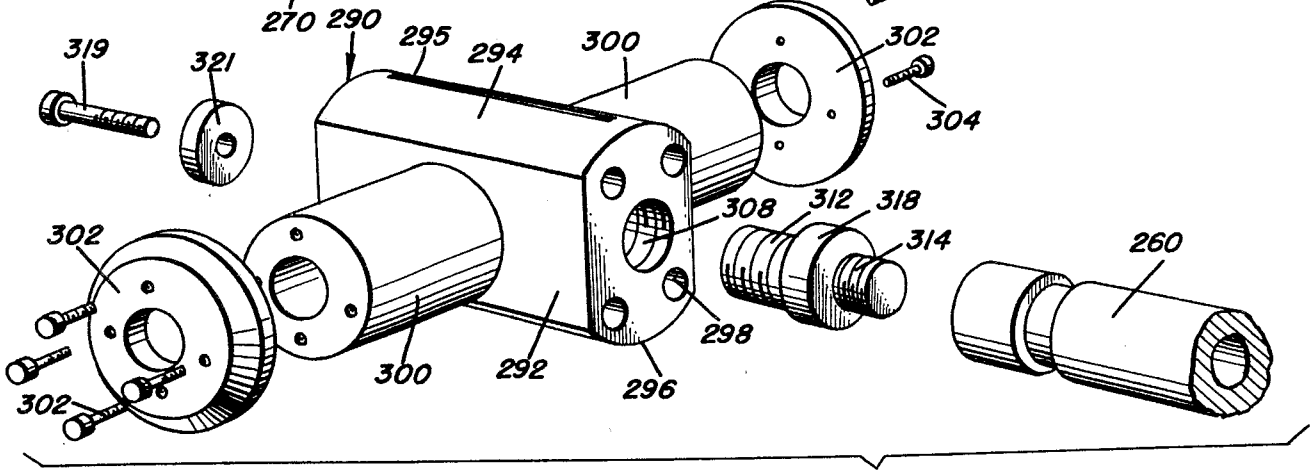
FIG. 25 is an exploded perspective view of one of the crosshead slides.

Slidably and guidably received in the slot of the member 264 between arm 272 and base 266 thereof is a slide indicated generally by the numeral 290 as shown in FIG. 25. This slide comprises an elongated body 292 having upper and lower rounded guiding surfaces 294 and 296 which are complementary to and cooperate with previously mentioned guide surfaces 276 and 274 of the guide 264. The body is provided with a plurality of longitudinally extending guide bores 298 which are slidably received upon the fastening bolts 280 previously mentioned, as will be apparent from a comparison of the FIGS. 22 and 24. A pair of cylindrical projections or trunnions 300 extend from opposite sides of the body 292 and project laterally from the sides of the slot formed in the member 264 between the arm 272 and the base 266 thereof. Retainer disks 302 are secured by bolts 304 to the ends of the projections 300 as best shown in FIG. 22. Oil grooves such as that shown at 295 extending longitudinally of the top surface 294 serve to facilitate lubrication of the slide.

Referring now to FIGS. 24 and 25, it will be seen that the elongated body 292 of the slide is provided with a bore 306 extending centrally therethrough and opening upon that end of the slide body which is adjacent to the slot closure plate 278, and an axially aligned internally threaded bore 308 of a different diameter and which merges with the bore 306 being separated therefrom by an annular rib or ring 310.

Use is made of this bore construction to detachably secure a piston rod 260 or 262 to the slide body. Thus there is provided a connector having an externally threaded cylindrical stem 312 which is seated in the bore 308 and abuts the rib 310, and which has its other end diametrically reduced and externally threaded as at 314 for engagement in the internally threaded extremity of the rods 260 or 262. Between the portions 312 and 314, the connector is provided with an enlarged collar or rib 318 which abuts against the end of the rod 260 or 262 and against the end of the slide body 292. A cap screw 319 and washer 321 cooperating respectively with an internally threaded bore in the connector body portion 312 and the rib 310 serve to secure the piston rods 260 and 262 to the slide bodies 292.

As so far described it will be apparent from FIG. 24 that the collar 318 of the connector and the attached end of the rod 260 are slidable through the previously mentioned bore 284 of the guide body 264.

Figure 30:
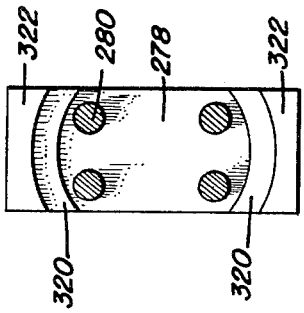
FIG. 30 is a vertical sectional view of the interior surface of the closure plate for a crosshead guide, being taken substantially in the plane indicated by the section line 30—30 of FIG. 24.

It will also be noted by a study of FIGS. 23, 24 and 30 that the closure plate 278 has arcuate raised surfaces 320 which are adapted to engage the ends of the plates 276 and 274 to retain the latter tightly in position in the slotted portion of the member 264. In addition, the plate 278 is provided with further raised surfaces 322 which engage the recessed end surfaces 324 of the arm and base of the member 264 to secure a firm seating engagement therewith.

Figure 20:
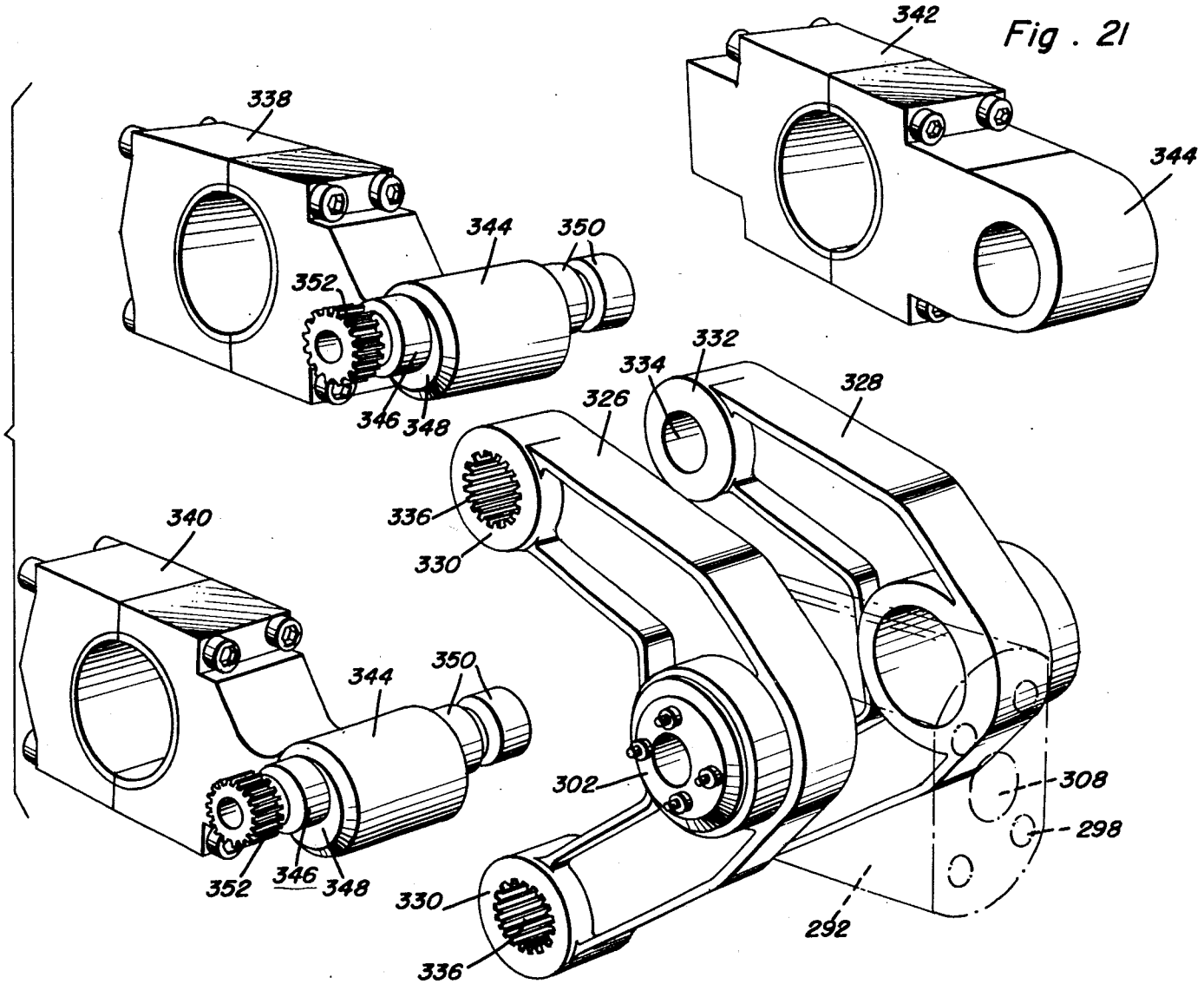
FIG. 20 is a perspective view, parts being broken away, of a rocker and connecting rod assembly forming a part of the means operatively and adjustably connecting the piston crossheads to the crankshafts.

Disposed upon each side of the slide body 292 and freely journaled upon the projections 300, being retained thereon by the retainer disks 302, are a pair of rockers 326 and 328. As best shown in FIG. 20, the two ends of the arms of the rockers 326 and 328 have transversely aligned apertured bosses 330 and 332, respectively, the bores or apertures in the bosses 332 being smoothly cylindrical as indicated at 334 while both of the bosses 330 are cylindrical and splined at their outer end portions only as at 336. A pair of connecting rods 338 and 340 are adapted for respective journaling upon the upper and lower crankshafts 170 and 172 previously mentioned. The connecting rods 338 and 340 are provided for the rocker assemblies which are operatively connected to the pump unit working piston connecting rod 260. A modified construction of connecting rod 342 is employed for the throws 210 and 216 of the upper and lower crankshafts which are connected to the rocker assembly that, in turn, is connected with the counterbalance cylinder piston rod 262 of the pump unit.

Each of the connecting rods 338, 340 and 342 has a cylindrical bearing 344 thereon and extending transversely at one end thereof and constituting a wristpin bearing which is received between the adjacent apertured bosses 330 and 332 of each of the rocker arm assemblies. For use with the connecting rods 338 and 340 of the pump working piston assemblies there are provided wristpins 346 having centrally disposed eccentric bearings 348 thereon for reception in the wristpin bearing 344. The opposite ends of the wristpins 346 are provided with a pair of cylindrical slide bearing or retaining surfaces 350 for engagement in the cylindrical bearing bores 334 of the rockers 328, and with a cylindrical splined extremity 352 for sliding, non-rotating engagement in the splined bores 336 in the rockers 326.

It will thus be apparent that the connecting rods of the upper and lower crankshafts are connected to the upper and lower ends of the rocker arm assemblies, each assembly comprising a pair of rocker arms 326 and 328, in such a manner that by rotationally adjusting the extension 348 of the wristpin 346 in the connecting rod wristpin 344, an independent eccentric adjustment of the wristpins of the two connecting rods attached to each rocker assembly can be obtained. When so obtained the splined engagement of the members 352 and 336 will serve to retain the wristpins in their adjusted position.

By means of this arrangement the length of the connecting rods of the upper crankshaft with respect to the length of the connecting rod of the lower crankshaft and also the effective operating length of lever arms of the rocker can be varied readily thereby varying the velocity, accelerations and ranges or the reciprocation of the slides 292 and of the piston rods and pistons rigidly connected therewith.

Further, in the connecting rod 342 by means of which the middle throws of the upper and lower connecting rods are attached to the rocker arm assembly which actuates the pump unit counterbalance piston 262, the wristpin bearing 344 receives therein a wristpin of a similar construction and operation to wristpin previously described in connection with the pump working piston assemblies.

As previously mentioned, the connecting rods 342 of the counterbalance cylinder unit are of the same general construction as those (338 and 340) of the pump working cylinders but are approximately 1.41 times the weight of the latter. This particular weight relation arises from the particular angular relation of the crank throws 210, 216 to the throws 208, 214 and 212, 218. Obviously other angular relations between these throws would result in different weight relations. Further, the same weight ratios are provided between the corresponding rockers, pistons, piston rods and slides of the single counterbalance unit and the pair of pump working cylinder units.

It is an especially important and advantageous feature of this construction that it enables a precise and controlled variation of the length of each connecting rod, of each end of a rocker arm and of the effective lever arm of each end of each rocker arm. This further enables the counterbalance assembly to have an eccentric adjustment which will compensate for any given eccentric adjustment of the two working cylinder rocker eccentrics.

As so far described, it will now be apparent that by adjusting the differential assembly 196, the crank throws of the two crankshafts may be given any desired lead or angular variation with respect to each other and thus one may vary the position of travel, as well as the rate of travel and rate of acceleration of the rocker arm slides and consequently of the pump piston rods associated therewith. By this means a wide range of adjustments of the stroke of the pistons of the pump unit are possible. Still further individual adjustments may be made as to individual pistons of the eccentric piston pin construction and the splined means for retaining the same in adjusted position.

PUMP ASSEMBLY (FIGS. 31-38)

A pump unit or pump assembly constituting the wave generator and forming a sub-assembly of this apparatus has been previously identified by the numeral 20 and appears in the assembly views of the apparatus in FIGS. 1, 3–6. Reference is now made more specifically to FIGS. 31–38 for a description and showing of the construction of the components of the pump assembly.

As previously described, the pump assembly illustrated consists of three cylinders disposed in side-by-side arrangement and including a pair of outer cylinders 100 comprising the power cylinders or the working cylinders of the pump unit, together with a cylinder 102 between the two outer cylinders and which comprises a counterbalance or compensating cylinder for the unit.

Figure 32:
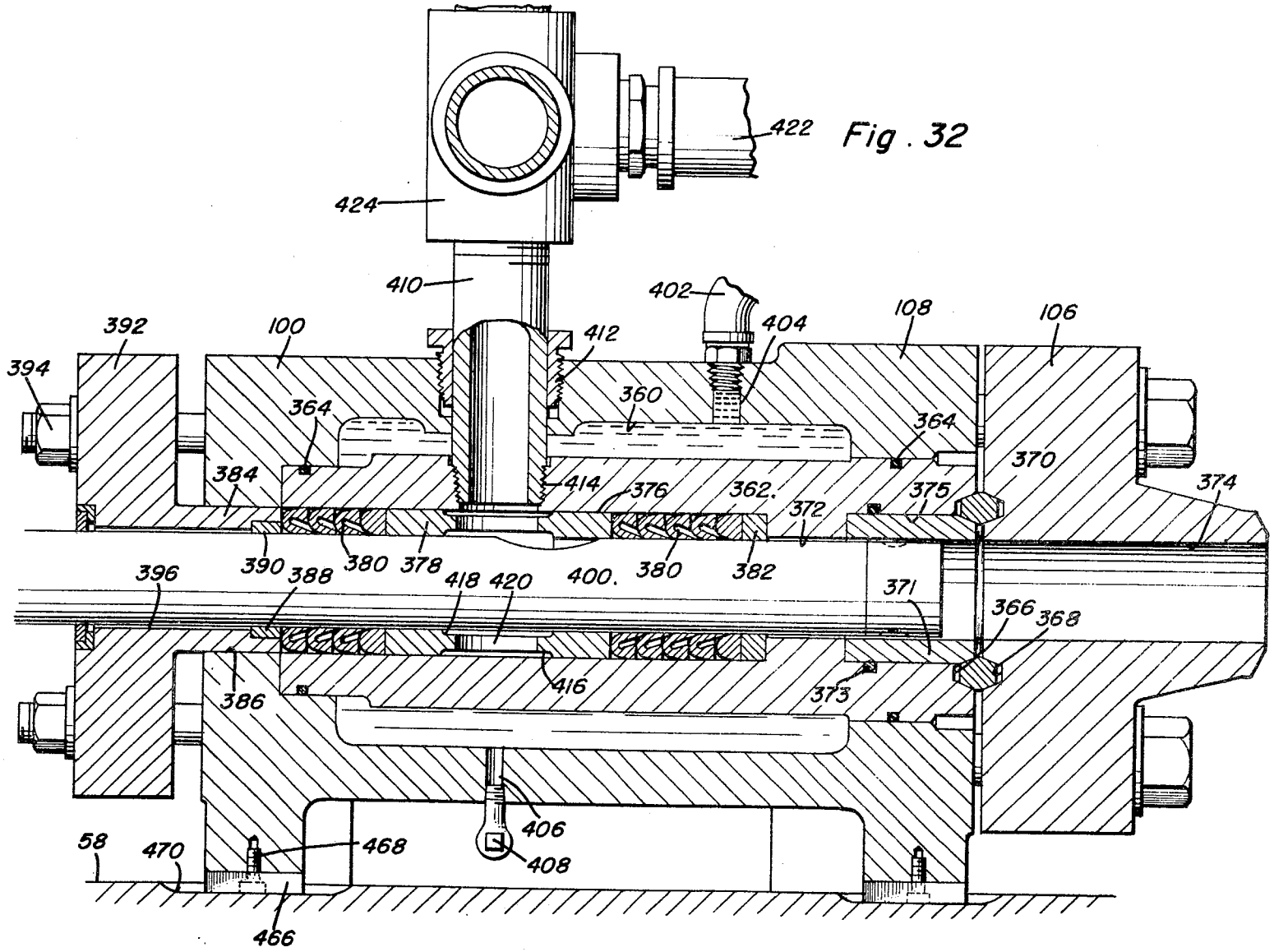
FIG. 32 is a longitudinal vertical sectional view of a working pump or wave generator cylinder and piston construction, taken upon an enlarged scale substantially upon the plane indicated by the section line 32—32 of FIG. 5.

Since the two outer working cylinders 100 are of identical construction, the same numerals employed to designate the corresponding parts of each, reference will now be made specifically to FIG. 32.

As shown, and as described hereinabove, the cylinders 100 have the coupling flanges 108 which are detachably secured to the coupling flanges 106 of the pipes or conduits 104. The cylinders are provided with a recessed or enlarged bore 360 which comprises a water jacket for the pump and a sleeve or cylinder liner 362 is received within cylinder 100, suitable O-rings 364 being provided therebetween to establish a fluid-tight seal between the cylinder liner and the cylinder 100 to form the water jacket therebetween. Suitable annular channels or grooves 366 and 368 are formed in the adjacent end surfaces of the coupling flanges 108 and 106 respectively to receive therein a correspondingly shaped packing metal O-ring 370 and aligned bores 372 and 374 are formed in the cylinder 100 and in the coupling flange 106.

A removable insert sleeve 371, having an O-ring 373, is removably seated in a counterbore 375 in the outer end of the bore 372 and is retained in place by the engagement of the metal O-ring 370. Removal of this sleeve gives access for applying a wrench to the valve assembly of the pump piston, to be later described.

At its end which is remote from the coupling flange 106 the bore 372 of the cylinder liner 362 is diametrically enlarged to provide a bore 376 and a bushing or sleeve 378 (see also FIG. 35) is received in the enlarged bore 376 intermediate the ends of the latter. A plurality of packing rings 380 are disposed in the enlarged bore 376 on opposite sides of the bushing 378, those at the right side of the bushing abutting against the retainer plate 382 seating on one end of the bore while those at the left are engaged by a packing gland or bushing 384 which is slidable in the open end of the enlarged bore 376 and in the registering bore 386 of the cylinder 100, a packing retainer ring 388 being disposed in a recess or enlargement 390 in the packing gland 384. The latter is provided with a coupling flange 392 whereby the packing gland may be clamped to the open end of the cylinder 100 as by means of fastening bolts 394. It will be observed that the packing gland and the coupling flange thereof are provided with an axial bore 396 extending therethrough and which is of the same diameter as the bores 372 and 374.

Slidable in the bores 396 and 372 and in the bushing or sleeve 378 is a pump piston 400 of a construction to be subsequently described, the packing members 390 serving to provide a fluid tight packed joint therewith.

A water inlet conduit 402 communicates with the water jacket 360 through an inlet passage or bore 404 in the wall of the cylinder for supplying water or other suitable coolant to the cooling jacket of the cylinder from any suitable source. At the lower side of the water jacket there is provided a water outlet passage 406 together with a drain plug 408 whereby the water jacket of the cylinders may be drained as desired.

The bore 374 constitutes the fluid outlet or the pump discharge means of the pump cylinder 100. In order to admit fluid to the cylinder to be compressed and pumped thereby, there is provided an inlet conduit 410 which extends through a suitable packing gland 412 in the wall of the cylinder 100 and has its extremity threadedly engaged in the bore 414 in the cylinder liner 362. In addition, the sleeve 378 (again see FIGS. 35 and 32) is provided with a circumferentially extending channel 416 upon its outer surface and 418 upon its inner surface with inwardly extending bores 420 communicating therebetween. As will be now apparent, the grooves 416 and 418 and the bores 420 establish continuous communication between the inlet conduit 410 and the interior of the sleeve 378, and thus into the interior of the piston 400 as will be apparent hereinafter.

Fluid is supplied to each of the pump unit working cylinders 100 by means of a supply pipe 422 which in turn is connected as by the valve fittings 424 with the previously mentioned pump inlet conduits 410, as will be readily apparent from FIGS. 1 and 4–6. The previously mentioned feed pump unit 26 constitutes the means for supplying the fluid under pressure to the supply conduit 422 and thus to the interior of the working cylinders 100 of the pump unit 20.

It is also contemplated and is an important concept of this invention to provide a heating means of any suitable type (not shown) for heating the fluid supplied by the conduit 422 and the feed pump unit 28 to the pump unit 20. Since the details of the pump feed conduit heater are not material to the invention claimed herein an illustration of the same is omitted as being unnecessary. However, this heater may be applied anywhere along the conduit 422 and especially thereon adjacent the communication of this conduit with the cylinders 100 of the pump unit 20.

Figure 31:
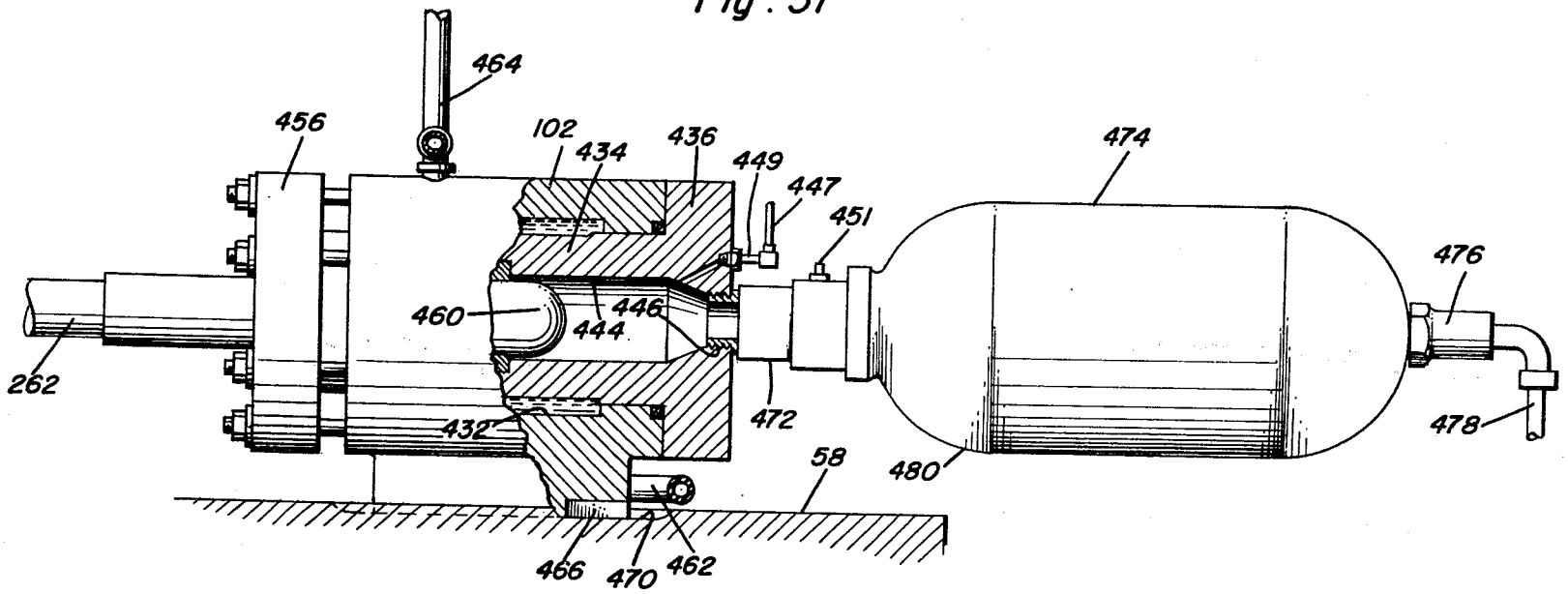
FIG. 31 is a view in vertical longitudinal central section, with parts in vertical elevation, of the pump counterbalance unit showing the counterbalance cylinder and piston and its adjustable pressure chamber.
Figure 31A:
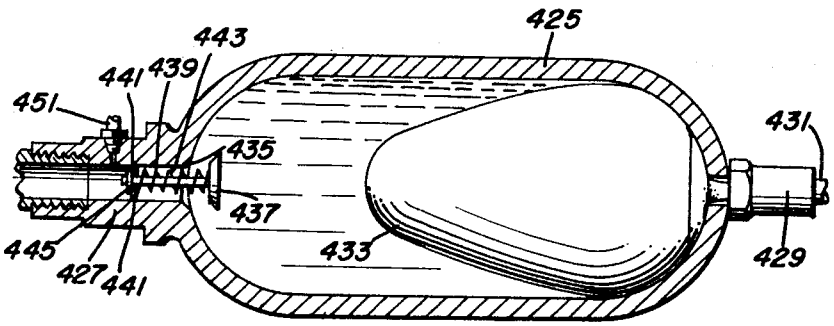
FIG. 31A is a view in vertical central section of an accumulator, of the construction employed with both the pump working cylinder and the pump counterbalance cylinder, being taken substantially upon the plane indicated by the section line 31A—31A of FIG. 4.

Referring especially to FIGS. 4, 6 and 31A, it will be seen that an accumulator 425 is utilized in connection with each pump working cylinder 100 and an accumulator 474 is associated with the pump counterbalance cylinder 102. Since the construction and operation of these accumulators is identical a description of the accumulator 425 as disclosed in FIG. 31A will suffice for all.

The accumulator 425 comprises a cylindrical housing having a tubular neck 427 at one end by which it is secured to and communicates with the pump cylinders 100 or 102. At its other end, the housing has a connection 429 by which it is connected through a conduit 431 to a suitable source of inert gas under pressure, by means of suitable control valves such as a nitrogen bottle or the like.

Secure to the connector 429 in the interior of the housing 425 is an expansible bag 433 which is inflatable to predetermined volume by controlling the quantity of inert gas introduced thereinto from the conduit 431 and thus apply a predetermined, variably adjusted pressure upon the contents of the housing 425.

The neck 427 has a valve seat 435 at its junction with the interior of the housing 425 which is controlled by a spring opened inwardly, opening poppet valve 437. The latter has its stem 439 slidably guided in radially extending ribs 441 in the stem 427, a compression spring 443 engaging the ribs and valve head to yieldingly open the latter. A retainer 445 of any suitable character is carried by the stem 439 and abuts the ribs 441 to prevent withdrawal of the poppet valve 437 from the tubular neck. A drain or bleed plug 451 is provided in the stem 427.

The operation of this portion of the apparatus is as follows. The inflatable bag 433 is supplied with an inert gas and is maintained at a pressure about one-half of the working pressure. This pre-loading of the accumulator maintains an even pressure on the fluid intake of the working cylinder 100, supplied by the intake conduit 410. When employed with the counterbalance cylinder 102, as shown at 474 in FIG. 31, it serves to dampen pulsations and to return energy to the counterbalance piston and from there to the pump pistons.

The purpose of the valve 437 is one of safety. It prevents or limits expansion of the inflatable bag 433 in the event of loss of fluid in the housing 425 for any reason and permits pre-loading of the accumulator in preparation for operation of the apparatus.

Figure 36:
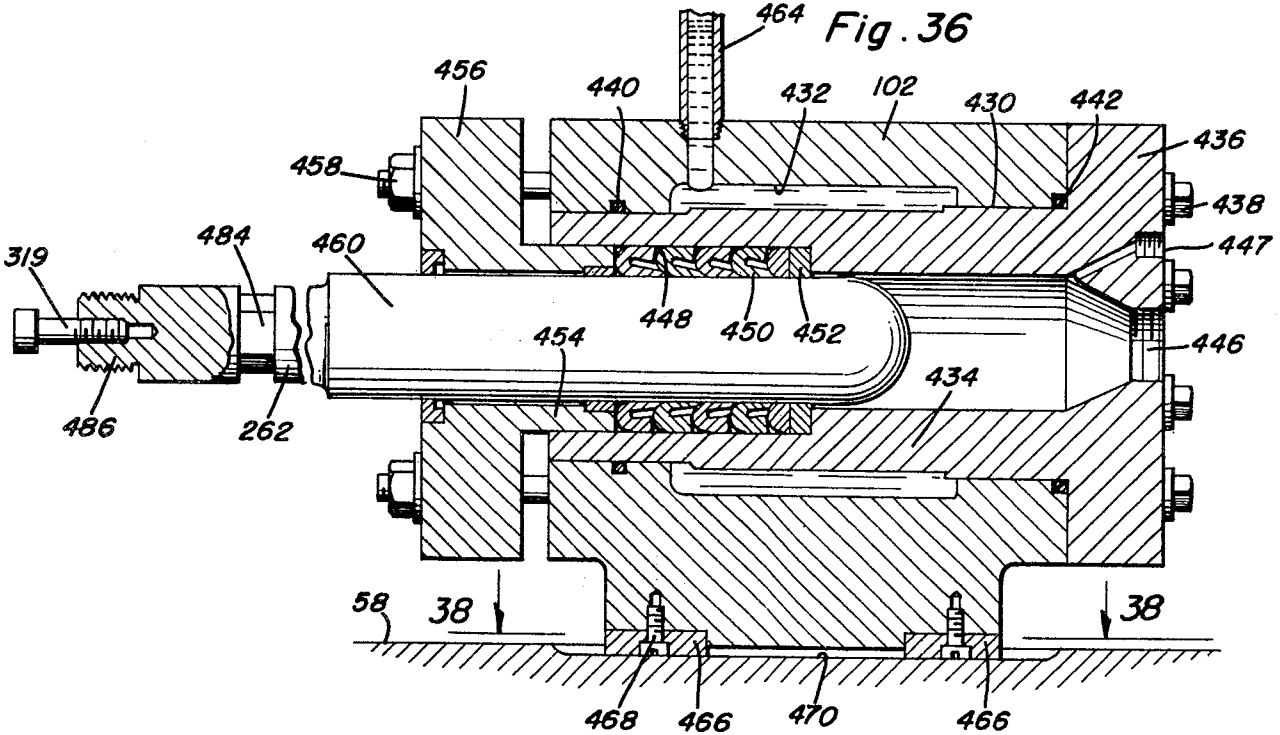
FIG. 36 is a longitudinal, central view in vertical section of the counterbalance pump cylinder and piston assembly of FIG. 31, being taken upon an enlarged scale substantially upon the plane indicated by section line 36—36 of FIG. 5.
Figure 38:
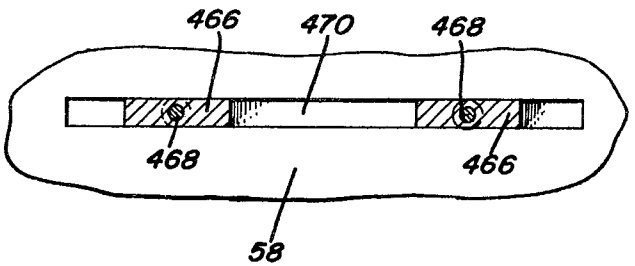
FIG. 38 is a horizontal sectional detail view illustrating the manner in which the counterbalance unit cylinder and also the pump cylinders are keyed to the supporting base, being taken substantially upon the plane indicated by the section line 38—38 of FIG. 36.
Figure 37:
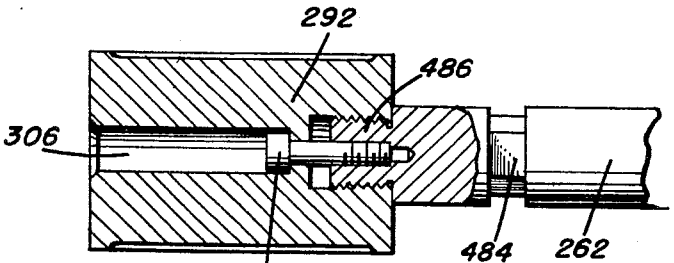
FIG. 37 is a detailed view in vertical longitudinal section showing the connection securing the piston rod of the counterbalance of cylinder to its crosshead slide.

At this point attention is directed to FIGS. 31 and 36 for a description of the counterbalance cylinder 102 of the pump unit which is provided with an axial bore 430 diametrically enlarged or recessed intermediate its ends as at 432 to provide a cooling jacket. Received in the axial bore is the cylinder sleeve or cylinder liner 434 which at one end is provided with an enlarged flange 436 adapted to be secured to the end of the cylinder 102 as by fastening bolts 438. Suitable O-rings or packing or sealing members 440 and 442 are provided between the cylinder liner 434 and the bore 430 of the cylinder and between the enlarged flange 436 and the end of the cylinder.

An axial bore 444 extends through the cylinder liner and constitutes the chamber of the counterbalance pump, this bore having a reduced internally threaded end 446 for a purpose to subsequently apparent. At its other end, the bore is diametrically enlarged as at 448 to receive therein a plurality of packing members 450 which abut against a retainer ring 452 seated on the annular surface at the bottom of the bore 448 and its junction with the bore 446. A packing gland 454 in the form of a sleeve is slidably received in the bore 448 to compress the packing 450 therein and is provided with an enlarged centrally aperturned flange 456 by which it is secured to the open end of the cylinder 102 as by means of fastening bolts or studs 458. Slidable in the chamber 444 is a preferably solid piston plunger 460 comprising the counterbalance piston of the pump unit as set forth hereinafter. This piston has a fluid tight engagement in the bore 444 by means of the packing member 450 previously mentioned.

Coolant is supplied to the cooling jacket of the counterbalance cylinder and is discharged therefrom by any suitable cooling circulating system, which may include the coolant supply conduit 462 (see FIG. 31) and the coolant discharge conduit 464.

Each of the previously described working cylinders 100 and the counterbalance cylinder 102 are mounted upon the previously described surface 58, being retained in selected position thereon as by means of keys 466 secured to each of the cylinders as by bolts 468 and projecting therebeneath for engagement in recessed grooves or channels 470 in the surface of the platform 58 as will be apparent from FIGS. 31, 32, 36 and 38.

Referring now to FIG. 31, it will be seen that the internally threaded bore 446 of the working chamber 444 has a nipple 472 engaged therein and by which an accumulator 474 is secured to and placed into operative communication with the chamber 444. This accumulator is of the same construction described in detail in connection with FIG. 31A. Opposite to the nipple 472, the accumulator 474 is provided with a coupling 476 and a conduit 478 corresponding to the conduit 431 previously mentioned by means of which any desired fluid pressure may be applied and maintained in the accumulator chamber and within the inflatable rubber bag therein. A suitable volume of liquid 480 may be retained in the accumulator chamber 474 to thus apply any desired back pressure to the counterbalance piston 460.

In the compensator cylinder and accumulator of FIG. 31 a working pressure compensating conduit 449 applies the main working pressure in the Y-tube assembly 30 to the pump counterbalance cylinder 102 by a conduit 449 and a bore in the cylinder head 436. Thus the pressure operating in the Y-tube assembly is equalized with that in the compensator cylinder and its accumulator.

Referring again to FIGS. 36 and 37, it will be seen that the counterbalance piston 460 is provided with a stem extending therefrom and comprising the previously mentioned piston rod 262 which rod may be provided with a diametrically reduced polygonal shaped portion 484 for engagement by a wrench and terminates in a diametrically reduced externally threaded extremity 486 by which it is detachably secured to the body of slide 292 (see FIGS. 24 and 25) as by means of the previously described cap screw 319. Since the slide is of substantially the same construction for both the working cylinders and the counterbalance cylinder of the pump unit, the illustration of this slide in FIGS. 24 and 25 and the description of same as set forth hereinbefore will suffice for an understanding of the slide and its associated with the counterbalance cylinder.

Figure 33:
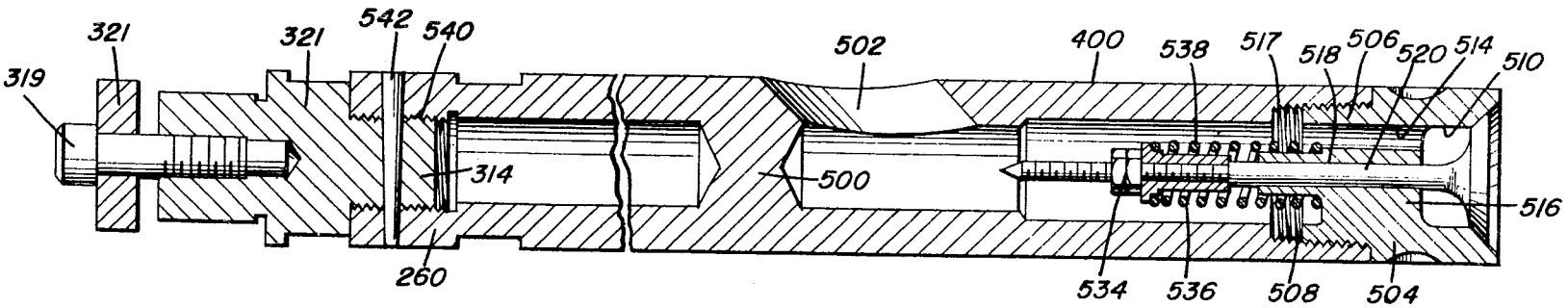
FIG. 33 is a central longitudinal sectional view upon a slightly enlarged scale of the generator or working pump cylinder, piston and piston rod of FIG. 32, parts being broken away.
Figure 34:
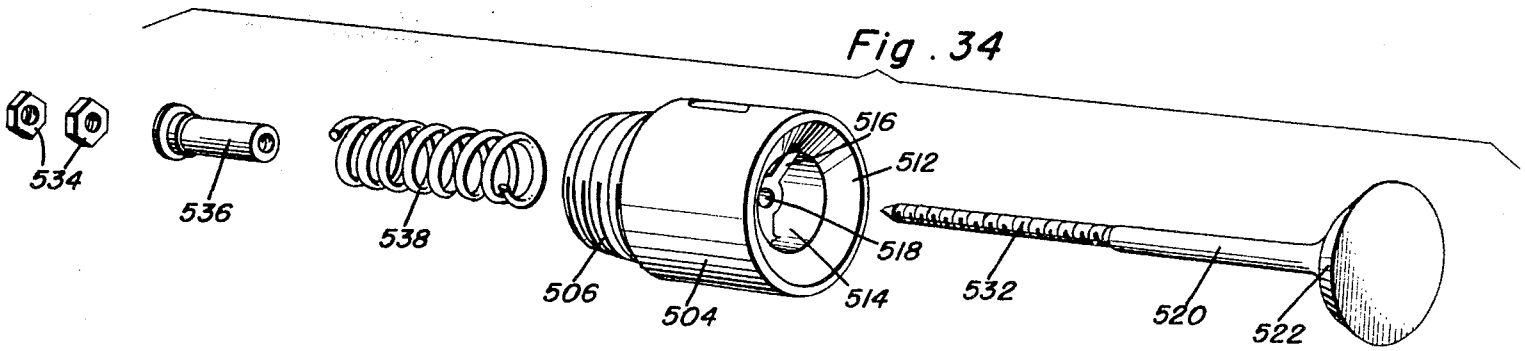
FIG. 34 is an exploded perspective view of the working pump piston valve assembly.
Figure 35:
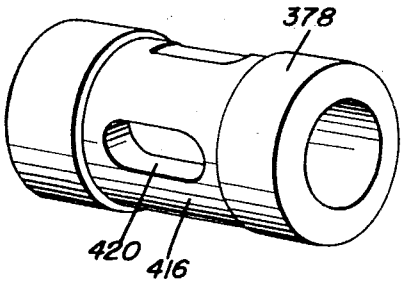
FIG. 35 is a perspective view of the packing sleeve of the working pump piston assembly.

Referring now specifically to FIGS. 33 and 34 for an understanding of the construction of the pump working piston 400. The latter comprises a cylindrical member which is open at both ends, being provided intermediate its ends with a partition 500. Immediately adjacent this partition and extending towards the forward end of the piston therefrom is a longitudinally extending slot 502 constituting the inlet port opening into the hollow interior of the piston and which at all times registers with the openings 420 in the sleeve 378 and thus with top inlet conduit 410 as previously described.

An inlet valve cage 504 has a diametrically reduced externally threaded rear extremity 506 screw threadedly engaged in the internally threaded bore 508 at the open right end of the piston 400. At its outer end the hollow cage 504 is provided with a valve chamber 510 which terminates in a conical valve seat 512. One or more fluid passages 514 extends from the chamber 510 into the interior of the piston 400 and a spider 516 is provided with an axial valve stem passage 518 in which is slidably received and guided the stem 520 of the valve 522.

At its other end the valve stem is reduced in diameter and is externally threaded as at 532 and by means of a pair of lock nuts 534 and a flanged guide sleeve and retainer 536, a compression spring 538 is compressively engaged and abutted against the spider 516 and its projecting guide bushing 517 to thus yieldingly retain the valve upon its seat.

It will thus be seen that fluid entering the interior of the piston through the port 502 may enter by the passage 514 into the chamber 510 and thus may pass the valve when the latter is opened as set forth hereinafter.

The open other end 260 of the piston 400, comprising the abovementioned piston rod, is internally threaded as at 540 to receive a connector 312 as previously mentioned and as shown in FIGS. 24 and 25 by which the pump working piston is secured to guide member 292. Pin 542 may be employed to retain the connector in pump piston 400 against accidental displacement therefrom.

As so far described, it will now be apparent that by appropriately choosing the mass of the counterbalance piston and in view of the angular disposition of the crank throws of the two crankshafts which are connected to the counterbalance piston and to the two working or pump pistons, the inertia and force of the working pistons may be effectively balanced to thereby eliminate vibrations to the mechanism arising from the reciprocation of the three pistons. In addition, by adjusting the back pressure or load applied to the counterbalance piston through the fluid pressure maintained in the accumulator chamber 474 of the counterbalance cylinder the load imposed upon the mechanism by the pump pistons may be effectively also counterbalanced. Thus there results a smooth working and vibrationless mechanism in the three cylindered unit of the pump unit.

It is evident that during their reciprocation, as fluid is required in the bores 374 and 372, the pump working piston 400 will intake fluid from the supply conductor 410 and passage 502 into piston 400 behind the valve 522 on the piston outstroke and on the piston instroke will discharge this fluid past the valve and into the bores 372 and 374 in front of the pistons.

It is also to be understood that the valve pistons 400 and their inlet means 422, 424, 410, and 420 may also be employed to introduce other liquids and gases into the conduits of the Y-tube assembly for other purpose as desired.

DISCHARGE VALVE ASSEMBLY (FIGS. 39–47)

Reference is now made particularly to FIGS. 39–47 for an exposition of the construction and operation of the valve assembly of this invention. As previously mentioned, and as will be apparent from FIGS. 4–6, 10–12, the valve assemblies, indicated generally by the numeral 82, are operatively connected to the terminal portions 112 of the conduits 110 of the Y-tube assembly 30. The valve assemblies include cylindrical casings 560 having thereon mounting flanges 562 by which the cylindrical casings are detachably secured as by fastening bolts 564 to a suitable portion of the crankcase and supporting base 50.

Figure 39:
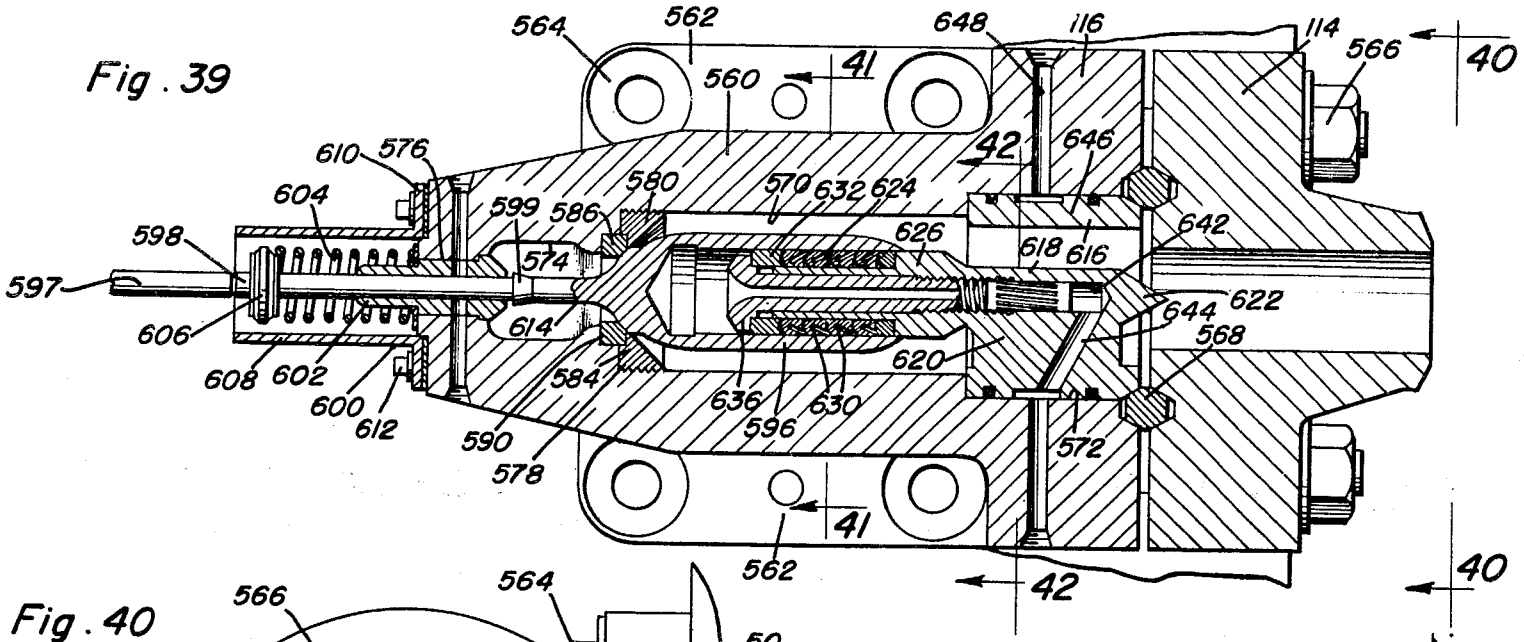
FIG. 39 is a longitudinal central view in vertical section of the valve assembly, taken upon the enlarged scale substantially upon the plane indicated by the section line 39—39 of FIG. 5.
Figure 41:
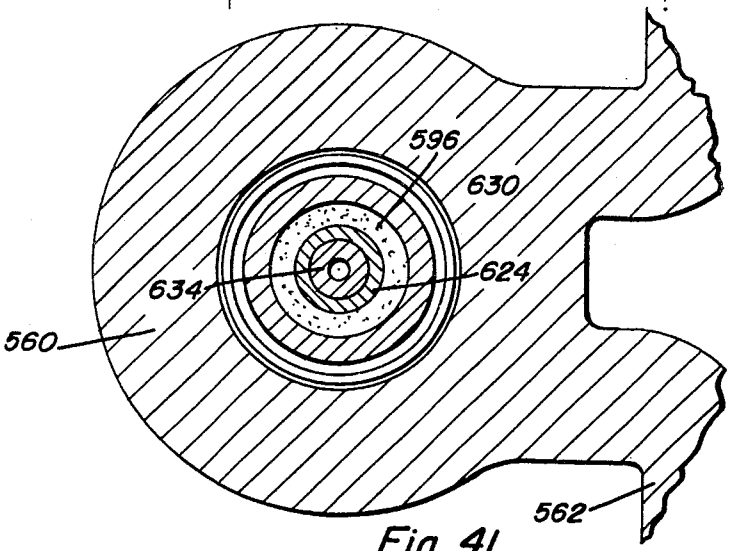
FIG. 41 is a vertical transverse sectional view through the valve assembly housing being taken substantially upon the plane indicated by section line 41—41 of FIG. 39.
Figure 40:
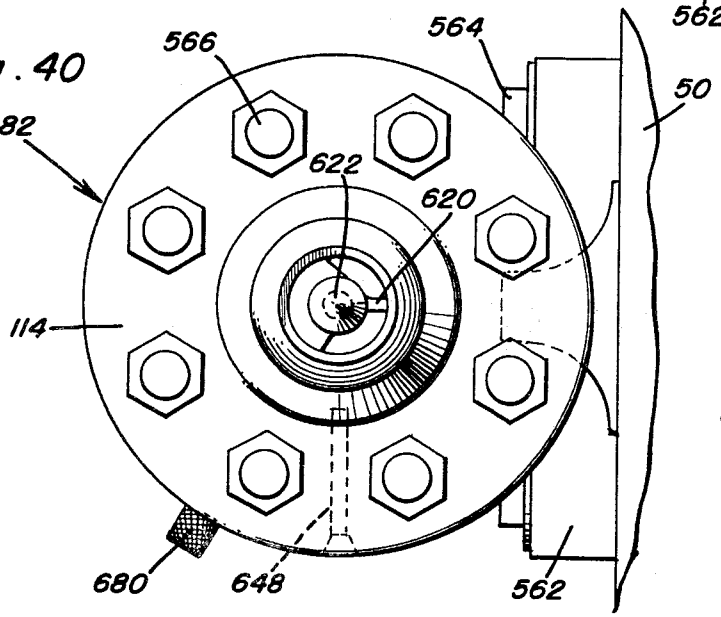
FIG. 40 is an end elevational view of the valve assembly, being taken substantially upon the vertical plane indicated by the section line 40—40 of FIG. 39.

The casings 560 are provided with the previously mentioned flanges 116 to which are secured the flanges 114 of the terminal portions 112 of the conduits 110 through the use of fastening bolts 566. As shown in FIG. 39, the mating surfaces of the flanges 114 and 116 are provided with registering annular grooves receiving a packing ring or O-ring 568 for establishing a fluid-tight seal between the two flanges in the same manner as set forth in connection with the flanges 106, 108 of the pump cylinders.

The casing 560 is provided with a cylindrical bore 570 therein which in turn has a diametrically enlarged bore 572 communicating therewith and opening to the surface of the flange 116. At the other end of the casing 560 from the flange 116, a further axial diametrically reduced bore 574 is provided which opens into the bore 570 and which at its other end terminates in a diametrically reduced axial bore 576 opening through the end of the cylindrical casing.

Figures 42, 43, 44, 45:
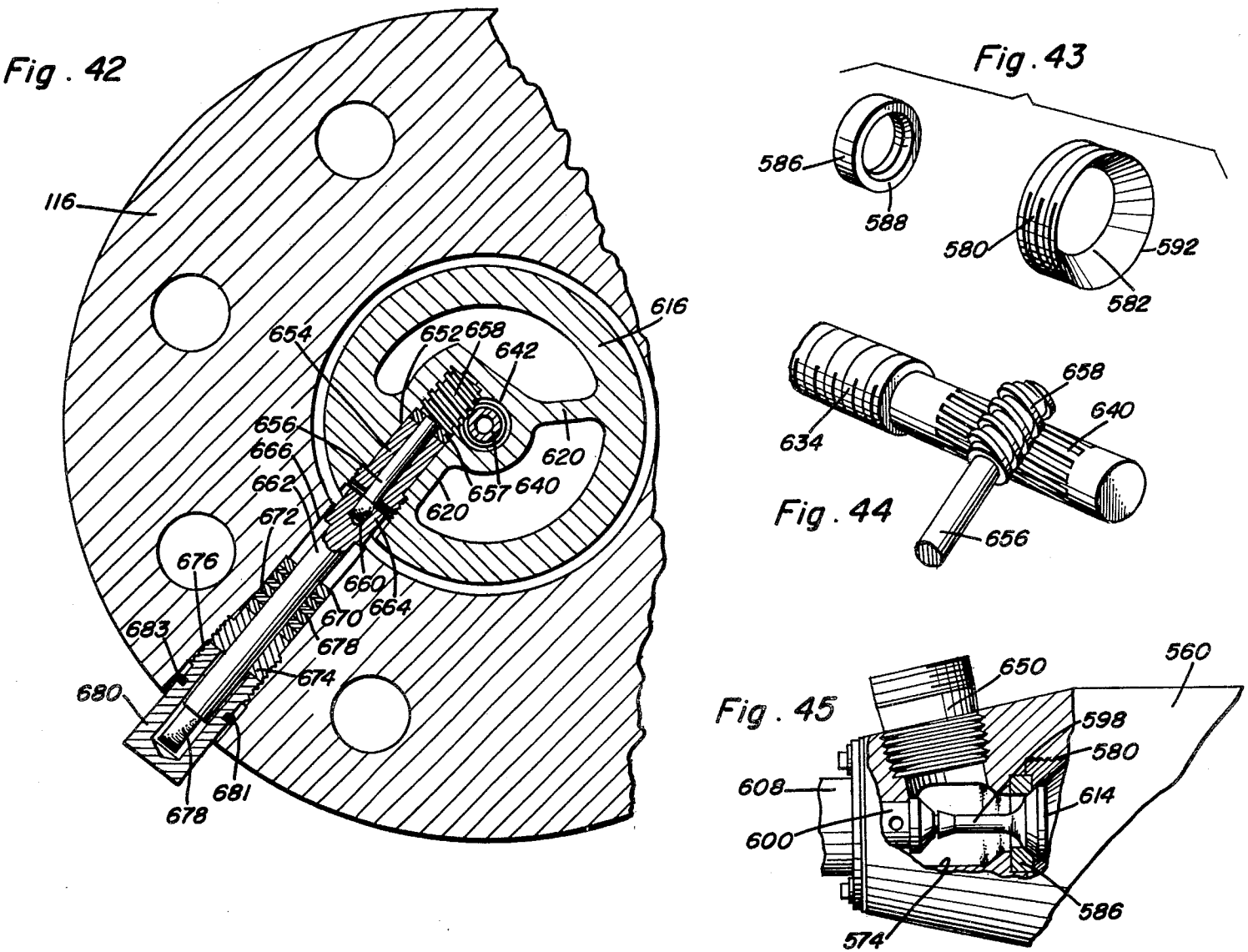
FIG. 42 is a fragmentary detail view of the adjusting means for the valve packing, being taken upon an enlarged scale substantially upon the transverse vertical plane indicated by the section line 42—42 of FIG. 39.
FIG. 43 is a group perspective view of the valve seat assembly of the valve assembly of FIG. 39.
FIG. 44 is a perspective detail view showing the manner in which the adjusting rod operates the packing rod of the valve assembly of FIGS. 39 and 41.
FIG. 45 is a detailed view in vertical section of the discharge support of the valve assembly of FIG. 39, being taken upon an enlarged scale substantially upon the plane of section line 45—45 of FIG. 6.

At the junction of the bores 570 and 574 there is provided a valve seat assembly designated generally by the numeral 578. The elements forming the valve seat assembly are shown in detail in FIG. 43, and their positioning with respect to the bores 570 and 574 is also shown in FIG. 45. In view of the relatively enormous shocks and loads to which this valve assembly is subjected, its construction is of considerable importance to the satisfactory functioning of the mechanism.

In one satisfactory embodiment of the valve seat assembly 578 there is provided a cylindrical body or ring 580 adapted to be screw threadedly secured in the bore 570 in abutment with the shoulder at the junction of this bore with the bore 574. The ring 580 is provided with a circumferentially extending inwardly projecting rib 582 having a tapered surface substantially complementary to that of the valve seat 586 and the valve surface 588 cooperating with the latter. The valve seat assembly 578 also includes a valve seat 586 likewise consisting of a ring having a beveled surface 588 constituting the actual surface to be engaged by the valve as set forth hereinafter, the valve seat 586 being slightly oversize relative to a countersunk recess 590 in the bore 570, and being confined therein by cooling and shrinking the valve seat with dry ice, inserting it in the recess 590 and allowing it to then expand into a tight engagement therein. The ring 580 preferably includes a conical surface 592 which forms a smoothly curving surface leading up to the valve surface 588 of the valve seat 586, as will be more clearly apparent from FIGS. 39 and 45.

The tapered surfaces of the valve seat assembly and of the valve result in very important functions and operations as set forth hereinafter.

A valve member 596 is mounted in the casing 560 for axial reciprocation therein whereby to perform its valving action. The valve 596 is preferably a hollow sleeve provided with an axially extending stem 598 for actuation of the valve. The stem is slidingly and guidingly received in a bushing 600 seated in and extending through the bore 576 and has an enlarged tapered section 599 adjacent the bushing 600 whereby to preclude the entry of foreign matter, entrained by the fluid passing through the valve seat, into the bushing. The valve stem 598 further has a diametrically reduced end portion 602 which serves to position one end of the valve compression spring 604 which encircles the valve stem and has its extremities abutting against the end of the cylindrical casing 560, and against any suitable form of valve spring retainer 606 which is carried by the stem 598. The retainer may be of such conventional design as to cause slight rotation of the valve during each reciprocation, and cooperates with the spring to yieldingly urge the valve axially towards the left or to closing position upon the valve seat 586 as viewed in FIG. 39. A removable cylindrical housing 608 encircles the valve spring and has its flanged extremity 610 detachably secured as by fastening bolts 612 to the end of the valve casing 560.

At the junction of the valve body 596 with the valve stem, the valve is provided a conical surface 614 complementary to and cooperating with the valve seating surface 588 previously mentioned.

Figures 46, 47:
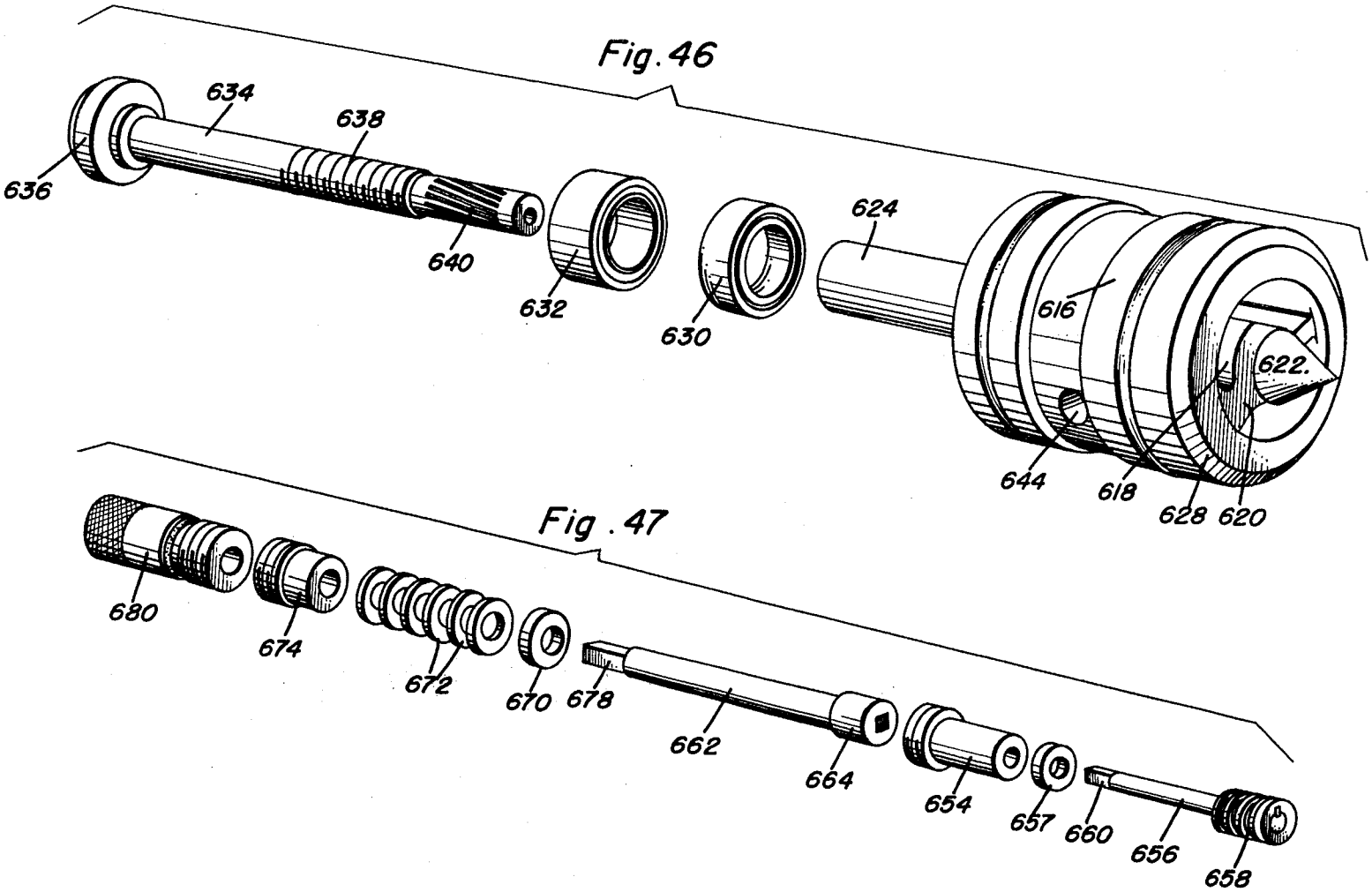
FIG. 46 is a group perspective view of the valve assembly of FIG. 39, some of the packing rings being omitted therefrom.
FIG. 47 is a group perspective view of the mechanism of FIG. 42 for adjusting the packing of valve assembly of FIGS. 39 and 46.

Seated in the previously mentioned enlarged bore 572 is a cylindrical body 616 which is hollow and has an axially extending core 618 therethrough, integrally secured to the walls of the body as by radially extending webs 620, see FIGS. 46 and 42. The axial core has a conical projection 622 at its forward end, while from its other or rearward end projects a stem or sleeve 624, having a diametrically enlarged portion 626 where this sleeve joins the core. As will be more readily apparent from FIG. 39, the right hand or forward end of the body 616 is provided with a conical beveled surface 628, see FIG. 46, which forms one side of the previously mentioned channel which receives the packing or O-ring 568.

The sleeve 624 is stationary and extends into the open hollow end of the valve 596 as shown in FIG. 39. Use is made of this sleeve to provide a packing and sealing means which will prevent the passage of fluid, even under the high pressures and sudden pressure changes permitted in this apparatus during the operation, between the interior of the valve 596 and the sleeve 624.

Attention is directed to FIG. 39 wherein it will be observed that the diameter of the enlarged stationary portion 626 is the same as the diameter of the valve seating surface 614 where the latter engages the valve seat 588. Under this condition, since the exposed areas at the two opposite ends of the valve 596 are equal, the pressure of the fluid in the bore 570 exerts equal forces upon the two ends of the valve whereby the valve is statically balanced, reducing the force required for the opening or closing of the valve to only that necessary to overcome the spring 604 and any force exerted by the pressure of the inert gas maintained within the bores 648, 644, and 642 and within the valve 596 between the head of the latter and the enlarged head 636 of the stationary member 626.

It will be understood, however, that these equal areas may be appropriately varied in order to produce a differential force acting on the valve from the fluid pressure in the bore 570 and thus bias the valve either toward or from its seat.

The taper of the surface on the ring 580 cooperates with the adjacent, correspondingly tapered surface 588 on the valve 596 to define a restricted throat therebetween. This throat produces a throttling effect upon the flow of liquid therethrough in order to create a balancing force on that end of the valve in opposition to the force produced on the tapered opposite end of the valve by the fluid flow and thus produce a dynamic balancing of the valve in addition to the previously described static balancing thereof. However, as desired, a differential effect may be obtained to yieldingly urge the valve either to or from closing position.

The packing assembly which is interposed between the valve body 596 and the sleeve 624 comprises a plurality of suitable packing rings 630 which surround the sleeve and are received inside of the hollow valve body. One end of the series of packing rings abuts against the enlarged member 626, while the other end of the series of rings in engaged by a ring 632 which serves to apply pressure to the packing rings 630, but more important, constitutes a guide ring for the interior of the valve body. A packing ring retainer and adjusting member consisting of a stem 634, hollow throughout its length is provided at one end with a diametrically enlarged head 636 and is externally threaded as at 638 adjacent its other end, while the adjacent end of the stem is externally toothed or splined as at 640. The core 618 of the body 616 is provided with a bore 642 opening from the left end of the same and this bore is internally threaded to receive the threads 638, although as will be noted from FIG. 46, the toothed so splined portion 640 is of a lesser diameter than the portion 638 for a purpose to be subsequently apparent.

Extending through one of the webs 620 is a duct or passage 644 which communicates with the bore 642 and with a circumferentially extending channel or groove 646 formed upon the exterior surface of the body 616 and which in turn has continuous communication with the radially extending bores or passages 648 extending to the exterior of the casing 560 through the flanges 116. The upwardly directed bore 648 is for receiving an inert gas under pressure, as later described, while the lower bore 648 comprises a drainage for fluid leaking past the packing 630 to a suitable drain tank, not shown. As so far described, and from FIG. 39, it will not be apparent that fluid may flow through the conduits 110, through the valve body 616 and into the bores 570 of the valve casings 560, and that after passing the valve assembly this fluid will be discharged from the bore 574 as by the conduits 650, as will be apparent from FIG. 45.

Means operable during operation of the apparatus is provided for adjusting from the exterior of the valve assembly the packing assembly interposed between the sleeve 624 and the interior of the valve body 596. This adjusting means is shown more clearly in FIG. 42, the elements thereof being set forth in FIGS. 44 and 47.

Extending into the valve body through the flange 116 and one of the webs 620 is a passage 652, which intersects the previously mentioned axial passage 642. Received in a reduced end section of the passage 642 is a bushing or bearing member 654 in which is journaled a shaft 656 having at its inner end a washer 657 and a worm gear 658 which continuously meshes with the toothed or splined portion 640 of the stem 634. At its outer end the shaft 656 is provided with a squared or non-circular end portion 660 to which an operating means is removably attached. The operating means consists of a shaft 662 having an enlarged socket 664 at one end thereof for engagement with the extremity 660 by sliding axial movement thereon. The shaft 662 is loosely received in an inwardly extending passage 660 in the flange 116, this passage having a diametrically enlarged portion 668 for reception of a retainer ring 670 and a plurality of packing members 672 of any suitable type. An externally threaded packing nut 674 is threadedly engaged in the still further diametrically enlarged portion 676 of the bore 666 whereby to provide a fluid-tight packing assembly for the shaft 662.

The outer end of the shaft 662 is provided likewise with a non-circular end portion 678 which is adapted to be engaged by any suitable tool inserted into the bore 676 whereby rotation may be given to the shaft 662. The bore may be closed by a removable cap 680 having an O-ring groove 681 and an O-ring 683 therein, when adjustment of the packing is not necessary.

As so far described, it will now be apparent that by removal of the cap 680, access may be had to the extremity 678 of the shaft 662 whereby a tool may be applied to the same to rotate the shaft and through the worm gear 658 and the toothed or splined portions 640, rotation of the stem 634 may be obtained. Engagement of this stem 638 in turn enables the stem to move axially of the sleeve 624 to thereby adjust the compression of the packing rings 630 previously mentioned.

Figure 60:
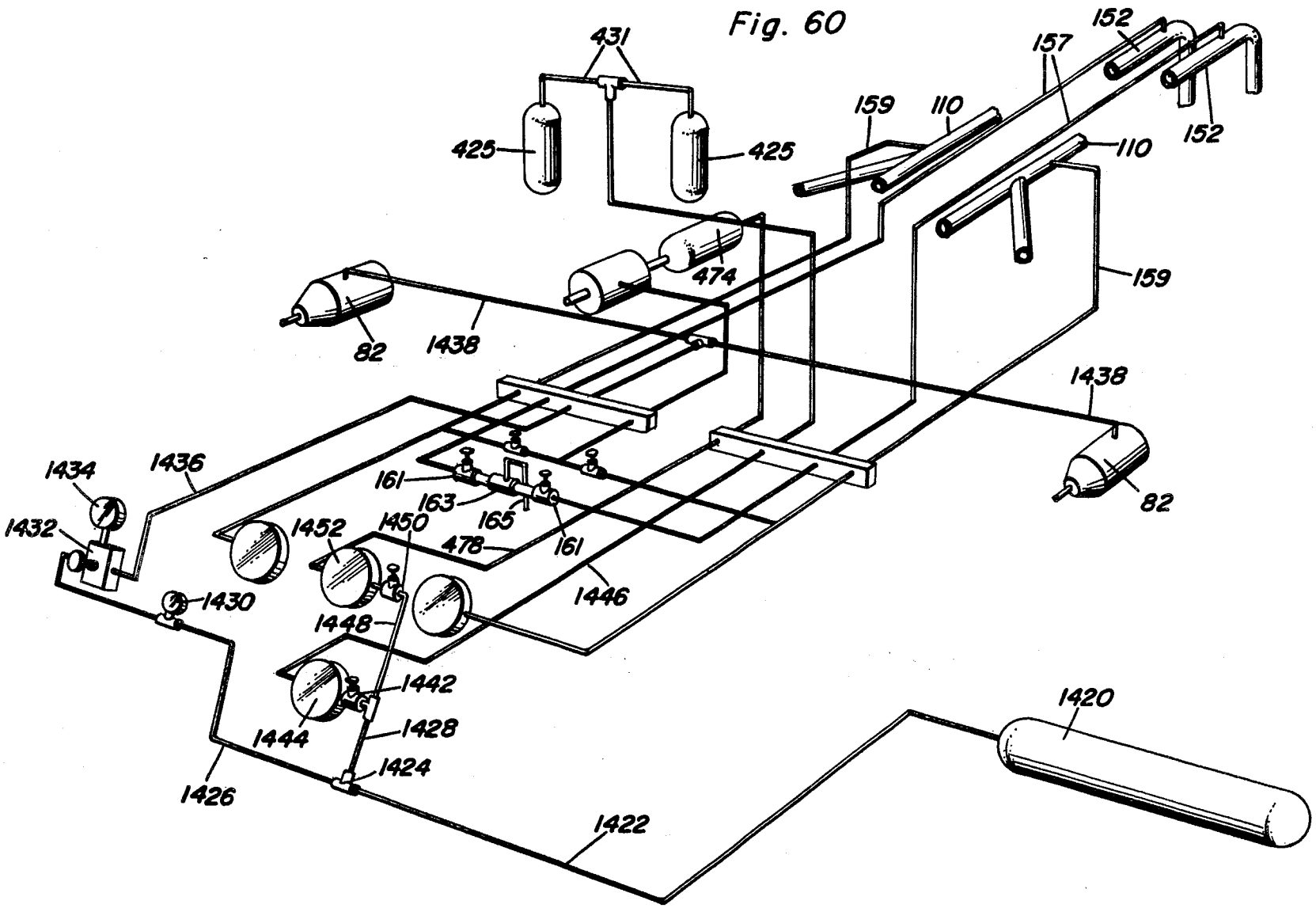
FIG. 60 is a schematic view illustrating the conduit connections of the nitrogen supply of the counterbalance pump and the bleed system of the apparatus.

An important feature of the valve assembly resides in the pressure preloading means for urging the valve towards its seat. For this purpose, as shown in FIG. 60, an inert gas, such as nitrogen, is applied from any suitable source such as a bottle or tank 1420 located in any convenient position upon the apparatus by means of a supply conduit 1422.

The latter is connected by a T-fitting 1424 with conduits 1426 and 1428. The conduit 1426 has nitrogen pressure gauge 1430, for indicating the pressure available from the container 1420, and communicates with a pressure regulating valve 1432 having a gauge 1434 indicating the pressure supplied therefrom by a conduit 1436 to the branch conduits 1438 and thence to the bores 648 of the discharge valve assembly casings 560 of the discharge valve assemblies 82.

By means of the gauge and regulator 1434 and 1432, any desired preloading or closing pressure can be applied to the interior of the valve 596 for resiliently urging it to its seat and either supplementing or substituting for the valve stem closing spring 604. The fluid pressure thus applied to the interior of the valve not only closes or assists in the closing movement of the valve but also cushions and limits the completion of the opening movement thereof.

The conduit 1428 has a T-fitting 1440 by which it is connected to a control valve 1442, gauge 1444 and conduit 1446 and the previously mentioned branch conduits 431 of the pump working cylinder accumulators 425; and by a further conduit 1448, control valve 1450, gauge 1452 and the previously mentioned conduit 478 to the pump counterbalance cylinder accumulator 474. Thus, the pressure maintained in the accumulators 425 and 474 of the pump and counterbalance cylinders may be individually adjusted for preloading these cylinders.

DISCHARGE VALVE TIMING ASSEMBLY

Reference is next made more particularly to FIGS. 48–59, for a disclosure of the valve timing assembly, by means of which precise control is provided for the automatic opening of the discharge valve assemblies 82, both as to the frequency of opening thereof and as to the time, duration and extent of the opening with respect to the position of the pistons of the pump assembly.

Figure 53:
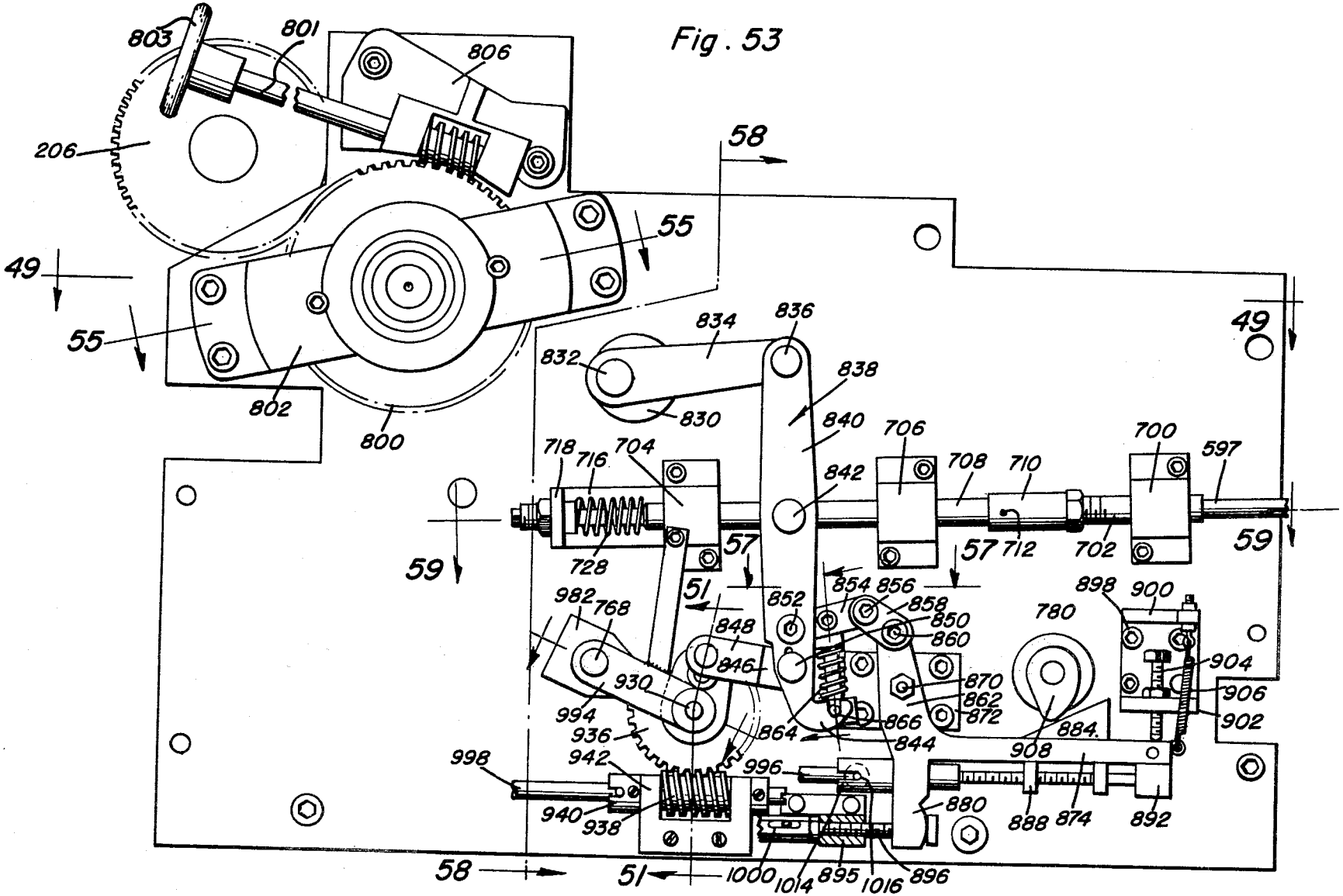
FIG. 53 is a view in vertical elevation from one end of the pump unit with the end cover removed and showing the valve actuating mechanism.

As shown best in FIGS. 6 and 53, the previously mentioned valve stem 598 shown in FIG. 39 extends towards the left from the valve casing and is abuttingly and operatively engaged by a push rod 597, in turn actuated by a number of different valve actuating mechanisms, each of which is adapted to impart a particular timed motion to the push rod and thence to the valve stem.

The push rod extends through a suitable guide bracket 700 and at its left end is externally threaded as at 702 to a second or actuator rod 708 journaled in a second set of guide brackets 704 and 706, and the actuator rod is axially aligned with the push rod and valve stem and is detachably secured or connected to the push rod by a connector sleeve 710. The sleeve 710 is secured to the actuator rod 708 by a shear pin 712 being also secured to the push rod by a threaded engagement together with a lock nut 714.

Figure 59:
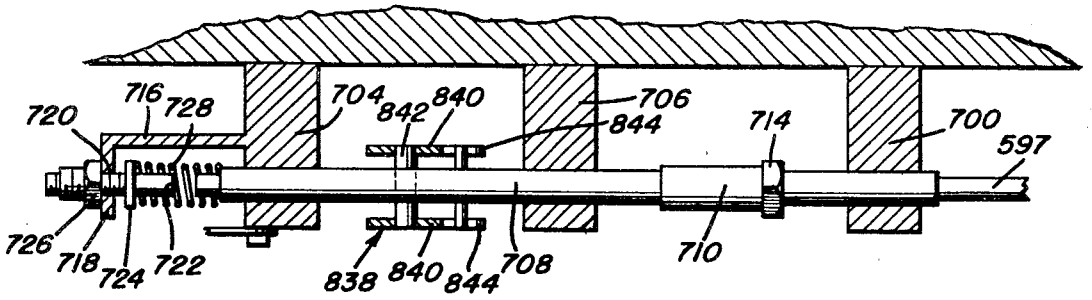
FIG. 59 is a horizontal sectional view taken substantially upon the plane indicated by section line 59—59 of FIG. 53.

Extending from the slide of the bracket 704 is an arm 716 with a flange 718 inturned on the end thereof, the flange being threadedly apertured as at 720, see FIG. 59, to slidingly receive the diametrically reduced abutment pin 722 which is threadedly secured to the flange 718 and is provided with a collar 724 and lock nut 726. The pin 722 is axially adjustable through the bracket to provide an adjustable abutment for the end of the actuator rod 708. A compression spring 728 surrounds the end of the abutment pin 722, and bears against the collar 724 against the spring 728 and thus tensions the reduced end of the actuator rod 708 to yieldingly urge the latter together with the push rod 597 secured thereto, towards the right into operative contact with the valve stem 598.

Referring next specifically to FIGS. 48, 49, 55 and 58, it will be seen that the drive gearing for the valve timing assembly includes a main driving gear 750 which is connected with the previously mentioned gear 206 on the lower crankshaft 172 through the differential assembly 790. The main driving gear 750 is fixedly secured upon the differential shaft 752, and also is in driving engagement with a gear 754 secured to a stub axle or shaft 756. The latter has fixedly secured thereto a small gear 758 in driving engagement with the large gear 760 secured to the idler shaft 762 which is likewise provided with a small driving gear 764 thereon. The gear 764 in turn is engaged with a large gear 766 carried by the shaft 768, the latter having a small driving gear 770 fixed or secured thereto which engages a large gear 772 carried by the shaft 774. A small gear 776 is secured to the shaft 774, meshing with a large gear 778 carried by the shaft 780. Through this gearing assembly, power is transmitted from the lower crankshaft 172 to the various mechanisms which control the operation of the valve assemblies 82.

As previously mentioned, the crankshaft gear 206 through its engagement with the gear 750 causes rotation of the shaft 752. In order to vary the phase relation between the crankshaft 172 and the shaft 756, and the succeeding shafts and gearing driven thereby, a differential gearing assembly is operatively interposed between the shafts 172 and 756, this assembly being shown best in FIG. 55.

Figure 55:
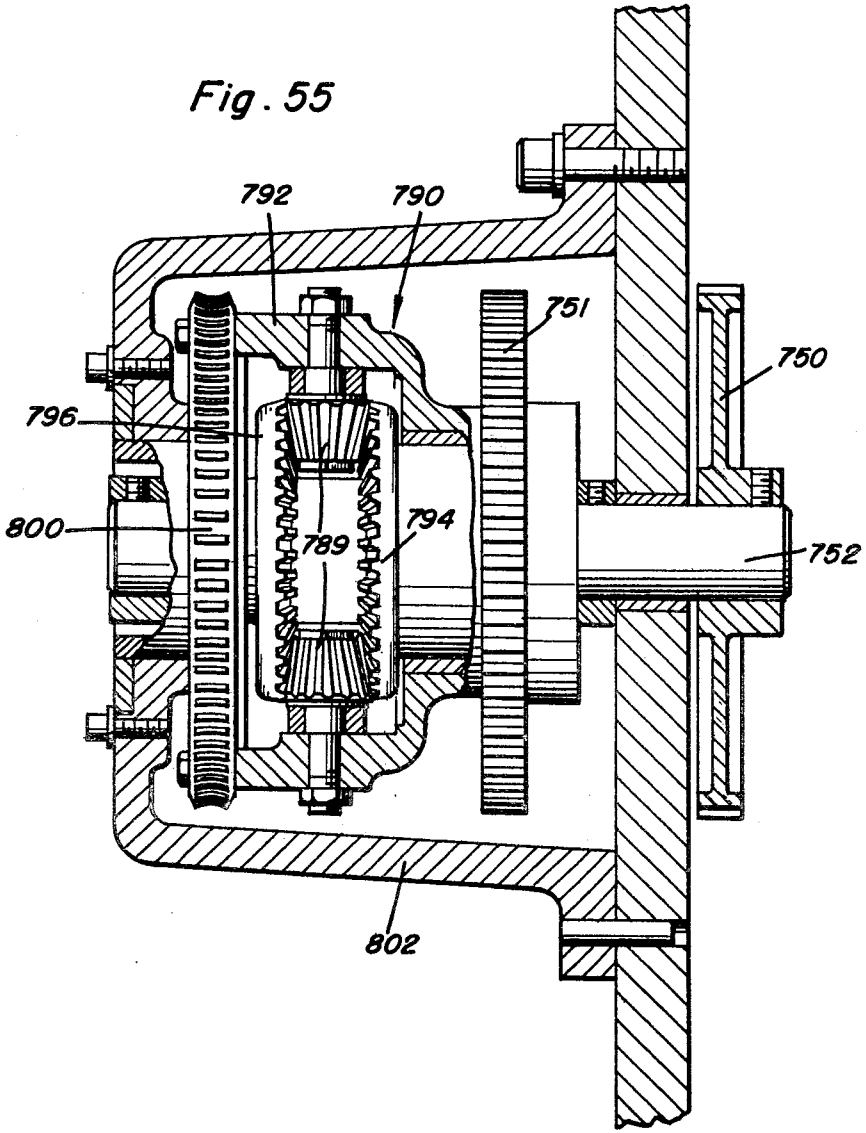
FIG. 55 is a sectional view of the differential gearing for adjusting the phase relation between the pistons and the valves, being taken upon an enlarged scale substantially upon the plane indicated by section line 55—55 of FIG. 53.

The differential gearing assembly is designated generally by the numeral 790 and may be of any conventional design. As illustrated in FIG. 55, this assembly includes a differential housing 792 which is freely rotatably journaled upon the stub axle carrying the driving gear 750. The housing is provided with a gear 751 which is the power output gear of the differential assembly and which directly engages and drives the gear 754 previously mentioned. Fixedly secured to the stub axle 752 within the differential housing 792 are the differential gears 794 and 796, one of these being fixedly secured to the shaft 752, while the other is fixedly secured to the gear 791. Idler gears 798 engage the two gears 794 and 796 in the conventional manner of differential gearing assemblies. Secured to the exterior of the housing 792 is a control gear 800 by means of which the housing is rotationally adjusted in order to thereby vary the phase relation between the gears 794 and 796, and thus between the gears 750 and 751. In this manner, the angular or phase relation between the crankshaft 172 and the shaft 756 can be easily adjusted, thereby permitting variations in the timing of the various shafts of the valve timing assembly and the crankshaft from which they are driven.

As will be noted from FIG. 53, a bracket 802 is provided which supports the differential gearing assembly. In order to actuate the control gear 800, there is provided a shaft 801 mounted in a suitable supporting bracket and having a worm gear thereon engaging the control gear 800, the shaft 804 being extended through the crankshaft casing 80 to the control panel where it is provided with a manual control wheel 803.

Figure 49:
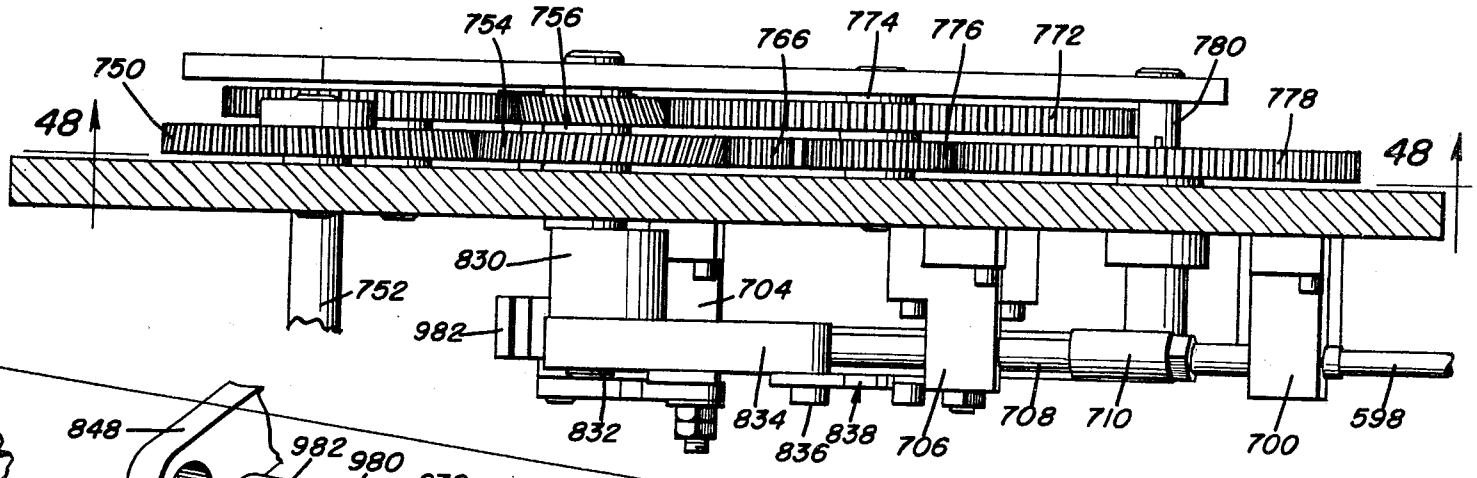
FIG. 49 is a horizontal sectional view of the gearing assembly of FIG. 48, being taken substantially upon the plane indicated by section line 49—49 of FIG. 53.
Figure 58:
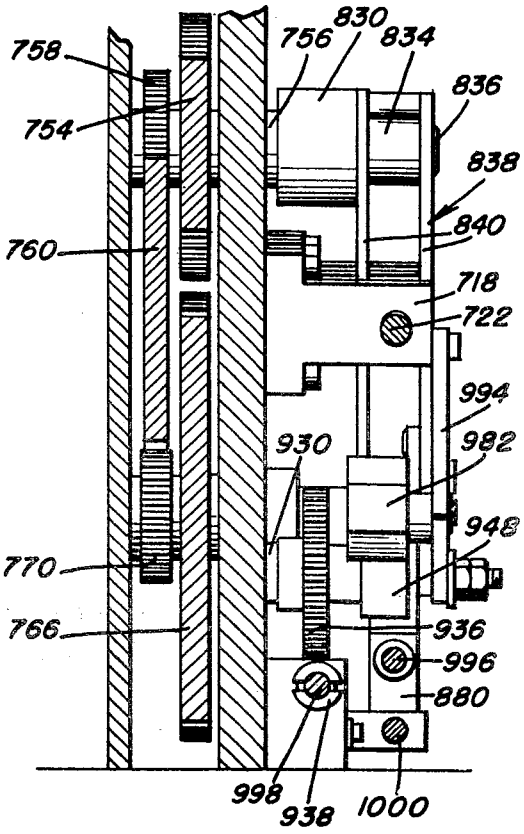
FIG. 58 is a vertical transverse sectional view of the gearing assembly of FIG. 48, being taken substantially upon the plane indicated by broken section line 58—58 of FIG. 53.

Referring next particularly to FIGS. 53, 58 and 49, it will be seen that the previously mentioned stub axle or shaft 756 is provided with a crank disc 830 thereon having a crankpin 832. Journaled upon the pin 832 at one end is a connecting rod 834 whose other end is connected by a pivot pin 836 to the upper end of a lever 838.

As will become more readily apparent in FIGS. 57, 53A, 53B and 59, the lever 838 consists of a pair of parallel flat plates or blades 840 which are pivoted intermediate their ends by a pivot pin 842 to an enlarged central portion of the valve stem actuator rod 708 previously mentioned. The lower ends of the two lever blades are turned laterally as at 844.

Just above their outturned end portions 844, the lever blades 840 receive therebetween the end portion 846 of bifurcated connecting rod 848. A pivot pin 850 serves to pivotally connect the connecting rod 848 to the lever for a purpose to be subsequently apparent.

A further pivot pin 852 extends through the lever blades 840, immediately above the pivot pin 850, and secures thereto a pair of toggle links 854 wholse other ends are pivoted at 856 to a second pair of toggle links 858, the latter in turn being pivoted at 860 to the upper end of a control lever 862 received therebetween. The toggle link assemblies 854 and 858 are yieldingly urged into an off-center position by means of a compression spring 864 whose lower end is seated against a guide block 865 having transversely extending pins 866 in suitable notches 867 in the inturned end portions 844 of the lever blades 840. The guide block is centrally apertured and has a bushing 869 therein slidably receiving a guide pin 871 whose upper end is carried by a transverse block 868 carried by its trunnions 873 in the mid-portion of the toggle links 854.

It is important to note that the proportions and dimensions are such that the axes of the pivots 873 and 868 move in concentric arcs about the axis of the pivot 842 during oscillation of the lever 838 thereby substantially eliminating movement of the spring 864 and the guide pin 861 except for a particular operation set forth hereinafter.

Figure 53A:
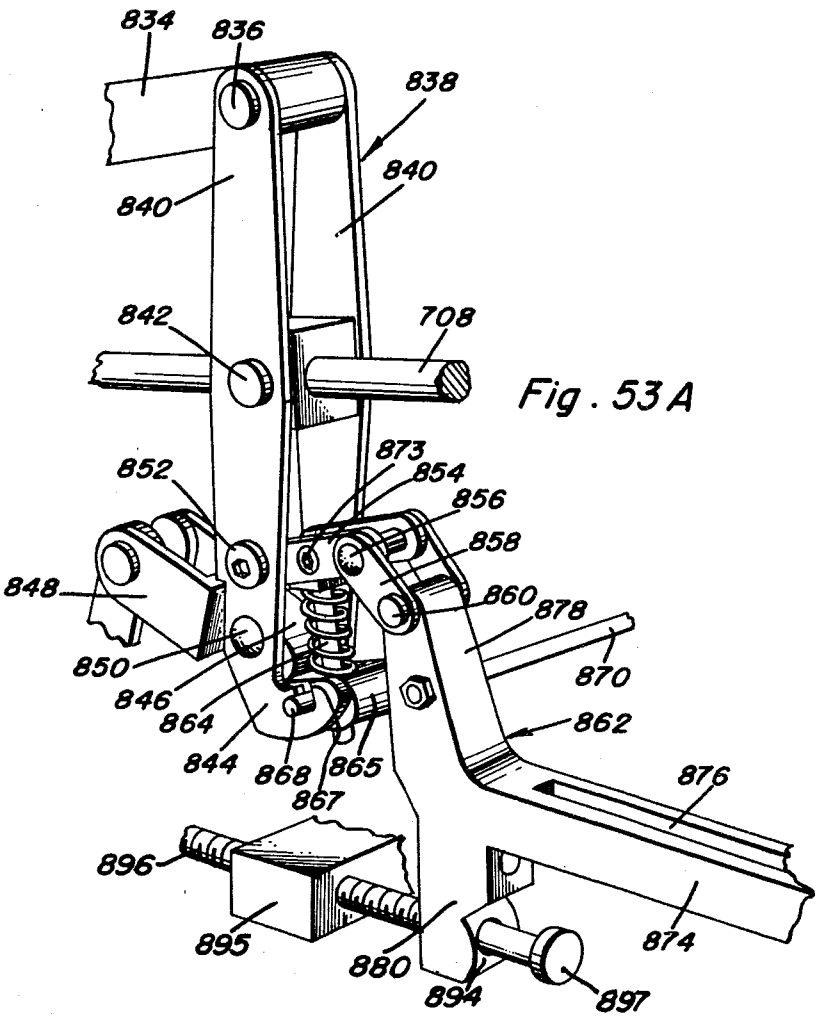
FIGS. 53A and 53B are fragmentary perspective detail views of a part of the mechanism of FIG. 53.
Figure 53B:
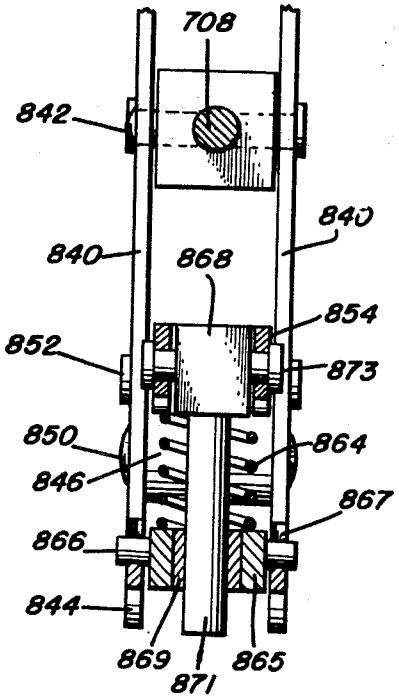
Figure 57:
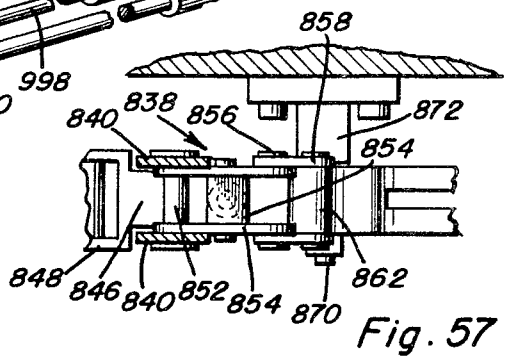
FIG. 57 is a horizontal sectional view taken substantially upon the plane indicated by section line 57—57 of FIG. 53, parts being omitted.

As will be best apparent from FIGS. 53 and 57, the lever 862, see FIG. 53A, is pivotally mounted or journaled upon a supporting pin or fulcrum 870 which in turn is supported by a bracket 872.

Figure 56:
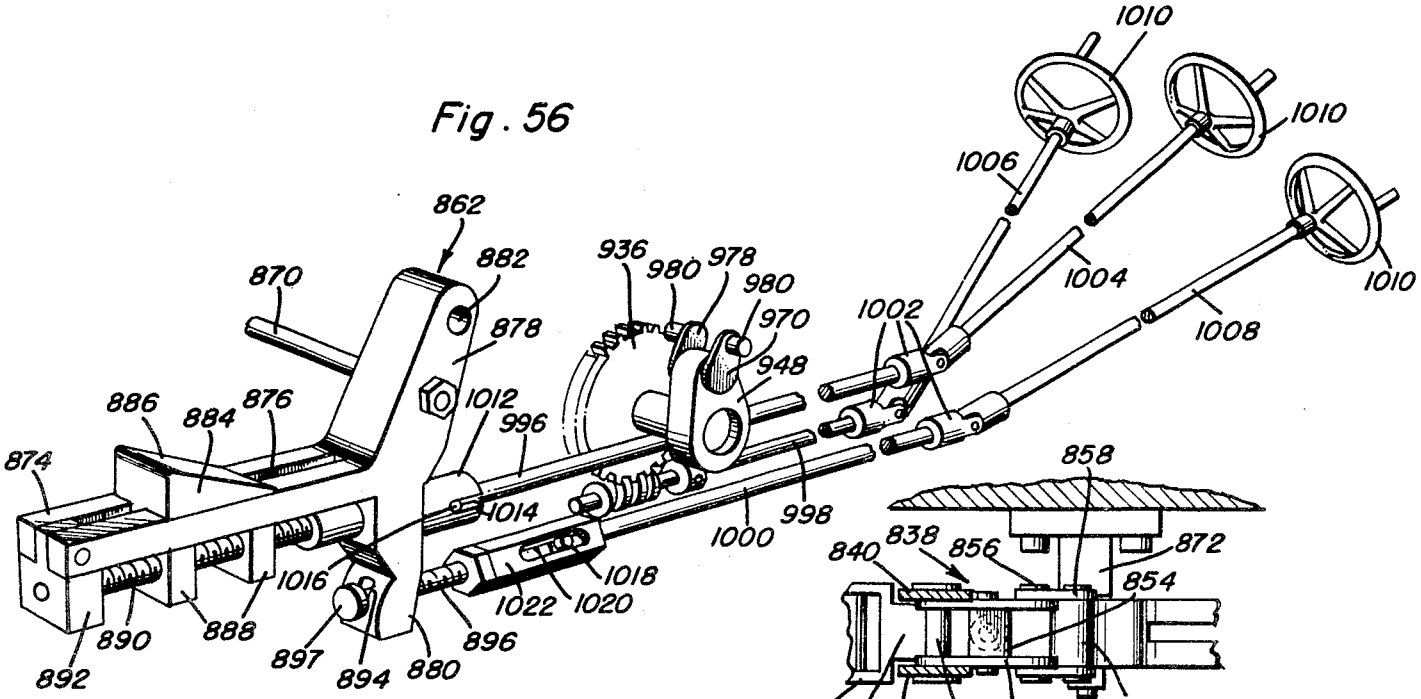
FIG. 56 is a perspective view of the variable timing actuating mechanism of the valve assembly, parts being broken away and showing manual controls for adjusting the actuation of the valves.

Referring now more particularly to FIGS. 53 and 56, it will be seen that the previously mentioned lever 862 is T-shaped, having a straight, longitudinally slotted stem portion 874 with a slot 876 therein and oppositely extending upward and downwardly projecting arms 878 and 880. The upwardly projecting arm 878 is provided with an aperture 882 therethrough to receive the previously mentioned pivot pin 860.

Secured to the stem 874 is a slide 884 having an inclined upper cam surface 886 thereon. Depending from the slide 884 and slidably engaging the undersurface of the stem 874 are a pair of internally threaded slide members 888 which are engaged upon an adjusting screw 890 which is journaled in a depending lug 892 at one side of the stem 874 in the depending or downwardly projecting arm 880 previously mentioned. The arrangement is such that when the adjusting screw 890 is rotated, the slide 884 will be caused to travel in the slot 876 towards or from the upwardly projecting portion 878. The lower extremity of the depending arm 880 is apertured as at 894, see FIG. 53A, and slidably receives therein a screw 896. The latter is utilized, as set forth hereinafter, to establish an operative connection with a cam to effect thereby a rocking motion of the T-shaped lever about its pivot pin or fulcrum support 870 in order to actuate the valve push rod 597 and the valve 596 at a 1 to 100 or any other desired geared ratio with the pump pistons as set forth hereinafter.

As shown in FIGS. 6 and 53, there is provided a U-shaped bracket 898 having parallel upper and lower lateral flanges 900 and 902. The lower flange has threadedly engaged therethrough an adjusting screw 904 adapted to abut the upper surface of the end of the stem 874 of the T-shaped lever and thereby adjustably limit counterclockwise rotation of the lever as viewed in FIG. 53, while a tension spring 906 is secured to the upper flange 900 and to the end of the stem 874 for yieldingly urging the latter upwardly against the adjustable abutment provided by the adjusting screw 904.

Secured to the previously mentioned shaft 780 is a cam 908 which continuously rotates at a speed determined by the ratio of the gear train, this being a ratio of 1 to 100 relative to the crankpin 832, in the embodiment illustrated as hereinbefore set forth. This cam is positioned vertically above the path of longitudinal travel of the slide 884 in order that the cam may be rendered effective to impart periodic downward movements to the slide by engagement with its cam surface 886, and thereby cause clockwise oscillation of the lever 862, the extent or amplitude of this oscillation depending upon the longitudinal adjustment of the slide 884 along the stem 874 of the lever.

An adjusting mechanism to effect a 1 to 10 or desired other ratio actuation of the valve 596 is provided for allowing movement of the lower end of the lever 838 in a rocking motion. For an understanding of this illustrated 1 to 10 ratio adjusting mechanism, attention is now referred especially to FIGS. 50-54. A stub axle 930 is suitably supported upon the frame of the machine and has rotatably journaled thereon a sleeve 932 to which is secured as by a spline or key 934 an adjusting gear 936. The latter in turn is engaged with an adjusting worm gear 938 fixedly secured to a shaft 940 which is rotatably journaled in a suitable supporting bracket 942. It will thus be apparent that upon rotation of the shaft 940, rotation of the sleeve 932 upon the stub axle 930 will be effected.

Figures 51, 52, 54:
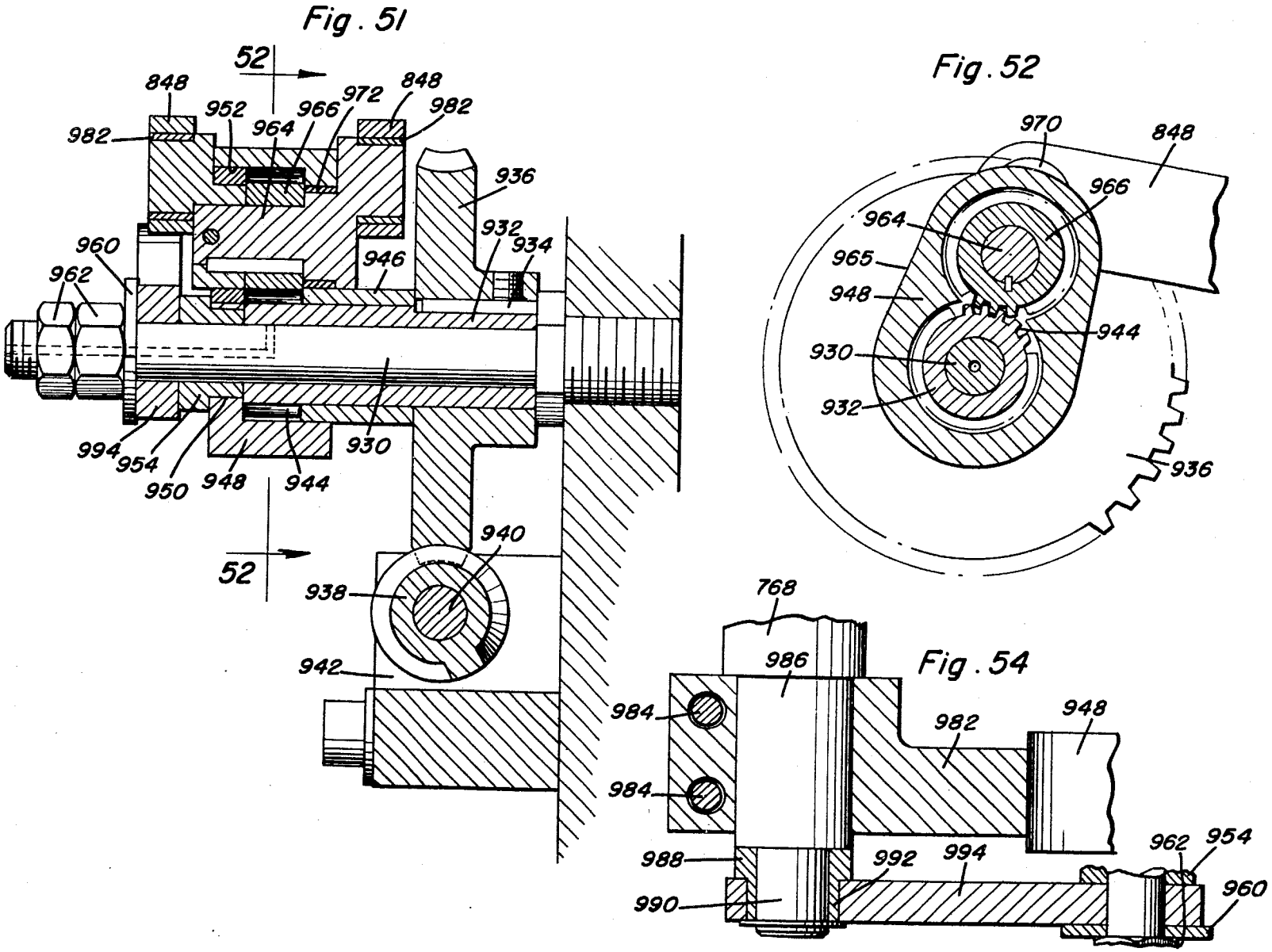
FIG. 51 is a vertical sectional view taken substantially upon the plane indicated by the broken section line 51—51 of FIG. 53, and is taken upon an enlarged scale.
FIG. 52 is a vertical sectional view taken substantially upon the plane indicated by section line 52—52 of FIG. 51.
FIG. 54 is a fragmentary view taken in section substantially upon the plane indicated by section line 54—54 of FIG. 53, and is taken upon an enlarged scale.

Referring now especially to FIGS. 51 and 52, it will be observed that one end of the sleeve 932 is provided with gear teeth 944 thereon and that a spacer sleeve 946 of somewhat greater diameter than that of the gear teeth 944 is journaled upon the sleeve 932 between the gear teeth 944 and the adjusting gear 936 and is pressed into the housing 948 to provide therein a bearing for the sleeve 932.

Figure 50:
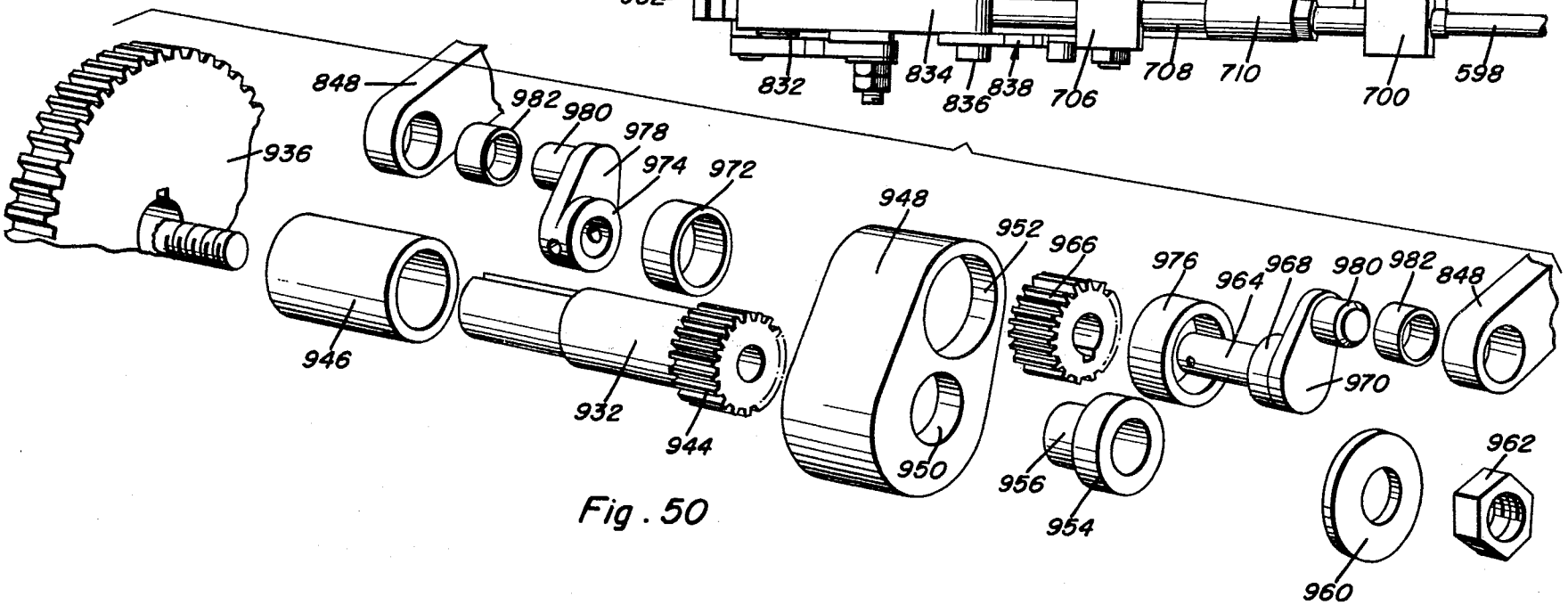
FIG. 50 is an exploded perspective view of the 10 to 1 ratio variable timing drive mechanism of the valve assembly.

As shown in FIGS. 50, 51 and 52, there is provided a housing 948 having circular openings 940 and 952 in one wall thereof. Received in the opening 950 is a bushing 954 by means of which that wall of the housing is journaled upon the stub axle 930. The bushing 954 has a diametrically reduced stem portion 956, see FIG. 50, which abuts against the end of the sleeve 932, a spacing and retaining bracket 994, a washer 960 and a pair of lock nuts 962 being engaged upon the stub axle 930 to retain these parts in assembled relation.

Extending through the other opening 952 of the same wall of the housing 948 is a crankshaft 964 to which is keyed a gear 966 which continually meshes with the gear 944 of the sleeve 932. The crankpin has a crank cheek 968 thereon from which extends a crank arm 970 with crankpin 980 and a bearing sleeve 972 surrounds the crank cheek and journals the latter in the opening 952. Secured to the crankpin 964 at the other side of the gear 966 is a second crank cheek 974 which is journaled as by a bearing ring 976 in the wall of the housing 948. This second crank cheek has a crank arm 978 thereon with a crankpin 980. A pair of bushings 982 journal the two crankpins or crank throws 980 in the bifurcated ends of the member 848 previously mentioned.

As so far described, it will now be apparent that by rotating the gear 936, the two gears 944 and 966 will impart rotation to the crankshaft 964 and the crankpins 980, to thereby move the bifurcated link 848 and thus allow a rocking movement to the lower portion of the lever 838, thereby allowing an adjustment of the limits of the rocking motion of the cam follower or housing 948, when the lower half of lever 838 is being oscillated.

Figure 48:
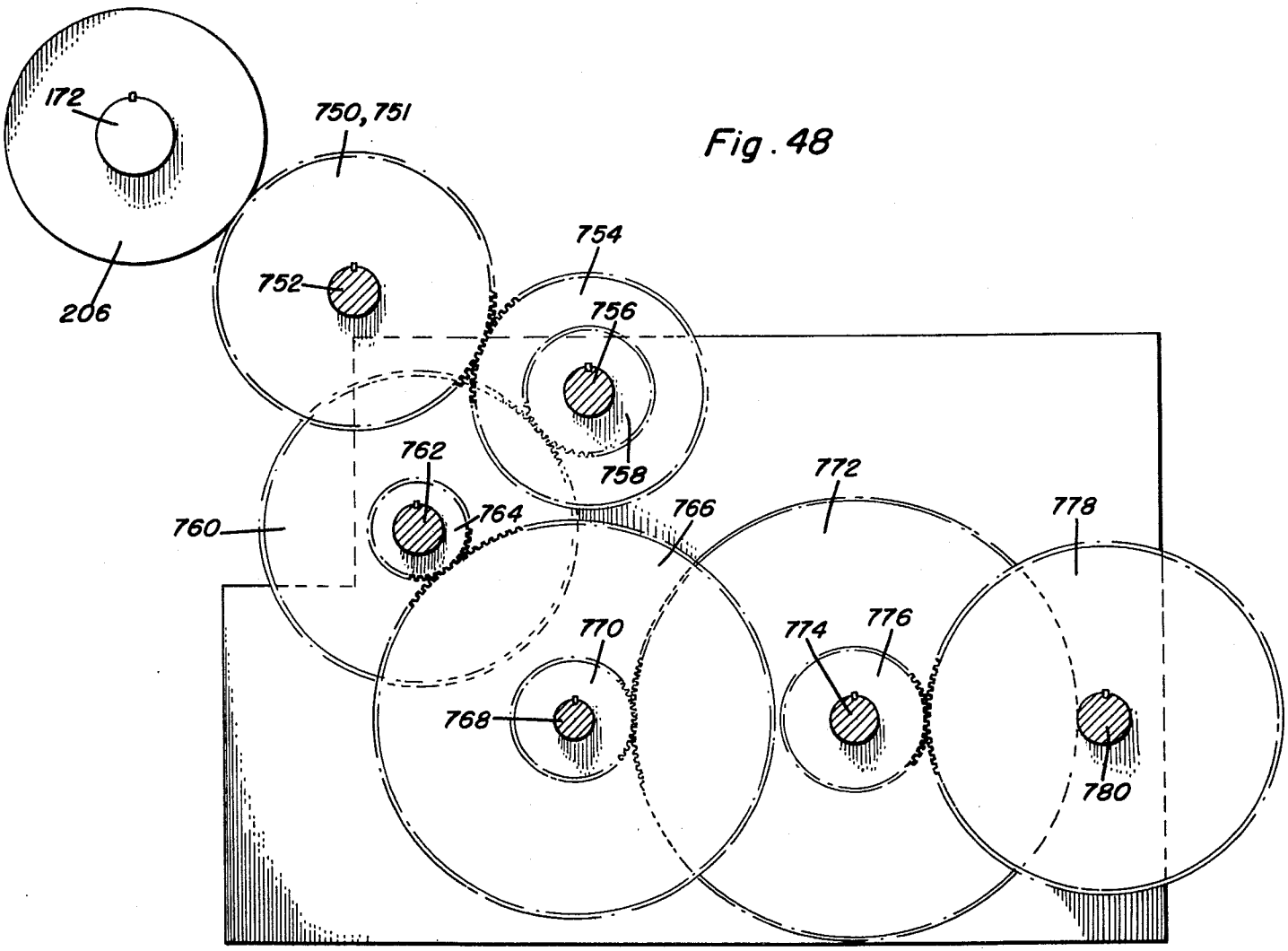
FIG. 48 is a schematic view in vertical transverse section taken upon an enlarged scale substantially upon the plane indicated by section line 48—48 of FIG. 5 and also 48—48 of FIG. 49 and showing the gearing for driving the valve actuating mechanism.

The shaft 768 shown in FIG. 48 has secured thereto as shown in FIGS. 53 and 54 a cam 982 which is fastened as by clamping bolts 984 in rotationally adjusted position upon a diametrically reduced end portion 986 of the shaft 768. A spacer collar 988 journals the diametrically reduced extremity 990 of the shaft 768, and has a reduced neck portion 992 which is engaged in a supporting bracket 994. The arrangement is such that the abutment cam 982 will continuously revolve with its shaft 768 in close proximity and in the path of oscillatory movement of the housing 948.

Although in the embodiment disclosed herein the cam 972 has a single lobe to provide a single operated abutment during each rotation of the cam, a multiple lobe may be employed when the timing is such that a plurality of effective abutments during each rotation of the cam is desired. This, together with changes in the gear ratios, will enable the valve to be opened at other desired ratios besides the multiples of 1 to 10 or 1 to 100 revolutions of the main driving gears 750.

Referring now especially to FIGS. 53 and 56 it will be observed that manual control means are provided for effecting ready adjustment of the previously mentioned adjusting means. Thus, there are provided adjusting shafts 996, 998 and 1000, each of which has a universal joint connection 1002 by which the shafts are respectively connected with the shaft extensions 1004, 1006 and 1008 each being provided with a manual control wheel 1010 thereon. The location of these control wheels upon the instrument panel 84 is shown clearly in FIGS. 2, 4 and 5.

Referring again to FIGS. 53 and 56 it will be seen that the adjusting shaft 996 has a non-rotative axially slidable connection with the end of the adjusting screw 890. For this purpose the screw is provided with a sleeve 1012 having a slot 1014 therein in which is disposed a diametrically positioned pin 1016 carried by the shaft. Accordingly, upon rotation of the shaft 996, it is evident that rotation will be imparted to the adjusting screw 890 thereby resulting in the movement of the slide 884 to vary the operative relationship of the continuously rotating cam 908 and the T-lever 862.

In a somewhat similar manner, the adjusting shaft 998 is connected with the shaft 940 which has the worm 938 thereon, to enable adjustment of the gear 936 and the connecting rod 848.

Finally, the shaft 1000 has an axially slidable but non-rotative connection by means of a diametrically disposed pin 1018 sliding in a slot 1020 formed in a sleeve 1022 which screw threadedly engages the adjusting screw 896 having a head 897. The screw 896 is threaded through a stationary block 899 whereby to impart axial movement to the head 897 upon rotation of the screw. The latter is loosely and slidably received in the aperture 894 of the lever arm 880. The arrangement is such that upon rotation of the shaft 1000, the sleeve 1022 will be rotated and will thus advance the adjusting screw 896 through the block 899 to thereby cause the head 897 to pull the arm 880 and thereby effect a downward pivotal movement of the T-shaped lever 862 about its pivot pin 870. It should be noted that oscillatory or rocking movement of the lever by the cam 908 engaging slide 884 is permitted by the lost motion provided by the slot 894 on the screw 896.

OPERATION OF APPARATUS (FIG. 1–60)

The operation of the apparatus of FIGS. 1–60 is as follows. As shown in the diagrammatic view of FIG. 60, fluid pressure is supplied from the nitrogen tank 1420 to the discharge valve assemblies 82 for preloading their valves, and to the accumulative cylinders 474 and 425 of the counterbalance cylinder 102 and the work cylinders 100 of the pump unit 20. Water, oil or other fluid upon which the pump unit 20 is to operate is supplied from the tank 28 or other suitable source to the feed pump 26 and from the latter, by the feed conduit 422, to the working cylinders 100 of the pump unit, from which cylinders the fluid is discharged by the piston valves in the pump cylinders into the pipes or conduit 104 of the Y-tube assembly 30. By means of the Y-tube assembly and the conduits 152 the fluid is supplied to the interior of a well bore or to any other object to which the fluid pressure and the wave generated therein is to be applied.

The reciprocation of the pump pistons in the working cylinders 100 operates to produce a high frequency pulsating wave in the fluid medium as hereinbefore set forth. Further, the pump pistons serve to drive or propel the fluid medium through the conduits 104 previously mentioned. In conjunction with the propulsive action of the working cylinders of the pump unit, the discharge valve assemblies through the tubes 110 serve to discharge fluid from the Y-tube assembly and from the pipes and conduits connected therewith. By appropriately timed operation of the discharge valves, under specific variable timing control means hereinbefore set forth, further high frequency energy carrying waves may be set up in the fluid.

The stroke of the working pistons of the pump unit are capable of a wide range of variation as to the time of the stroke, the duration of the stroke, the velocity, acceleration and range of movement of the pistons during their stroke, while additionally the phase relation between the pistons can also be adjusted.

Figures 73, 74, 75, 76:
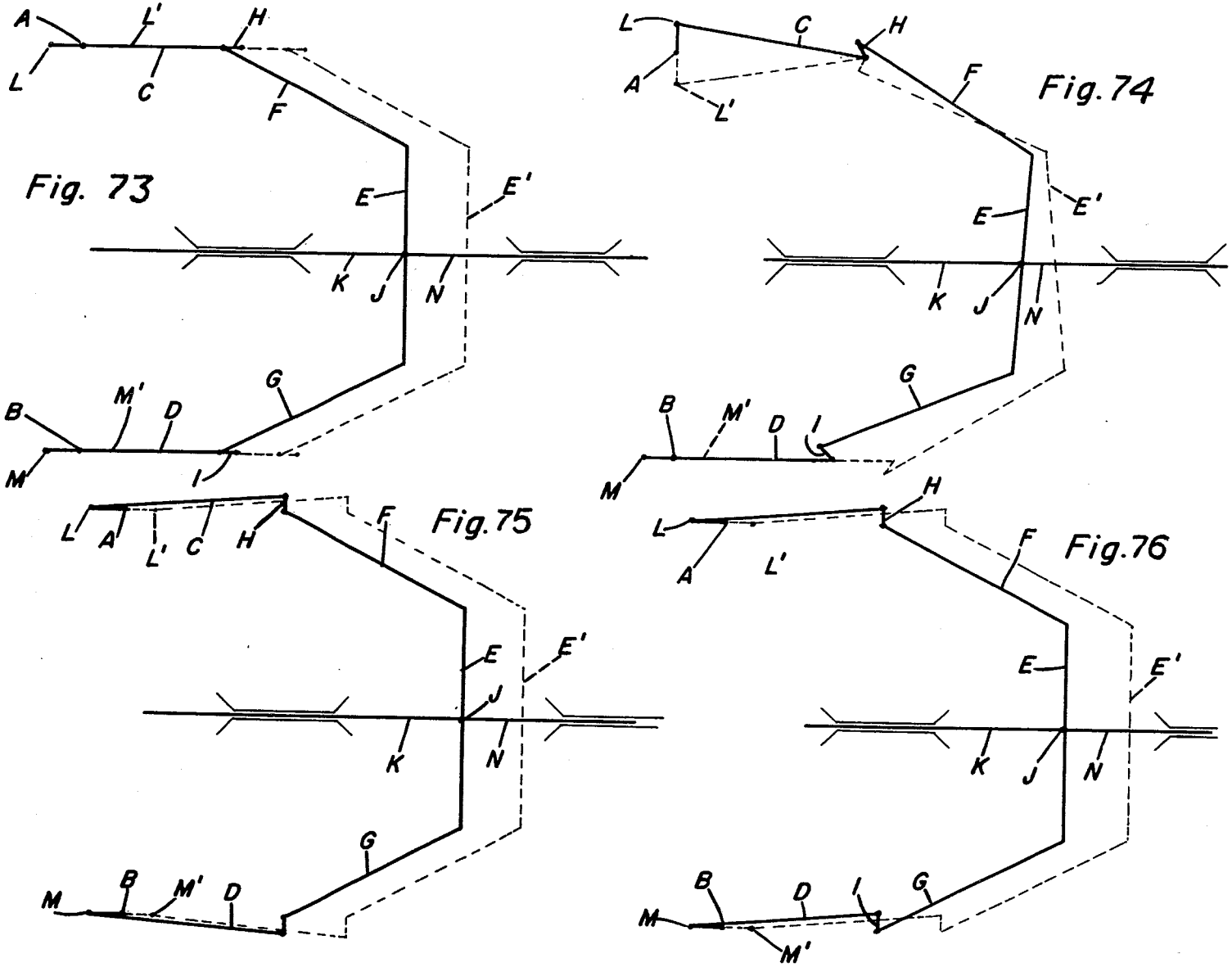
FIGS. 73–76 are diagrammatic views of the rocker mechanism for varying the stroke of the pump and counterbalance pistons.

The angular or phase relation between the two crankshafts 170 and 172 rotating at a uniform velocity can be adjusted by the differential assembly 196 operatively interposed therebetween as shown in FIG. 14, thereby resulting in considerable variation in the type of motion, see FIGS. 73 and 74, imparted to the reciprocating crosshead or slide 290, see FIG. 25, through the pair of rockers 328, see FIG. 15, which rockers are connected to the pair of crankshafts.

In addition to the variation of motion imparted to the slides and pistons by adjusting the phase relation between the two crankshafts, it is also obvious that further considerable variation can be obtained by appropriate individual adjustments of the eccentric bearings 344 of the wristpins by which each end of the rocker assemblies is secured to one of the two crankshafts.

For a more complete understanding of the type of variation of movement obtainable by the eccentric adjustments of the connections between the crankshaft connecting rods and the crosshead rocker arms, attention is now directed more specifically to FIGS. 73–76. In these diagrammatic views, the pair of crankshafts are indicated by the numerals A and B, and there are crankshafts C and D connected to the rocker E whose pair of oppositely extending arms F and G are engaged by adjustable eccentric connections H and I. The central portion of the rocker is shown pivoted as at J to the slide or crosshead K to which the pistons of the working and counterbalance cylinders are connected. The position of the crank throws or the crankshafts A and B to which the connecting rods C and D are pivoted is shown at L and M in FIG. 73 and the full line position of the rocker arm E, with the eccentric connections H and I being in a neutral position may be regarded as a normal position to which the other positions of adjustment may be compared. Shown in dotted lines in the position E′ of the rocker arm when the two crank throws L and M are disposed at 180° positions, or at L′ and M′. The position N therefore represents the normal distance of travel given to the slide K and therefore to the pump and counterbalance pistons during the rotation of the crankshafts in the above described neutral position of the associated parts of this mechanism.

In FIG. 74 is shown the position of the parts in which the differential gear assembly 196 has been manipulated to effect a different phase relation between the crankshafts A and B, from that shown in FIG. 73, as by advancing the crankshaft A 90° with respect to that of B. The full and dotted line positions again show respectively the rearward and forward extremities of the slide during its operation for the setting of the parts with the eccentrics being again in their neutral position.

FIG. 75 shows the effect upon the motion of the slide and therefore upon the pistons of the pump unit which may be obtained by adjusting the eccentric connections H and I each to their maximum away from the central line or axis of travel of the reciprocating slide K.

FIG. 76, in turn, shows the effect upon the motion imparted to the slide and pistons when the eccentric adjustments H and I are both adjusted in the same direction, with the crankshafts remaining in the neutral position shown in FIG. 73.

It will be noted that the adjustment of the eccentrics H, I or both, serves to vary the effective length of the rocker arms F or G as well as the effective length of the connecting C and D.

It will thus be understood that by means of the individual adjustments of each of the eccentrics H or I for each piston, as well as by the adjustment of the phase relation of the crankshafts A and B, a very wide variety of motions, accelerations, and amplitude or travel may be given to the pistons, thereby varying their stroke from zero to a maximum, and also providing an infinite number of variations in their accelerations.

OPERATION OF VARIABLE TIMING MECHANISM FOR THE DISCHARGE VALVE ASSEMBLY

Reference is next made to FIGS. 61–72, for an explanation of the variably timed actuation of the discharge valves, these figures diagrammatically illustrating the elements for actuating the discharge valves and their motions during operation of the valves at various time intervals. Briefly, each discharge valve is actuated by an actuating lever 838 which is pivoted at its midportion at 842 to the valve push rod 708. The upper end of the lever 838 is connected by the connecting rod 834 to the continuously rotating crankpin 832 and therefore continuously oscillates with the latter. The lower end of the lever 838 is selectively freed for oscillation, or is operatively held by variably timed fulcrum means, thereby imparting varied movements to the push rod 708.

Figure 62:
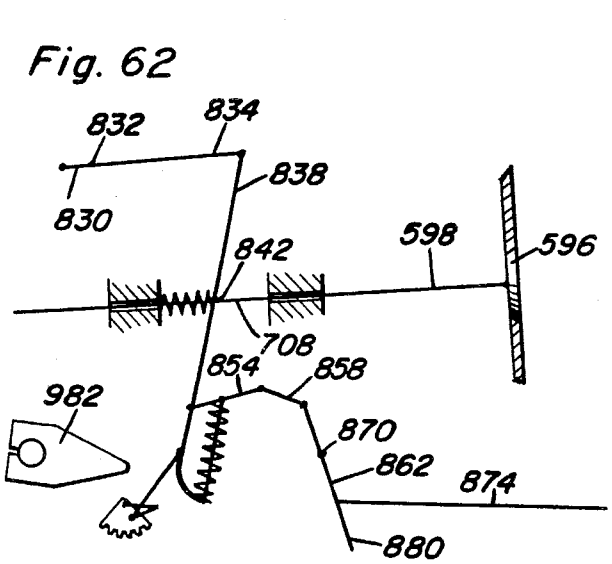
FIGS. 61–72 are diagrammatic views of mechanisms for the variably timed operations of the discharge valves of the pump units.
Figure 61:
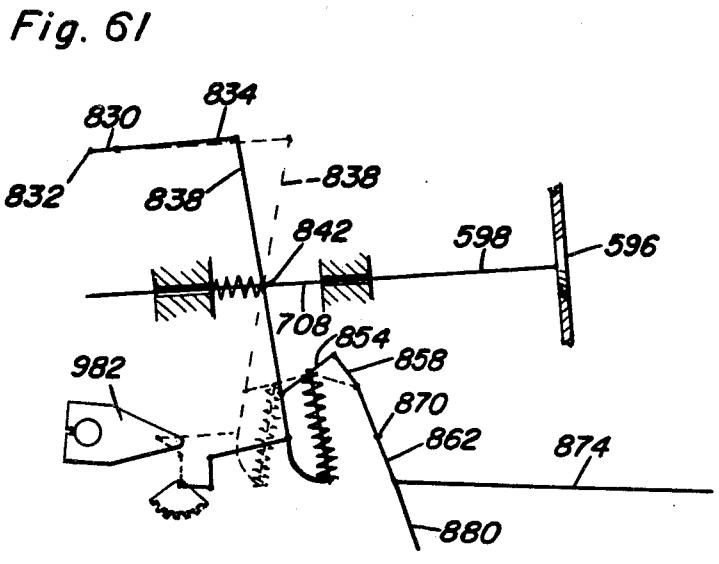

Referring first to FIGS. 61 and 62, there is seen the position of the parts when the actuating mechanism for the discharge valves is in a neutral position so that the valve is not operated and remains closed. As will be seen from FIGS. 61 and 62, the several variable timing mechanisms which are operatively associated with the lower end of the valve actuating lever 838 are operatively disconnected from the latter so that as the crankshaft carrying the crank throw 830 rotates, the crank 832 thereon through the connecting rod 834 will impart oscillation to the valve actuating lever 838 so that the latter will continuously pivot or oscillate about its pivotal connection 842 on the push rod 708, without imparting reciprocatory movement to the latter. FIG. 61 shows in full lines the positions of these parts for one position of the crankpin 832, while FIG. 62 shows in full lines and FIG. 61 in dotted lines the position of the valve actuating lever 838 when this crankpin is rotated through 180°. As will be seen, continuous rotation of the crankpin 832, in this position of the mechanisms, merely imparts idle oscillation to the valve actuating lever 838 about is pivot 842 on the push rod 708, without imparting reciprocatory travel to the latter. Therefore, for this position, the valve 596 remains closed.

Figure 64:
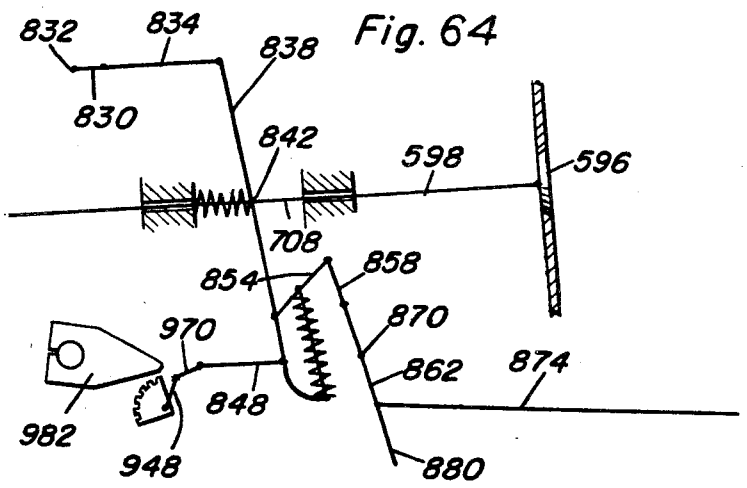
Figure 63:
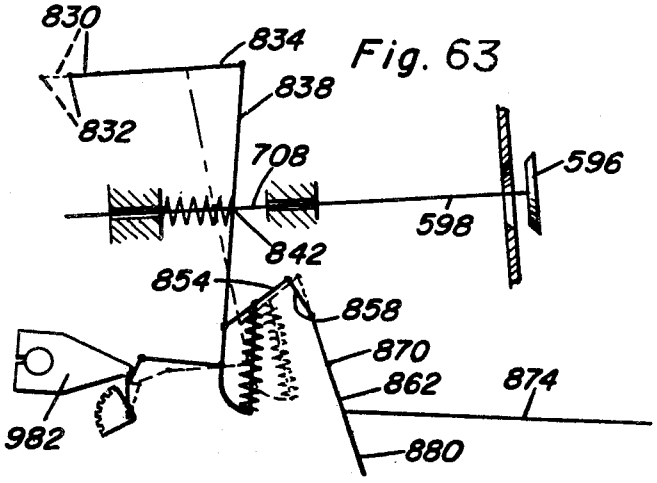

FIGS. 63 and 64 show the position of the parts when the variable timing mechanisms are adjusted in order to effect automatic operation of the valve to cause the latter to open once for each ten revolutions of the crankpin 832.

As previously mentioned in connection with FIGS. 61 and 62, the valve actuating lever 138 continuously oscillates in response to the continuous rotation of the crankpin 832. Free oscillation of the lower end of the valve actuating lever is permitted by virtue of the free pivoting action of the pair of toggle links 854, and 858, the former being pivoted to the actuating lever and the latter being pivoted to the lever 862. Further, the lower end of the valve actuating lever 838 is pivoted to a link 848 which in turn is pivoted to an assembly which in turn is pivoted to a crank arm 970 within the housing 948. The latter is arcuately adjusted to cause the side of the housing to be moved into or out of engagement with the cam 982 which rotates at one-tenth of the speed of the crankshaft carrying the crankpin 832. The arrangement is such that the cam 982 will once each ten or other preset number of revolutions of the crankshaft and oscillations of the lever 838 be disposed against the housing 948 as shown in FIG. 63 to thus prevent movement of the link 848 towards the left. Consequently, the cam 982 and the link 848 constitute a fixed abutment which holds the lower end of the lever 838 in the position shown at FIG. 63, preventing oscillation of the link 848 towards the left and thus providing a temporary fixed fulcrum for the lower end of the actuating lever 838, whereby the same will open and close the valves as will be apparent from FIGS. 63 and 64.

Figure 66:
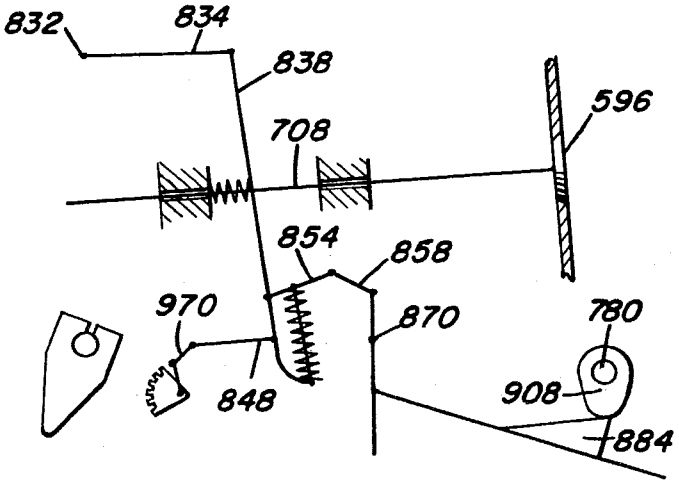
Figure 65:
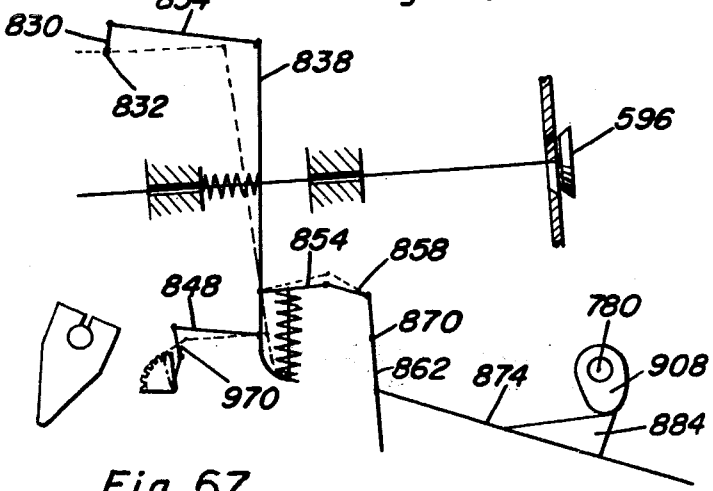

Referring now to FIGS. 65 and 66 it will be seen that another variable timing mechanism is operable to effect opening and closing of the valve during each 100 or other desired preset revolutions of the crankshaft having the crankpin 832. For this purpose the cam 908 upon the shaft 780, the latter being operable in the present illustration at a one to one hundred ration from the shaft having the crankpin 832 thereon, is adapted during its rovolution to engage the slide 884 mounted upon the stem 874 of the lever 862. Consequently, each time this cam engages the slide, the lever 874 will be rocked downwardly about its fulcrum 870. This in turn will straighten the toggle links 854 and 858 and will thus provide a fulcrum for the lower end of the actuating lever 838. Consequently, as the pin 832 moves the upper end of the lever 838 towards the right, the pivotal connection of the latter at 842 upon the push rod 708 will move the latter towards the right and thus open the valve. This position is shown in FIG. 65, while FIG. 66 shows the manner in which continued rotation of the crankpin 832 will allow the valve actuating lever 838 to move to the dotted line position shown in FIG. 65 or the full line position of FIG. 66 at which time the valve will be closed.

It will be observed that while the cam 908 engages the slide 884 only once for each 100 or other preset number of revolutions of the crankpin 832, that this engagement may be of sufficient duration to cause the continuously reciprocating crankpin and the oscillating actuating lever 838 to cause a number of openings and closings of the valve. The amplitude of movement of the lever 862 and the number of acutuations thereof by a revolution of the cam 908 can be controlled by the sliding adjustment thereon of the slide 884.

It is also possible to cause actuation of the valve once for each revolution of the crankpin 832. For this purpose, the lever 862 is again utilized. In this arrangement, the adjusting screw 904 is moved down to cause the same to engage and depress the stem 874 of the lever 862, thereby rocking the lever downwardly about its fulcrum 870, and straightening the toggle links 854 and 858 in the same manner as was affected by the cam 908. When the lever 874 is depressed, whether intermittently by the cam 908 or continuously by the manual adjustment 904, the toggle links are straightened, and there is thus provided an effective stationary fulcrum for the lower end of the valve actuating lever 838, whereby the latter will be oscillated about this fulcrum and in turn will cause reciprocation of the push rod 708 and of the valve 596 once for each revolution of the crankpin 832.

Figure 69:
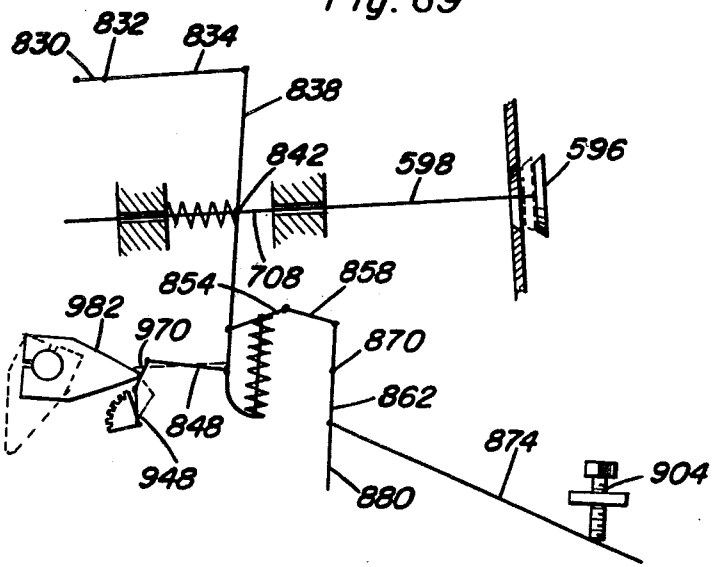

The variable timing mechanism for the valve operation also permits any combination of these variable timed actuations to be effected. Thus, as indicated in FIG. 69, the valve may be actuated once each revolution of the crankpin 832, as explained in connection with FIGS. 93 and 94, and also once each 10 or other preset number of revolutions of the crankpin by simultaneous operation of the mechanism shown and described in connection with FIGS. 63 and 64.

Figure 70:
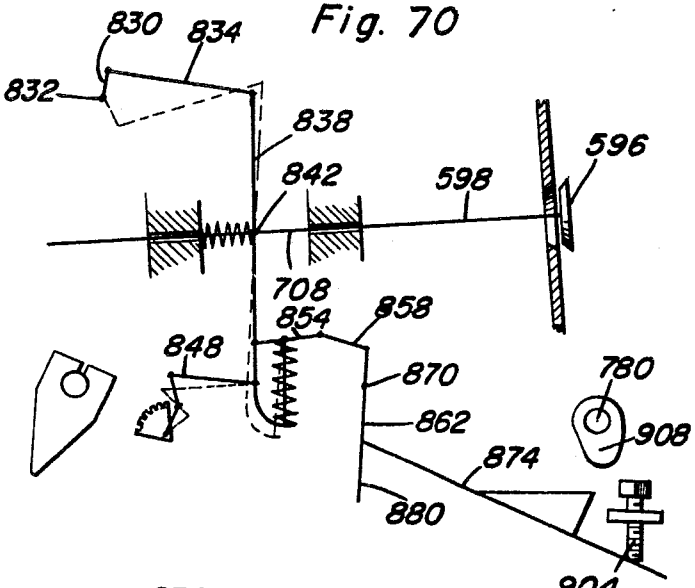

Further, as shown in FIG. 70, the valve may be operated once each revolution of the crankpin in the same manner as set forth in connection with the mechanism of FIGS. 67 and 68, and in addition may be operated once each 100 or other desired preset number of revolutions of the crankpin 832 by employing the actuating mechanism of FIGS. 65 and 66.

Figure 71:
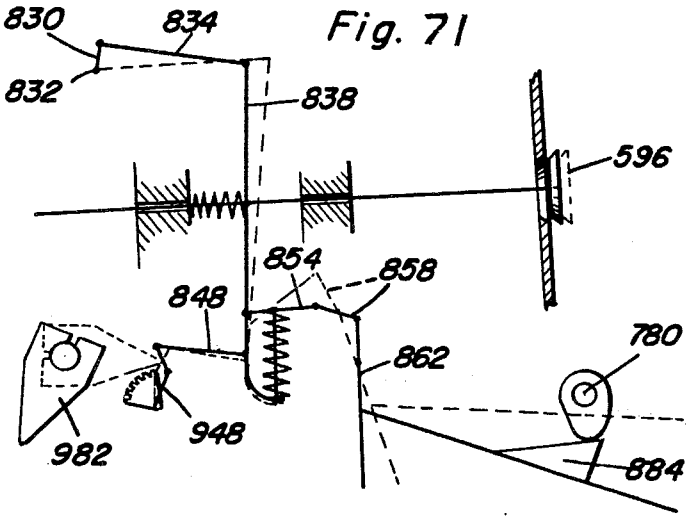

As shown in FIG. 71, it is also possible to combine actuation of the valve every 10th or other preset number of revolution of the crankpin 832 as shown and described in connection with FIGS. 63 and 64, and in addition to actuate it once each 100 or other preset number of revolutions of the crankpin as shown and described in connection with the arrangement of FIGS. 65 and 66.

Figure 68:
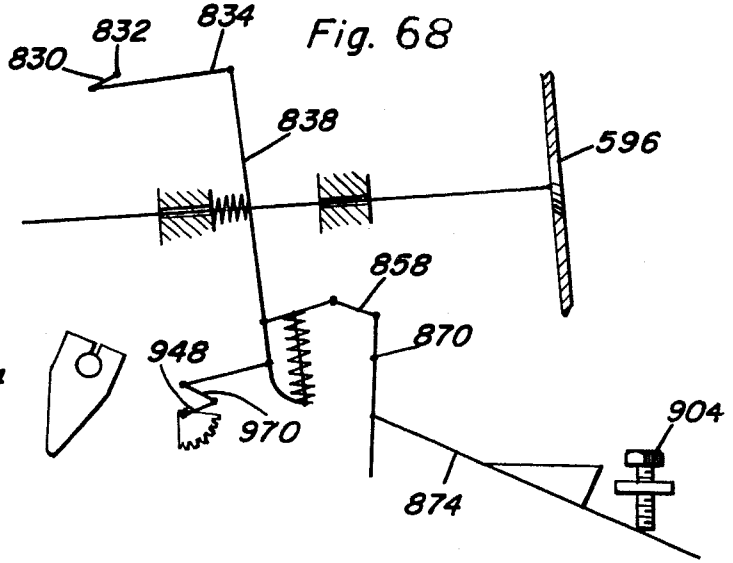
Figure 67:
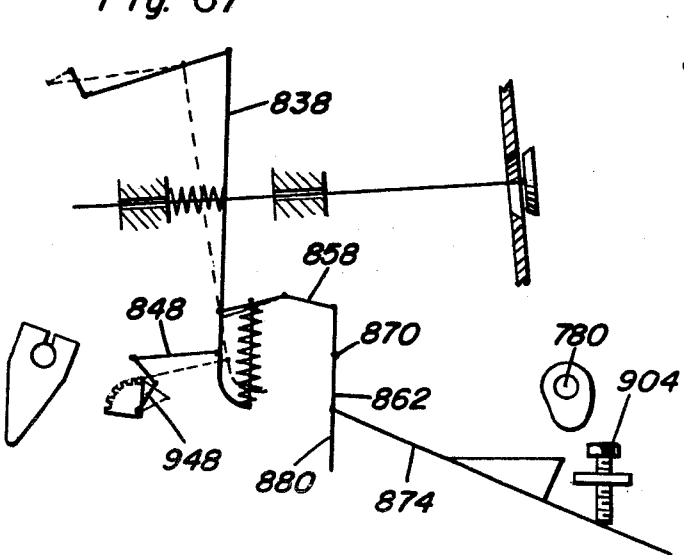
Figure 72:
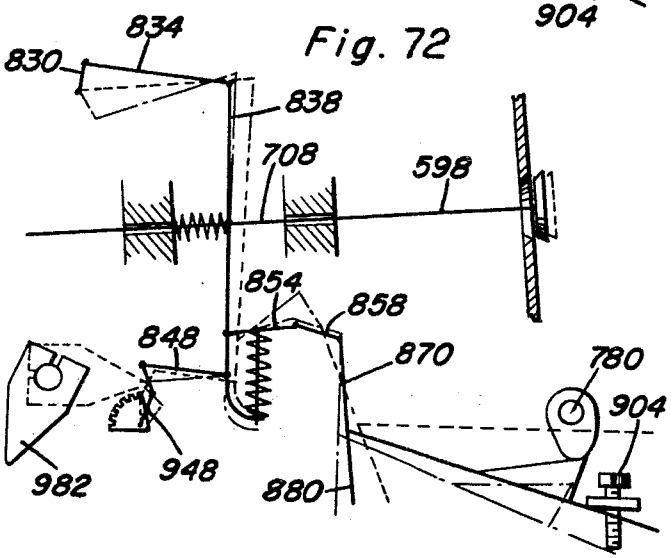

Finally, it is possible to employ all three actuations, as shown by way of illustration only, in FIG. 72, whereby the valve will be actuated for each revolution of the crankpin by the arrangement shown in FIG. 67 and 68; will be also actuated each 10 revolutions of the crankpin as shown in connection with FIGS. 63 and 64; and in addition will be operated for each 100 revolutions of the crankpin as shown in FIGS. 65 and 66.

In the operation of this apparatus, not only is it possible to impart numerous variable timed actuations to the valve 596 of the discharge valve assemblies 82, but that any desired phase relation may be obtained between the valves of the two discharge valve assemblies. This is accomplished through the differential gearing assembly 790 through the driving gears 750 for each of the valve actuating driving shafts 752. Thus, the time of valve opening for one discharge valve assembly, for all of its variably timed operations at different ratios with respect to the operation of the shaft 752, can be caused to lead or lag the operation of the corresponding pump pistons of the pump unit 20 to produce a cavitating effect, and to generate secondary and tertiary energy carrying waves as set forth hereinafter.

It will be noted that, by the hereinbefore described control means, the various valve actuating mechanisms for imparting different ratios of valve actuations with respect to the continuously rotating valve driving shaft are positioned for remote control from the exterior of the apparatus and without necessitating any interruption to the functioning of the pump assembly or the discharge valve assembly during such adjustments.

What I claim:

1. That method of maintaining a predetermined pressure upon a fluid medium and thereby transmitting a sonic wave between a sonic wave generator and a means of reception comprising oscillating a valve in head piston between a compressible energy storage means and a column of pressured fluid contacting said means of sonic wave reception, making up losses in the predetermined pressure of said fluid medium by admittance of additional fluid through said piston valve from a source of pressured fluid during accelerated rarefaction oscillations of said piston against said compressible energy storage means, adding said additional fluid into said fluid medium during compressional oscillations of said piston, including increasing the pressure being maintained on said fluid medium column by increasing the accelerations imposed on said rarefaction oscillations.

2. The method of claim 1 including increasing the intensity of said transported sonic wave by increasing the compressional accelerations of said oscillation imposed on said piston.

3. The method of claim 1 including imposing cavitational modulations upon said sonic wave during said accelerated rarefaction oscillations, transporting said modulations to said reception means by said sonic wave.

4. The method of claim 3 including varying the phase angle of said cavitational modulation in relation to said rarefaction oscillations of said transporting sonic wave.

5. The method of claim 3 wherein said cavitational modulation comprises withdrawing pressured fluid and sonic wave energy from said pressured fluid column transmitting said sonic wave energy to said reception means.

6. The method of claim 5 including varying the phase angle of said withdrawal of said pressured fluid and sonic wave energy in relation to said rarefaction oscillations of said transporting sonic wave.

7. The method of claim 5 including imposing said cavitational modulation upon siad rarefaction accelerations of said oscillations of said sonic wave being transported to said sonic wave reception means, making up losses created in said predetermined pressure of said fluid column of said cavitational withdrawals by admittance of additional fluid through said piston valve from said source of pressured fluid, increasing the intensity of the whole of said sonic wave being transported to said reception means by adding said additional fluid into the compressional portion of the sonic wave following said rarefaction portion upon which said cavitational modulation is imposed.

8. The method of claim 7 including heating said fluid being admitted through said piston valve under the influence of said cavitational withdrawals, compressing said heated fluid into the compression phase of the sonic wave following said cavitational withdrawal, intensifying the heat of compression of said sonic wave, transporting the heat from said intensified modulated sonic wave to said sonic wave reception means.

9. The method of claim 8 including varying the phase angle of said addition of heat in relation to the rarefaction and compression phases of said transporting sonic wave.

10. The method of claim 8 wherein said transmitting fluid column is maintained in a substantially liquid phase during said rarefaction and compression phases and the transportation of said heat, and said reception means becomes substantially gaseous during at least the reception of said rarefaction phase or said heat.

11. The method of claim 10, wherein said reception means accumulates heat.

12. The method of claim 7, wherein said withdrawal of pressured fluid and sonic energy is achieved by opening of a discharge valve in timed relationship to the said oscillation of said piston.

13. The method of claim 12, wherein said valve is substantially balanced as to the area exposed to said pressured fluid and the discharge opening from said valve, giving lowered energy requirements for rapid opening of said valve.

14. The method of claim 13 including means built into said valve for metering the amount of pressured fluid and sonic wave wave energy discharged from said valve.

15. The method of claim 14 including varying the phase angle of said opening of said discharge valve in relation to said oscillation of said piston.

16. The method of claim 12 including varying the phase angle of said opening of said discharge valve in relation to said oscillation of said piston.

17. The method of claim 12 including means for varying the amount of opening, the dwell of or the abruptness of closing of said valve, creating variations in characteristics of said modulation transported to said sonic wave reception means.

18. The method of claim 17 including compressible means for assisting in the controlled opening and closing of said valve, means for varying the compression thereof as to said valve.

19. The method of claim 1 including heating said fluid admitted through said piston valve during said rarefactions, compressing said heated fluid into said sonic wave during compressional oscillations of said piston, increasing the heat of compression of said sonic wave, transporting said heat to said sonic wave reception means.

20. The method of claim 19 wherein said transmitting fluid column is maintained in a substantially liquid phase during said rarefaction and compression oscillations, and said reception means becomes substantially gaseous during at least the reception of said rarefaction oscillations.

21. The method of claim 20 wherein said reception means accumulates heat.

22. The method of claim 1 including oscillating at a phase angle a second of said sonic wave generators from a common drive means, controlling the admittance of pressured fluid through said second generator, transmitting sonic waves from said second generator to said sonic wave reception means to combine with the sonic wave from said first generator, creating at said reception means sonic waves of controllable characteristics.

23. The method of claim 22 including imposing cavitational modulations upon the sonic waves from said second generator, transporting said modulations to said reception means by said sonic waves from said second generator.

24. The method of claim 23 including creating by said modulations the admittance of heated fluid through said second generator, modulatingly compressing the heat from said heated fluid into said sonic wave from said second generator, transporting said intensified modulated compression wave to said sonic wave reception means for depositation of said heat.

25. The method of claim 23 including imposing cavitational modulations upon the sonic wave from said first generator, transporting by sonic waves the modulations from both of said generators to said reception means, creating in said reception means modulated sonic waves of variable characteristics.

26. The method of claim 25 including creating by said modulations the admittance of heated fluid through both said generators, modulatingly compressing the heat from said heated fluid into said sonic waves from both said generators, transporting said intensified modulated compression waves to said sonic wave reception means for depositation of said heat.

27. The method of claim 26 including varying the phase angle of the modulations compressing said heat into said first and second sonic waves being transported from each of said generators, depositing in said sonic wave and heat reception means controllable variations in said transportation of said heat.

28. The method of claim 22 including heating the fluid controllably admitted through said second generator, compressing heat from said fluid into said second generated sonic wave, heating the fluid admitted through said first generator, compressing the heat from said fluid into said first generated sonic wave, transporting to said sonic wave reception means said heat compressed from the fluid admitted to both sonic wave generators.

29. The method of claim 28 including varying the phase angle of said admittance of said heated fluid into said second generator in relation to said admittance of heated fluid into said first generator.

30. The method of claim 1. wherein said transmitting fluid column is maintained in a substantially liquid phase during said rarefaction and compression oscillations, and said reception means becomes substantially gaseous during at least the reception of said rarefaction oscillations.

31. The method of claim 30 wherein said reception means accumulates sonic wave energy.

32. A generator and modulator of energy transmitting waves in a liquid medium comprising a pump cylinder having communication with a liquid medium and a reciprocating pump piston with a one-way valve in its head having direct contact with said liquid medium during generation of compression and rarefaction phases of said energy waves, inlet means for supplying liquid through said piston and valve to said liquid medium during said rarefaction phases, means for reciprocating said piston to generate an energy transmitting wave in said liquid medium, pressure means for loading said pump cylinder adjacent said inlet means, a valve chamber having communication with said liquid medium and a valve therein for containing the pressure of said liquid in said valve chamber in communication with the liquid medium contacting said piston, operating mechanism for cyclically and variably opening said valve to discharge said liquid medium and modulate said energy waves at controllable and variable time intervals in relation to said reciprocation of said piston.

33. The combination of claim 32 wherein said reciprocation of said piston is balanced by a controllably pressured compressible fluid.

34. The combination of claim 32 wherein said variable opening of said valve and the amount of said liquid medium discharged therefrom variably controls the rarefactions produced at the face of said piston, variably controlling therewith the intensities in the rarefactions and compressions being produced in the energy transmitted in said liquid medium during said cyclically modulated energy wave.

35. The combination of claim 32 wherein said means for reciprocating said piston includes a crank throw on a drive shaft, a connecting rod from said crank throw to a cross head, a push rod from said cross head to said piston, means connected to said drive shaft for balancing said reciprocating and revolving mechanisms.

36. The combination of claim 35 including varying the length of said connecting rod in relation to the amount of said crank throw to vary the moments of acceleration of the reciprocation of said piston, creating thereby variations in the intensity of the rarefactions and compressions in said liquid medium at the face of said piston.

37. The combination of claim 32 including means for balancing the pressure needed to open said valve.

38. The combination of claim 37 wherein said balancing pressure upon said valve consists of substantially equal areas of said valve head being exposed to pressures of said liquid medium during the opening and closing of said valve.

39. The combination of claim 38 including means for introducing a compressible fluid under pressure against said valve for applying a closing force to said valve.

40. The combination of claim 38 wherein said valve head is so contoured as to balance the pressure of fluid flowing past said valve.

41. The combination of claim 38 wherein said valve head is so contoured as to have a metering effect upon the inertia of said fluid at rest and flowing past said valve upon the variable inward thrust of said valve away from its seat.

* * * * *